US005370237A

United States Patent [19]

Anderson et al.

[11] Patent Number: 5,370,237

[45] Date of Patent: Dec. 6, 1994

[54] METHOD AND APPARATUS FOR ATTACHING CONNECTORS TO A CABLE

[75] Inventors: Carl R. Anderson, Arvada; Gary G. Seaman, Broomfield, both of Colo.

[73] Assignee: AT&T Bell Laboratories, Murray Hill, N.J.

[21] Appl. No.: 127,025

[22] Filed: Sep. 27, 1993

[51] Int. Cl.[5] ..... B07C 5/00

[52] U.S. Cl. ..... 209/556; 29/712; 29/857

[58] Field of Search ..... 209/556; 29/861, 33 M, 29/711, 712, 564.6, 857, 564.1

[56] References Cited

U.S. PATENT DOCUMENTS

| | | | |
|---|---|---|---|
| 3,986,256 | 10/1976 | Kilpatrick et al. | 29/628 |
| 4,034,472 | 7/1977 | Cover et al. | 29/749 |
| 4,107,838 | 8/1978 | Keen et al. | 29/628 |
| 4,310,967 | 1/1982 | Funcik et al. | 29/749 |
| 4,461,074 | 7/1984 | Holt | 29/749 |
| 4,470,181 | 9/1984 | Sergeant | 29/33 M |
| 4,928,066 | 5/1990 | Adlon et al. | 324/539 |
| 4,947,546 | 8/1990 | Bowling et al. | 29/861 |

OTHER PUBLICATIONS

The Western Electric Engineer, vol. XXV, No. 2, pp. 15-23, Spring/Summer 1981, entitled "Automatic Connectorizing of 25-Pair Cables" by Roger G. Ebrey, Herbert A. Sckerl and Gary G. Seaman, New York, N.Y.

*Primary Examiner*—D. Glenn Dayoan

*Attorney, Agent, or Firm*—Christopher N. Malvone

[57] ABSTRACT

A conductor handling apparatus uses a rotating disk to move a single conductor to a first position on a path where a conductor identifier is located. The conductor identifier identifies the conductor by completing a circuit used to detect a signal on the conductor. A controller rotates the disk in a direction based on the identity of the conductor, and a conductor unloader moves the conductor from the rotating disk. A conductor transfer mechanism moves the conductor from the unloader to a predetermined position where the conductor is inserted into a contact of a connector.

22 Claims, 70 Drawing Sheets

METHOD AND APPARATUS FOR ATTACHING CONNECTORS TO A CABLE

CROSS-REFERENCE TO RELATED APPLICATION

Related subject matter is disclosed in co-pending applications entitled "Method and Apparatus for Automatic Cable Assembly", "A Method and Apparatus for Capturing and Positioning a Cable", "A Method and Apparatus for Manipulating Wound Cables" and "A Method and Apparatus for Manipulating Connectors", filed concurrently herewith and assigned to the same assignee hereof.

TECHNICAL FIELD

The present invention relates to automated manufacturing, and more particularly, the automated manufacturing of cable assemblies.

DESCRIPTION OF THE PRIOR ART

With the ever-increasing use of electronic equipment, there is an increasing demand for multi-conductor cable assemblies to interconnect electronic equipment. The multi-conductor cable assemblies comprise multi-contact connectors at each end. At both ends of the cable, each of the conductors within the multi-conductor cable are connected to one of the contacts within the connector. In some standardized cable assemblies, each connector has fifty contacts, and attaching each conductor to the proper contact is a time-consuming, labor intensive task that is expensive and subject to frequent errors. Wiring errors add to the overall cost of providing cable assemblies because a wiring error often requires scrapping the entire cable assembly. In an effort to reduce costs and errors, the manufacture of cable assemblies has been partially automated. For example, U.S. Pat. No. 4,107,838 entitled "Arranging Randomly Positioned Articles Into Preselected Positions" discusses a partially automated system for manufacturing cable assemblies. Partially automated techniques addressed the problem of attaching the conductors of a cable to the contacts of a connector on one end of the cable, but they require human intervention to attach a connector to the other end of the multi-conductor cable.

SUMMARY OF THE INVENTION

The present invention solves the aforementioned problems by providing a fully-automated method and apparatus for manufacturing cable assemblies. The fully-automated process minimizes the need for human intervention, and thereby increases the rate at which assemblies can be manufactured while decreasing the manufacturing cost of the assemblies and decreasing the number of assemblies that must be scrapped due to error.

The present invention automatically attaches multi-contact connectors to both ends of a multi-conductor cable to create a cable assembly. The multi-conductor cable is automatically unreeled from large spools provided by the cable manufacturer. A multi-contact connector is attached to a first end of the cable by automatically receiving the end of the cable, ale sheathing the end of the cable, identifying each conductor, and attaching each conductor to the appropriate contact of the multi-contact conductor. After attaching the first connector, the appropriate length of cable is unreeled from the spool and captured by a take-up reel. The cable is cut from the spool so that the cut end of the cable can automatically have a connector attached. The cut end of the cable is attached to a second connector in a fashion similar to that which was used to attach the first connector to the other end of the cable. The resulting wound and connectorized cable is automatically tied to preserve the wound configuration, and it is dropped on a conveyor belt that delivers the completed assembly to a desired location. Additionally, a robotic system removes connectors from a shipping box and places them in a known position at the automatic connectorization stations.

A conductor handling apparatus uses a rotating disk to move a single conductor to a first position on a path where a conductor identifier is located. The conductor identifier identifies the conductor by completing a circuit used to detect a signal on the conductor. A controller rotates the disk in a direction based on the identity of the conductor, and a conductor unloader removes the conductor from the rotating disk. A conductor transfer mechanism moves the conductor from the unloader to a predetermined position where the conductor is inserted into a contact of a connector.

DETAILED DESCRIPTION

Figure 1:
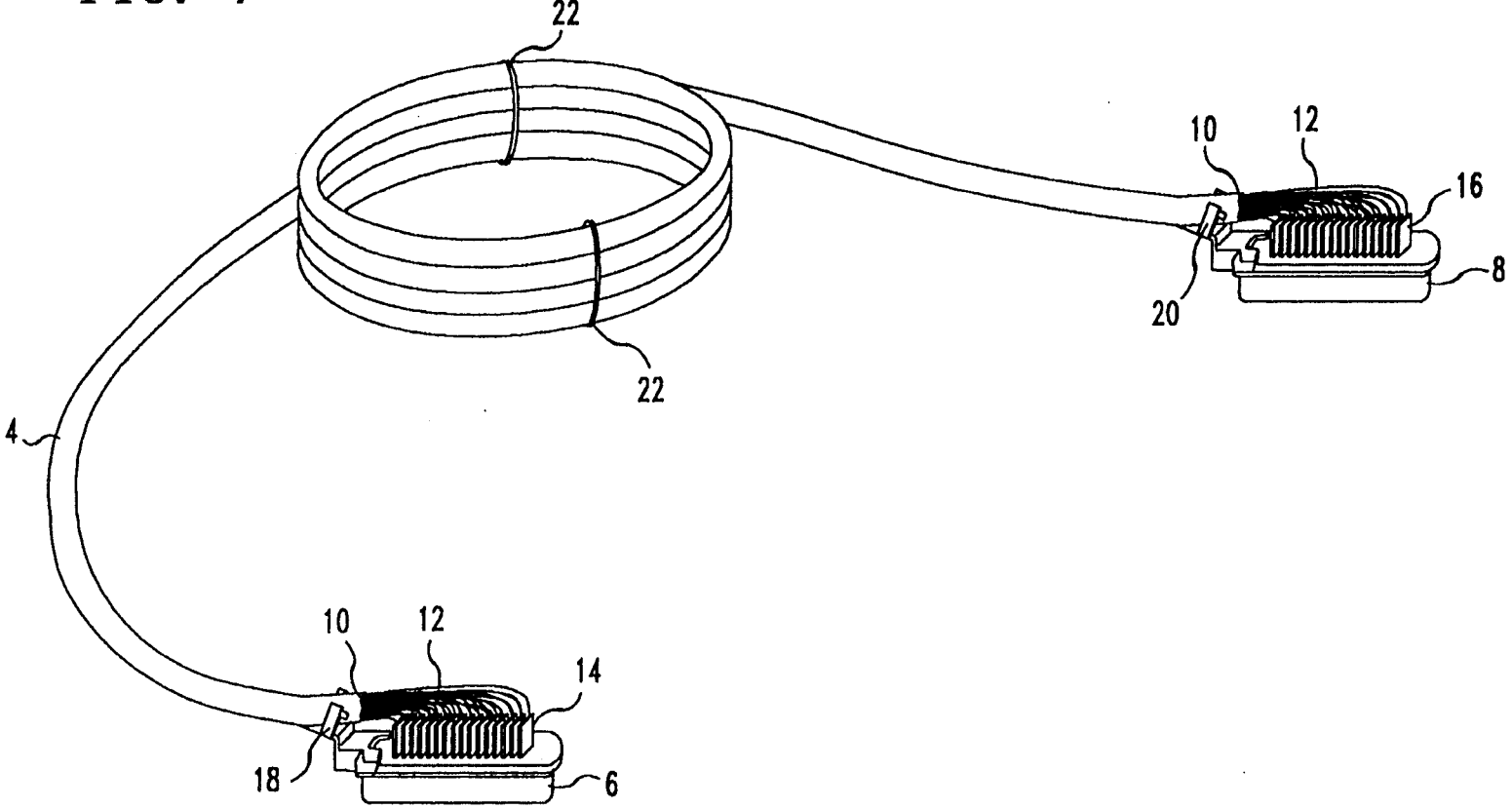
FIG. 1 illustrates a cable assembly.

FIG. 1 illustrates an example of a cable assembly that may be produced by the present invention. Cable assembly 2 comprises cable 4 and connectors 6 and 8. Cable 4 includes sheathing 10 which protects conductors 12. Conductors 12 are attached to insulation displacement type contacts 14 and 16 of connectors 6 and 8, respectfully. The ends of cable 4 are clamped by strain relief clamps 18 and 20 to minimize the possibility of accidentally breaking a connection between conductors 12 and the contacts of the connectors. Cable assembly 2 is held in a coiled configuration by ties 22 and thereby facilitates handling cable assemblies of varying length.

Manufacturing cable assembly 2 involves removing a portion of sheathing 10 from each end of cable 4 to expose conductors 12, identifying each of the conductors and attaching the conductors to the proper contacts of the connectors. The manufacturing also involves unreeling the proper length of cable, placing the cable in a coiled configuration and tying the coiled cable.

Figure 2:
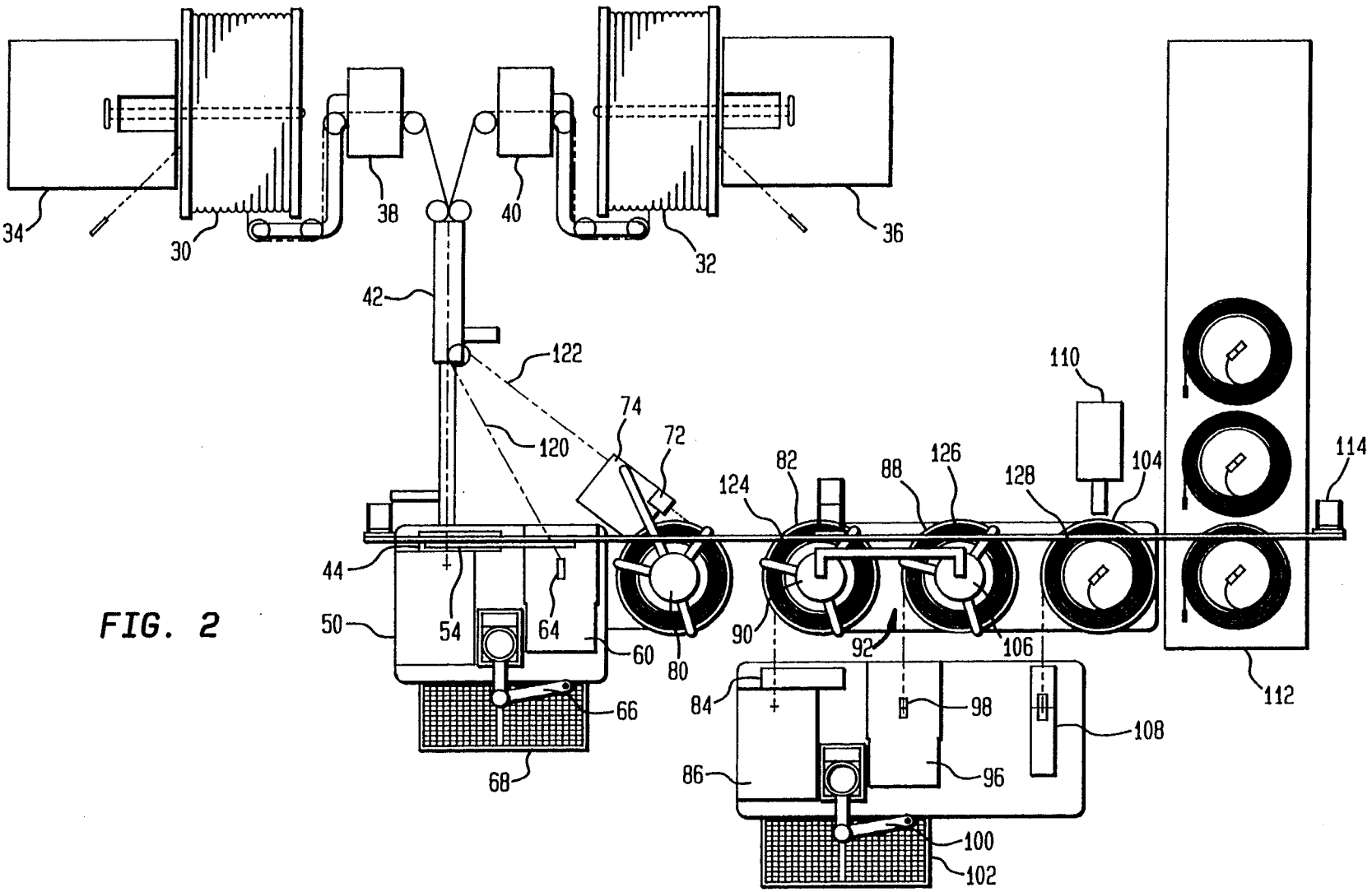
FIG. 2 illustrates the major components of a cable manufacturing system.

FIG. 2 illustrates the major components of a cable manufacturing system. The present invention automatically attaches multi-conductor connectors to both ends of a multi-conductor cable to form a cable assembly. The multi-conductor cable can be delivered in a variety of lengths and packages; however, it is preferable to use large spools 30 and 32 having several thousand feet of cable on each spool. Spools 30 and 32 are supported by spool lift mechanisms 34 and 36, respectively. The spool lift mechanisms raise the spools above the floor so that cable unreeling mechanisms can facilitate the removal of the multi-conductor cables from the spools. Cable unfeeling mechanism 38 facilitates removing the cable from spool 30 and cable unreeling mechanism 40 facilitates removing the cable from spool 32. After passing through the cable unreeling mechanisms, the cable enters cable pull mechanism 42. Cable pull mechanism 42 pulls the cable from each of the spools through their associated unfeeling mechanisms. Cable pull mechanism 42 feeds cable from spool 30 and 32 through cable guide and clamp mechanism 44 to desheath and comb station 50. Desheath and comb station 50 removes a portion of the cable's sheathing to expose a portion of the cable's conductor. The twists in the exposed conductors are removed by a combining or pressing of the wires. After station 50 desheaths the cable and removes twists in the exposed conductors, cable transport mechanism 54 moves the end of the cable to identify and connectorization station 60. At identify and connectorization station 60, each of the conductors within the cable are identified and attached to the appropriate contact of connector 64. Connectors are placed in identify and connectorization station 60 using a programmable positioning apparatus such as robot 66. Robot 66 moves connectors from containers 68 to identify and connectorization station 60.

After the conductors of the cable have been attached to the appropriate contacts of connector 64, cable transport assembly 54 moves the connectorized end of the cable to cable reeling mechanism 70. Once the connectorized end of the cable has been moved to cable reeling mechanism 70, cable reeling mechanism 70 begins to rotate so that it reels the cable into a coiled configuration as the cable is fed by cable pull mechanism 42. As the cable is being reeled by cable reeling mechanism 70, the cable is draped across cable guide mechanism 72 and cable locating mechanism 74. Cable locating mechanism 74 facilitates a uniform coiled configuration by controlling the level of each winding and captures the cable in a U-shaped channel that has retractable rollers which secure the cable within the channel. When the appropriate amount of cable has been pulled from the spool by cable pull mechanism 42, cable pull mechanism 42 cuts the cable. At this point, cable reeling mechanism 70 continues to rotate and reels the loose end of the cable toward cable locating mechanism 74. Ben the amount of cable to be reeled is less than the amount of cable that is taken up by approximately one revolution of cable reeling mechanism 70, cable reeling mechanism 70 stops rotating. The remaining portion of the cable is drawn toward cable locating mechanism 74 by a roller assembly within cable locating mechanism 74. This roller assembly creates a loop of cable and thereby draws the cut end of the cable towards a sensor within cable locating mechanism 74. When the end of the cable reaches the sensor, the roller assembly within cable locating mechanism 74 stops drawing the cable toward the assembly.

Rotating coiled cable transport 80 lifts the coiled cable from cable reeling mechanism 70, cable guide mechanism 72 and cable locating mechanism 74, and moves the coiled cable to coiled cable holding mechanism 82. Rotating coiled cable transport 80 also rotates the coiled cable so that the cut end of the cable is positioned at the input to cable feed and clamp mechanism 84. Cable feed and clamp mechanism 84 feeds the cut end of the cable into desheath and comb station 86 while coiled cable holding mechanism 82 maintains the coiled configuration of the cable. As was described with regard to desheath and comb station 50, desheath and comb station 86 removes the sheathing from the multiconductor cable, and combs out the twists in the exposed conductors.

After desheathing and combing, left pickup mechanism 90 of coiled cable transport 92 moves the coiled cable from coiled cable holding mechanism 82 to coiled cable holding mechanism 88, and positions the desheathed and combed end of the cable in identify and connectorization station 96. Coiled cable holding mechanism 88 maintains the coiled configuration of the cable while identify and connectorization station 96 identifies each of the cable's conductors and attaches each conductor to the appropriate contact of connector 98. Programmable positioning mechanism or robot 100 locates connectors within container 102 and places the connectors in identify and connectorization station 96.

After connector 98 has been connected to the cut end of the cable, the coiled cable is moved to slack take-up mechanism 104 by right pickup mechanism 106 of coiled cable transport 92. The coiled section of the cable is held in a coiled configuration by slack take-up mechanism 104 and connector 98 is held by sliding connector nest 108. Cable slack take-up mechanism 104 rotates to remove any slack that was created by cable locating mechanism 74 when it placed the loop in the cable. Cable slack take-up mechanism 104 rotates until sliding connector nest 108 moves toward cable slack take-up mechanism 104 and thereby indicates that the slack has been removed from the cable. Sliding connector nest 108 releases connector 98 so that connector 98 can be drawn onto slack take-up mechanism 104. Slack take-up mechanism 104 then stops rotating to permit coiled cable tie mechanism 110 to tie the cable so that it remains in a coiled configuration. After the cable is tied, right pickup mechanism 106 of coiled cable transport 92 lifts the coiled cable assembly from cable slack take-up mechanism 104 and places the cable assembly on conveyor 112 which delivers the cable assembly to a desired location.

Gantry system 114 is used to move cable transport mechanism 54, rotating coiled cable transport mechanism 80 and coiled cable transport mechanism 92 from location to location. Gantry system 114 includes optical switches which are used to define a home location for each of the cable transports, and the cable transports include retro-reflective scanners that are used to prevent collisions in the event of a malfunction.

In order to maximize efficiency, the cable assembly apparatus is operated in a manner that minimizes the idle time of each station. In normal operation, the cable is drawn from spools 30 and 32 in an alternating manner. For example, once the end of the cable from spool 30 has been moved to identify and connectorization station 60, the cable from spool 32 is fed to cable guide and clamp mechanism 44, and into desheath and comb station 50. In this way, desheath and comb station 50 can begin work on the next cable assembly before the cable from spool 30 is cut. Cable transport mechanism 54 moves the ends of two cables simultaneously. It moves one end of a cable from desheath and comb station 50 to identify and connectorization station 60, while moving a connectorized end of a cable from identify and connectorization station 60 to cable reeling mechanism 70. This situation is illustrated by the positions of cables 120 and 122. Once the end of cable 122 has been cut, the process is restarted by feeding cable from spool 30 to cable guide and clamp mechanism 44.

While the end of cable 120 is in identify and connectorization station 60, and cable 122 is being reeled by cable reeling mechanism 70, previously-reeled cables 124, 126 and 128 are held in coiled cable holding mechanisms 82 and 88, and slack take-up mechanism 104, respectively. When the slack removal and tying operations are complete on cable 128, cable pickup mechanism 106 moves cable 128 to conveyor belt 112. After moving cable 128, and when cable 124 has been desheathed and combed, and when cable 126 has been connectorized, pickup mechanisms 90 and 106 simultaneously move cables 124 and 126 to cable holding mechanism 88 and cable slack take-up mechanism 104, respectively. After cables 124 and 126 have been moved, cable 122, which by this time has been cut by cable pull mechanism 42 and reeled by cable reeling mechanism 70, is moved to coiled cable holding mechanism 82 by rotating coiled cable transport 80. The above-described operation is repeated and thereby minimizes the idle time of each station which results in maximizing the rate at which cable assemblies are manufactured.

Figure 3:
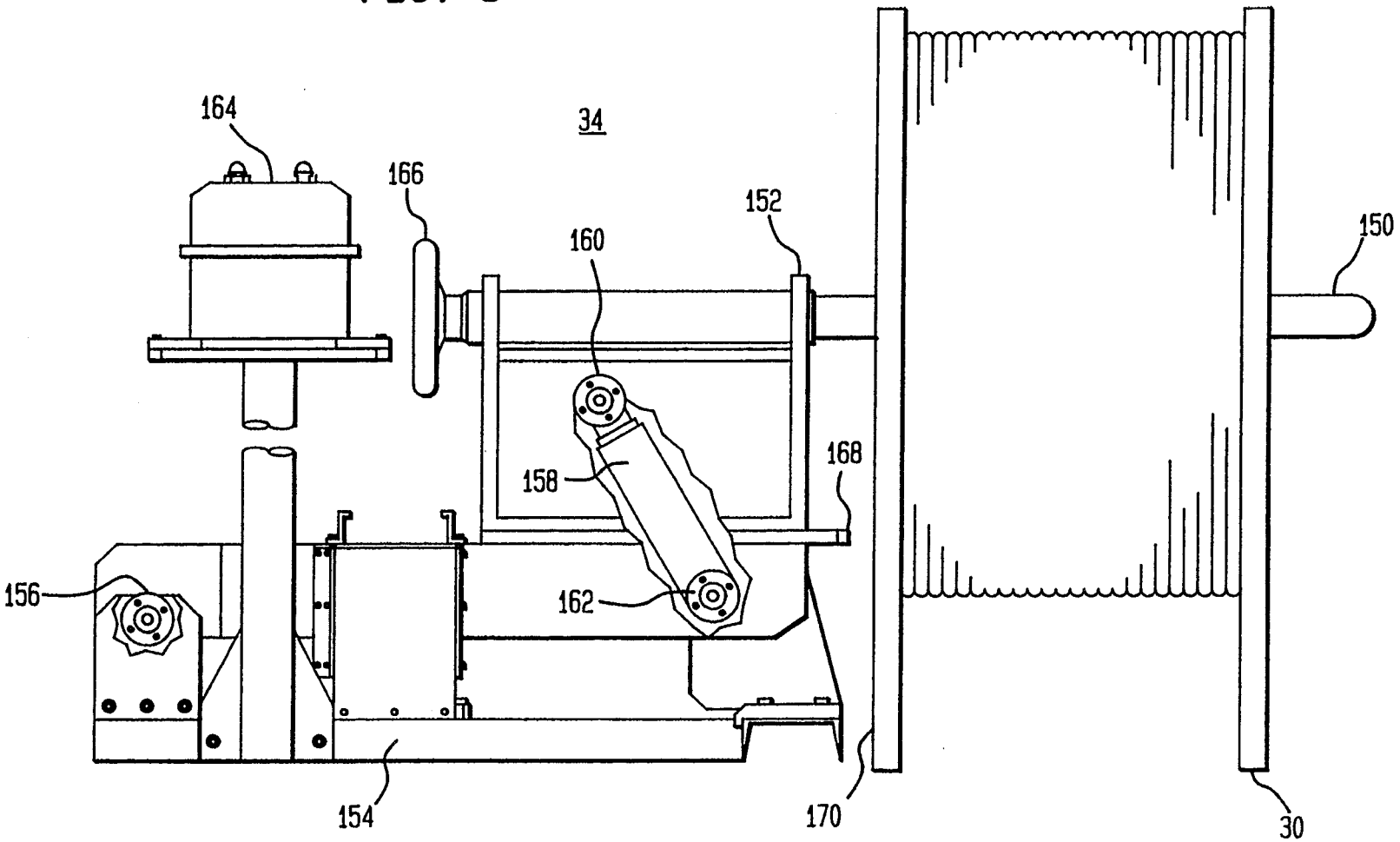
FIG. 3 illustrates a spool lifting mechanism.

FIG. 3 illustrates spool lifting mechanism 34. It should be noted that spool lifting mechanisms 34 and 36 are identical. When spool 30 is mounted on spindle 150. Spindle 150 is mounted on upper frame 152. Upper frame 152 is attached to base frame 154 by hinge 156. Linear actuator 158 has upper portion 160 attached to upper frame 152 and lower portion 162 attached to base frame 154. When linear actuator 158 is commanded to extend, it causes upper frame 152 to pivot about hinge 156. This motion raises spindle 150 and thereby lifts spool 30. Linear actuator 158 is commanded to extend or retract based on a simple up or down command entered via switches mounted on control box 164. Linear actuator 158 should be capable of lifting spools that weigh several hundred pounds. A linear actuator may be obtained from Thomson Saginaw Bail Screw Company, Inc., in Saginaw, Minn.

Spool 30 is mounted or removed from spool lift mechanism 34 by placing frame 152 in the lower position using control box 164. Once spool 30 is resting on the ground, handle 166 can be used to remove spindle 150 from frame 152 and thereby free spool 30. Spool 30 can be rolled away so that a replacement spool can be rolled into place. The replacement spool is mounted by simply using handle 166 to slide spindle 150 through frame 152 and through the center of spool 30. Spool 30 is then lifted by commanding actuator 158 to extend. In order to stablize spool 30, frame extension 168 extends from frame 152 to support outer portion 170 of spool 30. When in the raised position, there is sufficient room beneath spool 30 for the takeup pulleys of unreeling mechanism 38 to pass beneath spool 30.

Figure 4:
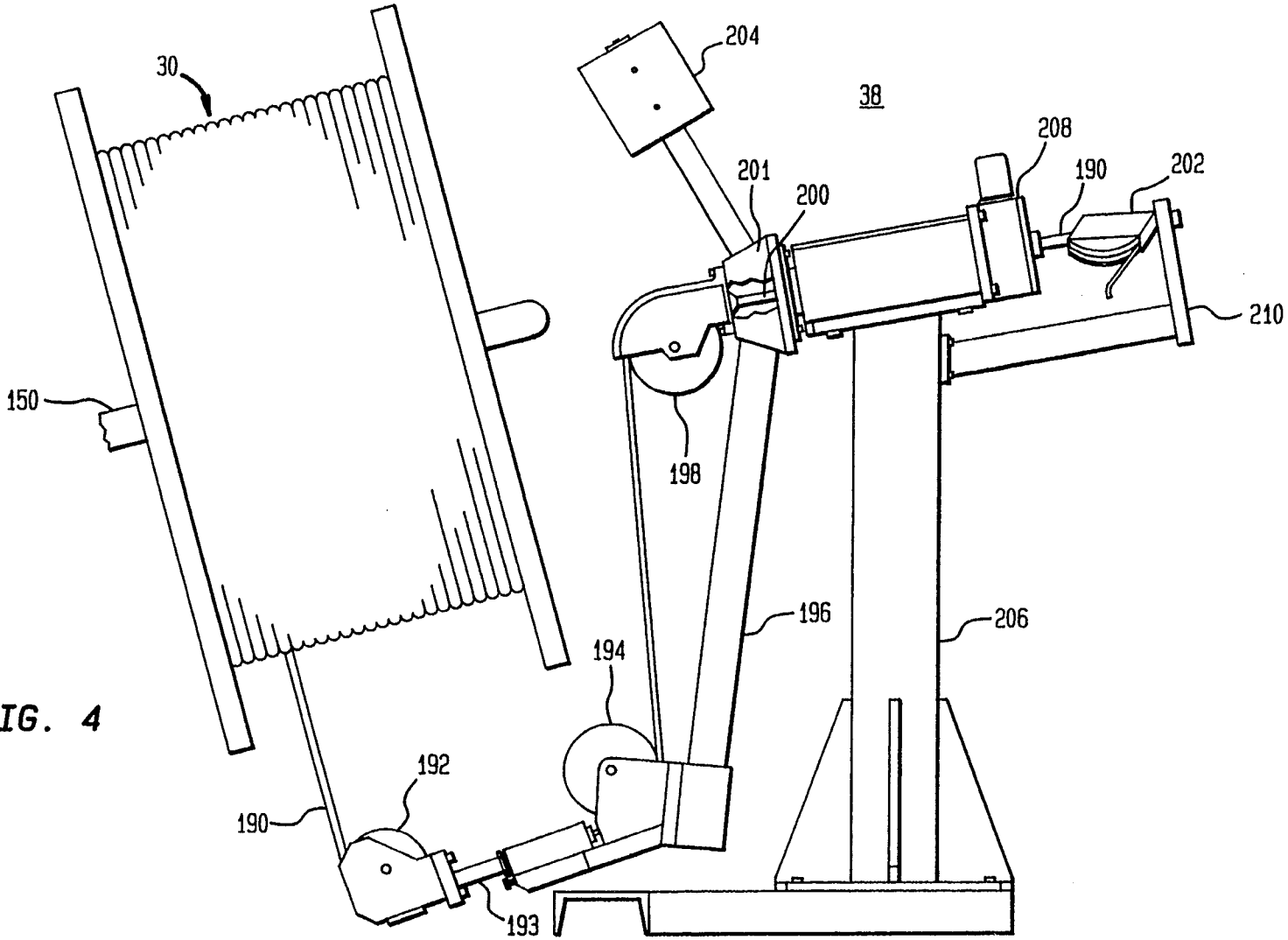
FIG. 4 illustrates a cable unreeling mechanism.

FIG. 4 illustrates cable unfeeling mechanism 38. It should be noted that cable unreeling mechanisms 38 and 40 are identical. Cable unreeling mechanism 38 is used to feed cable from spool 30 to cable pull mechanism 42 as cable pull mechanism 42 pulls the cable from spool 30 through cable unreeling mechanism 38. Cable 190 from spool 30 passes under pulley 192, through tubular channel 193 and under pulley 194 which are mounted on arm 196. Cable 190 then passes over pulley 198 and through axial channel 200 of hub 201. After passing through channel 200 cable 190 passes over pulley 202 and to cable pull mechanism 42. Arm 196, which supports pulleys 192 and 194, rotates about channel 200. Counter-weight 204 is used to facilitate the rotation of arm 196. Hub 201, which supports arm 196, is mounted to frame 206. Hub 201 is mounted to frame 206 through drag mechanism 208. Drag mechanism 208 permits hub 201 to rotate; however, it can apply a programmable drag to hub 201. Drag mechanism 208 may be any of the commercially available drag mechanisms such as drag mechanisms available from Warner Electric, Electric Brakes and Clutches in South Beloit, Ill. To provide flexibility with regard to the placement of unreeling mechanism 38 with respect to cable pull mechanism 42, pulley 202 is rotationally mounted on frame extension 210 which is mounted to frame 206.

Cable unreeling mechanism 38, permits cable to be withdrawn from spool 30 without rotating spool 30. As cable is pulled through pulleys 192, 194, 198 and 202 by cable pull mechanism 42, arm 196 rotates around spool 30 to enable cable unreeling without rotating the spool. The drag applied by drag mechanism 208 is controlled to prevent arm 196 from continuing to rotate after cable mechanism 42 stops pulling the cable.

Figure 5:
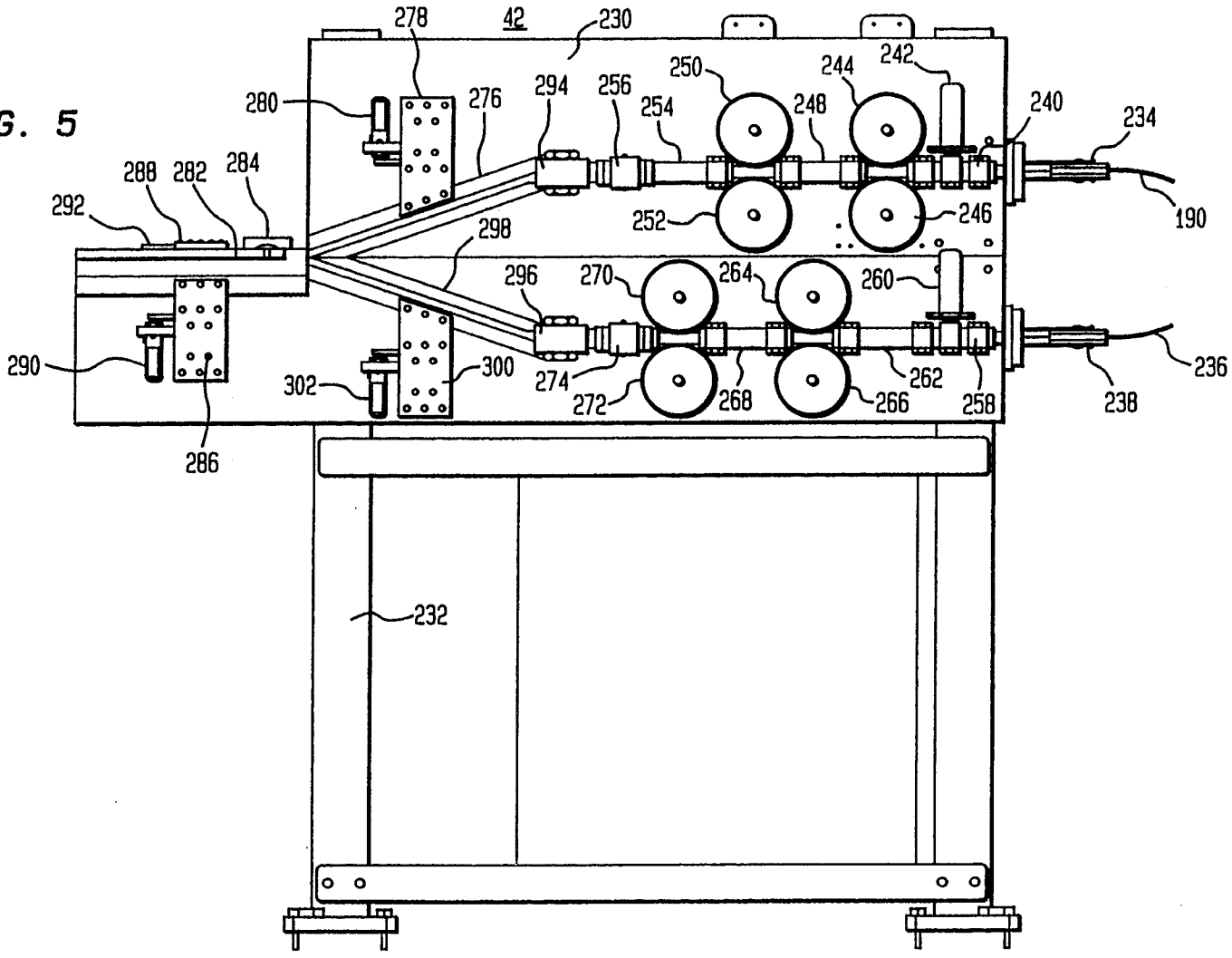
FIG. 5 illustrates a cable pull mechanism.

FIG. 5 illustrates cable pull mechanism 42. The components comprising cable pull mechanism 42 are mounted on metal plates 230 which are supported by frame 232. Cable 190 from cable unreeling mechanism 38 enters cable pull mechanism 42 via pulley 234 and cable 236 from cable unreeling mechanism 40 enters cable pull mechanism 42 via pulley 238. After passing over pulley 234, cable 190 passes through cable channel 240, which includes air cylinder and plunger 242, and then between knurled wheels 244 and 246. After passing between knurled wheels 244 and 246, cable 190 passes through cable channel 248 and then between knurled wheels 250 and 252. Cable 190 then enters cable channel 254 which leads to cutter 256. In a similar fashion, cable 236 passes through cable channel 258, which includes air cylinder and plunger 260, and then cable channel 262 between knurled wheels 264 and 266. After passing between the knurled wheels, cable 236 passes through cable channel 268 and then between knurled wheels 270 and 272. After passing between knurled wheels 270 and 272, cable 236 is fed to cutter 274.

The pairs of knurled wheels are used to pull the cable from their respective spools. In order to minimize deformation on the cable, the knurled wheels move between two positions. The first position places the pair of knurled wheels in close proximity to each other so that they tightly grip a cable passing between them. In the second position, the spacing between the pair of knurled wheels is increased so that they do not press on the cable. When the cable is not being pulled by the knurled wheels the spacing between the knurled wheels in increased and the cable is held in place by activating the air cylinder that presses a plunger with a relatively smooth surface against the cable. This type of operation minimizes the amount of time that the knurled surface of the wheels is pressed against the cable and thereby minimizes the possibility of damaging the cable sheathing or the conductors within the cable.

When cable 190 is pulled from spool 30, knurled wheels 250 and 252, 244 and 246 press on cable 190. The knurled wheels then push the end of the cable past cutter 256 and into U-shaped channel 276. When cable 190 is being fed through U-shaped channel 276, gate 278 is closed by air cylinder 280. Closing gate 278 prevents cable 190 from falling out of channel 276. From channel 276 cable 190 enters common channel 282. Common channel 282 includes ink-jet printer 284 which prints the cable assembly part number on the cable as it passes by. Common channel 282 is an L-shaped channel which is open on two sides. When cable 190 is being fed through common channel 282, vertical gates 286 and horizontal gate 288 are closed by air cylinders 290 and 292 respectively. Gates 286 and 288 closes the open sides of common channel 282 so that cable 190 does not fall out of the channel.

When cable transport mechanism 54 moves the end of cable 190 from desheath and comb station 50 to identify and connectorization station 60, gates 286, 288 and 278 open to allow the cable to be pulled out of channels 276 and 282. Eventually, the connectorized end of cable 190 is moved to cable reeling mechanism 70. At this point, the knurled wheels feed the desired length of cable 190 to cable reeling mechanism 70. Roller 294 is used to provide a non-abrasive surface that guides cable 190 toward cable reeling mechanism 70. When the appropriate length of cable has been fed to cable reeling mechanism 70, the knurled wheels stop and air cylinder and plunger 242 hold cable 190. After the cable is held by air cylinder and plunger 242, knurled wheel pairs 250 and 252, and 244 and 246 back away from the cable. Cutter 256 cuts the cable to permit cable reeling mechanism 70 and cable locating mechanism 74 to prepare the cable for transfer to desheath and comb station 86.

After the end of cable 190 is moved from desheath and comb station 50 to identify and connectorize station 60, channel 282 no longer contains cable 190 and is available to accept cable 236. Cable 236 is fed by knurled wheels 270, 272, 264 and 266 past cutter 274 and roller 296 into channel 298. Channel 298 is U-shaped and gate 300 closes by action of air cylinder 302 to prevent cable 296 from falling out of channel 298. After passing through channel 298, the end of cable 236 passes into common channel 282 where printer 284 puts the part number of the cable assembly on the cable. As described earlier, gates 286 and 288 close to prevent cable 236 from falling out of channel 282. The process then continues as was described with regard to cable 190 until cable 236 is cut by cutter 274. At that point, cable 190 begins the process all over again.

Figure 6:
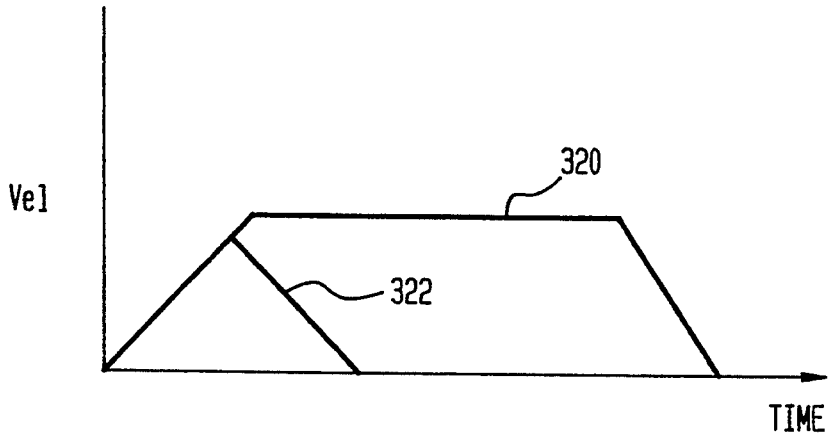
FIG. 6 illustrates a cable pull velocity profile.
Figure 7A:
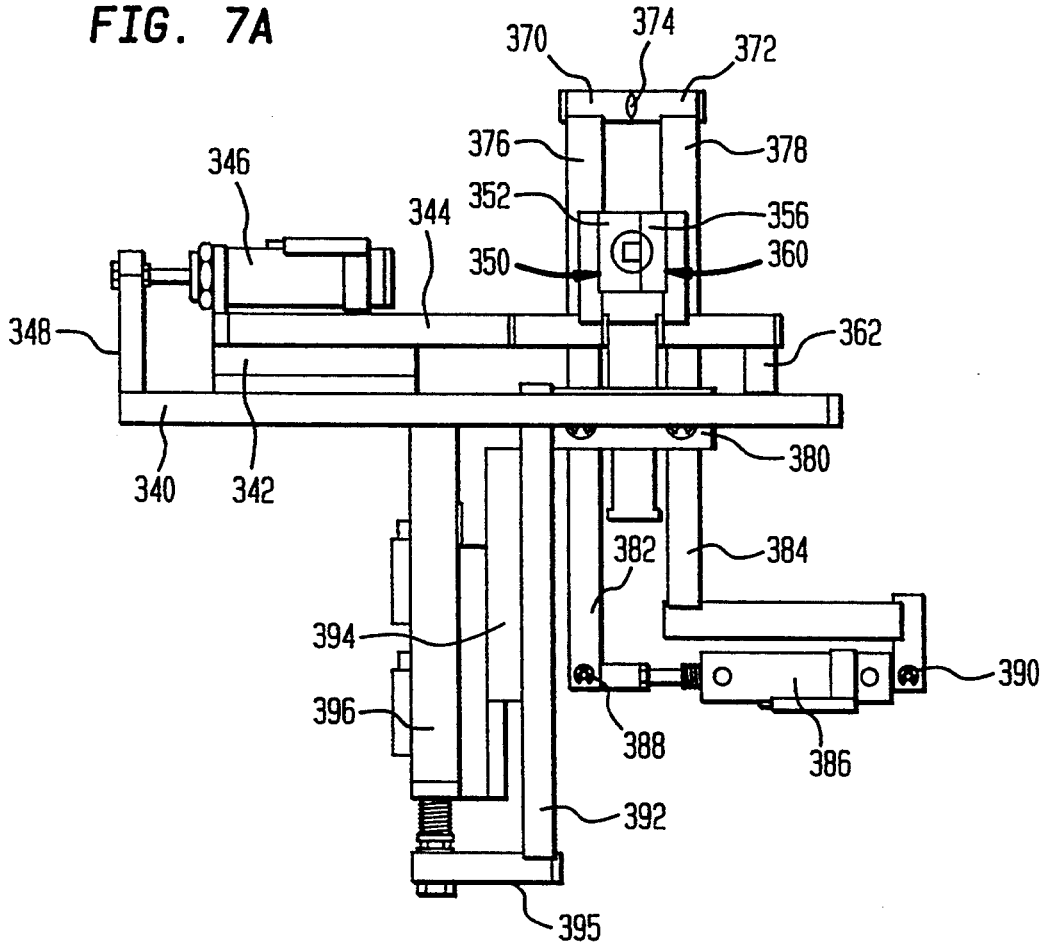
FIGS. 7*a*–7*e* illustrate a cable guide and clamp mechanism.
Figure 7B:
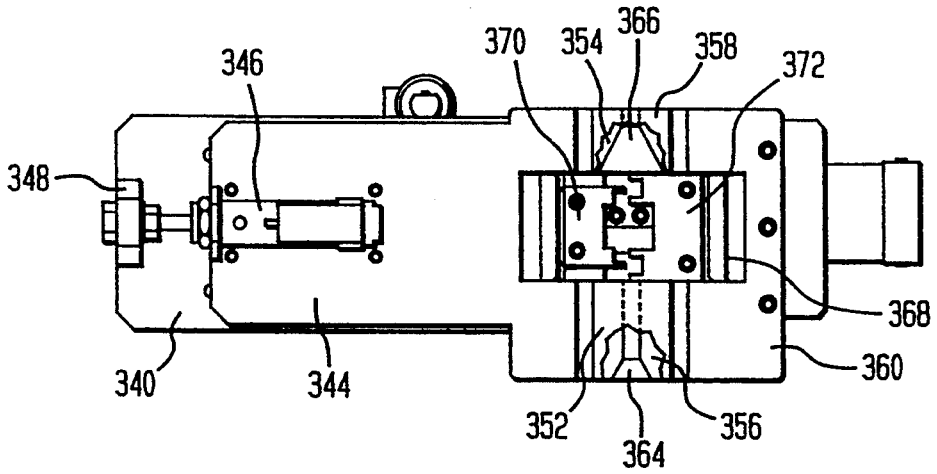
Figure 7C:
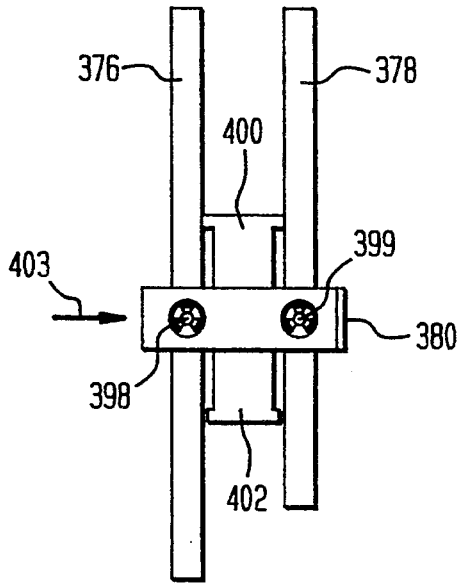
Figure 7D:
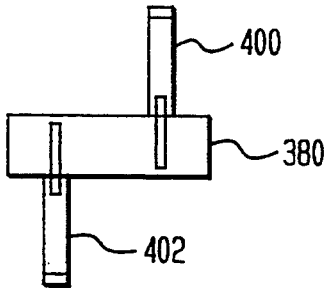
Figure 7E:
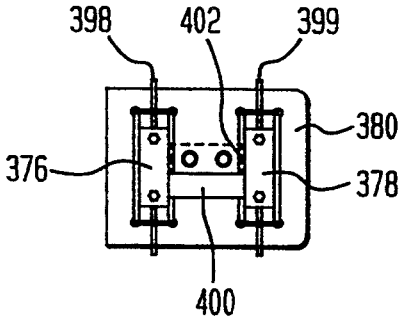

The knurled wheels pull cable from their associated spools through a cable unreeling mechanism. A desired length of cable is pulled using a pre-determined velocity profile. The wheels begin pulling at a low velocity which is gradually increased to a maximum and then gradually decreased to zero as the desired length of cable is pulled from the spool. If the desired length of cable is short, the wheels will not reach the maximum velocity and will begin decreasing velocity so that the cable can be stopped using the predetermined rate of change in velocity. FIG. 6 illustrates a velocity profile. Curve 320 illustrates a velocity profile that is followed for a long length of cable and curve 322 illustrates a velocity profile that is followed for a shorter length of cable. It should be noted that the upward slopes or acceleration of curves 320 and 322 are the same, and that the downward slopes or de-acceleration portion of curves 320 and 322 are the same. By following a predetermined velocity profile with gradual accelerations and de-accelerations, the cable is smoothly pulled from the spools without violent jerking motions. In addition, cable unfeeling mechanisms maintain a drag to prevent the momentum of the cable unreeling ,arm from unreeling unwanted cable as the knurled wheels slow down. When the knurled wheels stop, the drag on the cable unfeeling mechanisms is increased to act as a brake to stop the motion of the cable unfeeling mechanism's arm. Through the use of the predetermined velocity profiles and braking mechanism, cable is pulled from the spools in a smooth manner.

Cable pull mechanism 42 passes cable 190 to desheathing and combing station 50 via cable guide and clamp mechanism 44. Cable clamp and guide mechanism 44 guides the end of cable 190 into desheathing and combing station 50, and it grasps the cable near the point where it enters station 50. The combing section of station 50 is positioned above the desheathing section, and cable guide and clamp mechanism 44 moves the end of cable 190 between the desheathing section and combing section of station 50. After the desheathing and combing is complete, cable transport mechanism 54 receives the desheathed and combed end of cable 190 from cable guide and clamp mechanism 44.

FIGS. *7a* through *7e* illustrate cable guide and clamp mechanism 44. FIG. *7a* is a front view of cable guide and clamp mechanism 44. Horizontal frame 340 supports slide 342. Horizontal sliding frame 344 is mounted to the upper portion of slide 342. Sliding frame 344 is moved using air cylinder 346 which presses against stationary vertical frame 348. Left-half cable guide 350 is also mounted to sliding frame 344. FIG. *7b* is a top view of cable guide and clamp mechanism and illustrates that left half cable guide 350 comprises a front section 352 and a rear section 354. Sections 352 and 354 mate with sections 356 and 358, respectfully, of right cable guide 360. Right cable guide 360 is mounted to frame 340 via support 362. Left cable guide 350 and right cable guide 360 interact to form cable guides 364 and 366. Each of the cable guides receive the end of cable 190 through a tapered section that leads to a thinner tubular section. The tapered section of cable guides 364 and 366 facilitate capturing the end of cable 190 as it is fed into cable guide and clamp mechanism 44 by cable pull mechanism 42. Air cylinder 346 operates to open and close the cable guide formed by left cable guide 350 and right cable guide 360. When the piston of air cylinder 346 is retracted, left cable guide 350 moves to the left and separates from right cable guide 360. This allows cable 190 to be lifted out of cable channel 364 and 366. When the piston of air cylinder 346 is extended, left cable guide 350 is placed in contact with right cable guide 360 to form cable channels 364 and 366.

Positioned in space 368, between the front and rear sections of left cable guide 350 and right cable guide 360 is left cable clamp 370 and right cable clamp 372. Left cable clamp 370 and right cable clamp 372 are mounted in a vertically slidable configuration that enables cable clamps 370 and 372 to move between a lower position and an upper position. In the lower position, space 374 is co-linear with cable guides 364 and 366, and in the upper position, the end of cable 190 is positioned in the combing section of station 50. Left cable clamp 370 and right cable clamp 372 are mounted to vertical members 376 and 378, respectively. Vertical members 376 and 378 are pivotally mounted to block 380. End sections 382 and 384, of vertical members 376 and 378, are mounted to air cylinder 386 using pins 388 and 390. By extending and retracting the piston of air cylinder 386, left clamp 370 and right clamp 372 open and close to either release or grasp cable 190. Left and right vertical members 376 and 378, and air cylinder 386 are mounted to vertical frame 392 via block 380. Frame 392 is mounted to slide 394. The stationary section of slide 394 is mounted to air cylinder 396 which is mounted to frame 340. Horizontal section 395 of frame 392 is mounted to the piston of air cylinder 396. When piston 396 is extended, block 380, vertical members 376 and 378, and air cylinder 386 are moved downward so that space 374 is co-linear with cable guides 364 and 366. When the piston of air cylinder 396 is retracted, block 380, vertical members 376 and 378, and cable clamp sections 370 and 372 are moved to their upper position.

FIG. *7c* illustrates left and right vertical members 376 and 378 mounted to block 380. Left and right members 376 and 378 are mounted to block 380 via pins 398 and 399, respectively. The motion of vertical members 376 and 378 is limited by upper stop 400 and lower stop 402. When the piston of air cylinder 386 is extended, the upper portions of vertical members 376 and 378 approach each other so that clamp sections 370 and 372 grasp cable 190. This approach is limited by the horizontal tabs at the upper portion of upper stop 400. When the piston of air cylinder 386 is retracted, the lower portion of vertical members 376 and 378 approach each other. This approach is limited by the horizontal tabs at the lower section of lower stop 402.

FIG. *7d* illustrates block 380, upper stop 400 and lower stop 402 with vertical members 376 and 378 removed and seen from the direction of arrow 403 of FIG. *7c*. FIG. *7e* illustrates a top view of FIG. *7c*.

When cable 190 is fed from cable pull mechanism 42, space 374 is co-linear with cable guides 364 and 366, and left and right cable clamps 370 and 372 are in their open position. In order to guide the end of cable 190, left and right cable guides 350 and 360 are in a closed position. The end of cable 190 is fed through cable channel 364 past left and right cable clamps 370 and 372 through cable guide 366 into the desheathing section of station 50. When the end of a cable is sensed by an optical sensor within station 50, cable pull mechanism 42 stops feeding cable and left and right cable clamps 370 and 372 move together to grasp cable 190. After the cable is desheathed, left cable guide 350 moves away from right cable guide 360 to allow cable clamps 370 and 372 to lift the desheathed end of cable 190 upward to the combing section of station 50. After combing is complete, cable transport mechanism 54 grasps the desheathed and combed end of cable 190 and then cable clamps 370 and 372 move to an open position to allow cable transport mechanism 54 to move the end of cable 190 to station 60.

Figure 8:
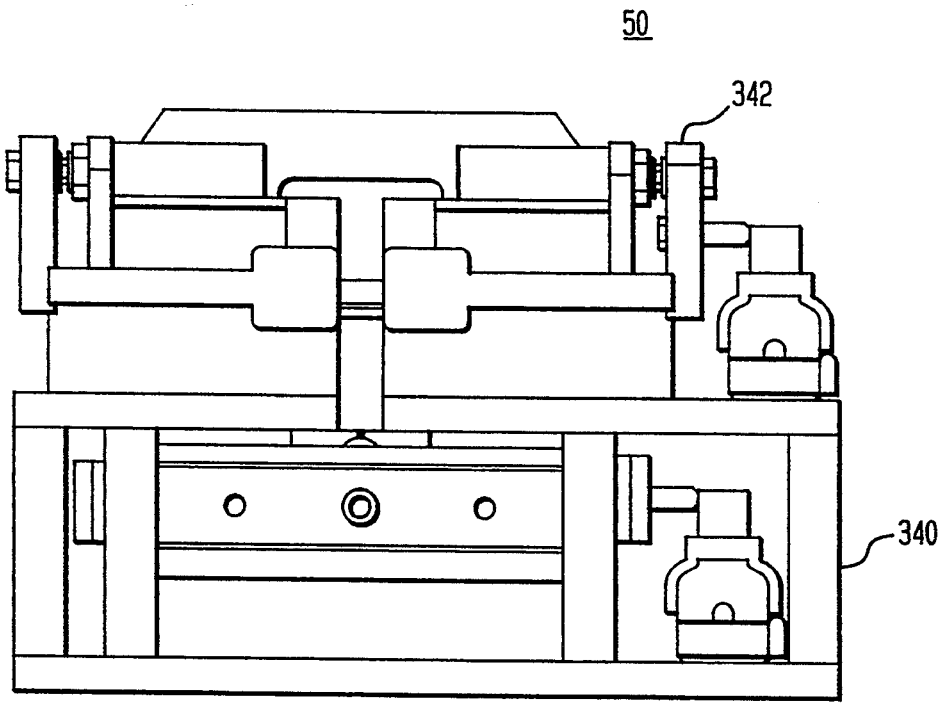
FIG. 8 illustrates a desheathing substation and a combing substation.

As discussed earlier, cable pull mechanism 42 feeds cable 190 to desheathing and combing station 50 via cable guide and clamp mechanism 44. FIG. 8 illustrates desheathing substation 340 and combing substation 342. The substations are arranged so that after the end of cable 190 is desheathed in substation 340, the end of cable 190 can be moved to combing substation 342 by the upward motion of clamp sections 370 and 372 of cable guide and clamp mechanism 44.

Figure 9C:
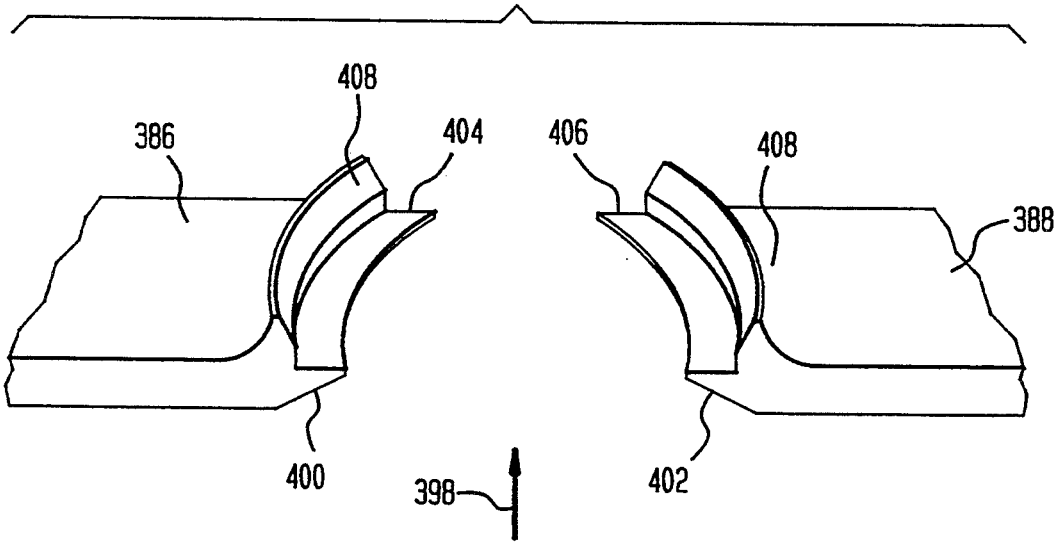
FIG. 9*c* illustrates the gripping blades of the desheathing substation.
Figure 9A:
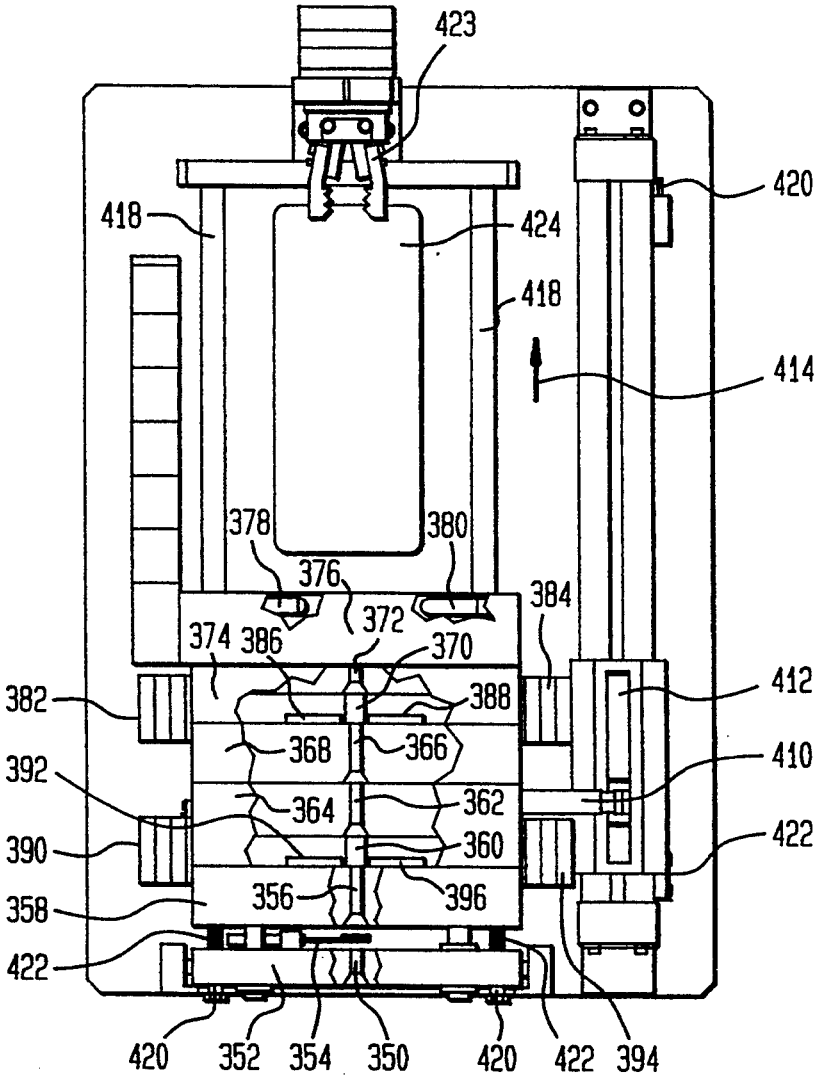
FIGS. 9*a*, 9*b*, 9*d* illustrate a top view, a front view, and a side view, respectively, of the desheathing substation.
Figure 9B:
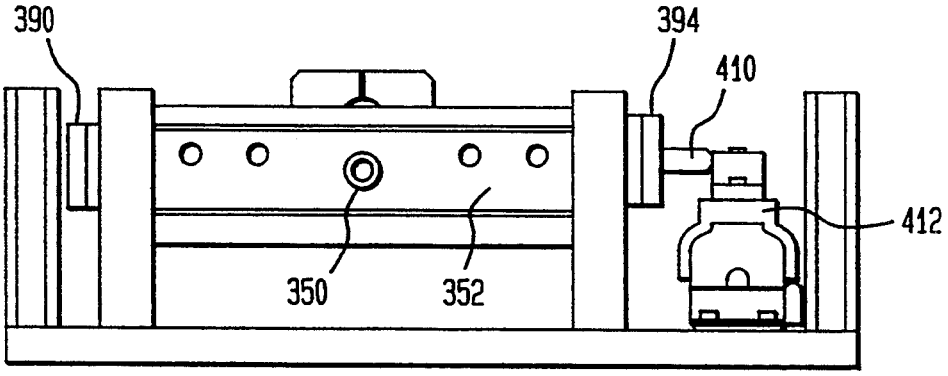

FIGS. 9*a* and 9*b* illustrate a top view and a front view, respectively, of desheathing substation 340. Cable 190 is fed to desheathing substation 340 by cable pull mechanism 42. Cable 190 enters desheathing substation 340 via tapered cable channel 350 in block 352. The end of cable 190 is fed through coiled heater element 354 and into tapered channel 356 of block 358. Element 354 is a two turn 46 watt coiled element, and has an inner diameter of approximately 0.5 inches. Element 354 is available from WATLOW, which is located in St. Louis, Mo. The cable end then passes through gap 360 and into tapered cable channel 362 of block 364. The end of cable 190 then enters tapered cable channel 366 in block 368 and then passes through gap 370. From gap 370 the cable end enters tapered channel 372 in block 374. From channel 372 the cable end passes under plate 376 where optical sensors 378 and 380 are mounted. When the end of cable 190 interrupts the interaction between sensors 378 and 380, cable pull mechanism 42 stops feeding cable into desheathing sub-assembly 340 and cable guide and clamp mechanism 44 grasps the cable.

When the cable stops, air cylinders 382 and 384 each extend a piston rod which is attached to a gripping blade. Pancake air cylinder 382, which is mounted to blocks 368 and 374, drives gripping blade 386 into the sheathing of cable 190 and pancake air cylinder 384, which is mounted to blocks 368 and 374, drives gripping blade 388 into the sheathing of cable 190. Likewise, pancake air cylinder 390, which is mounted to blocks 358 and 364, drives gripping blade 392 into the sheathing of cable 190 and pancake air cylinder 394, which is mounted to block 358 and block 364, drives gripping blade 396 into the sheathing of cable 190.

FIG. 9*c* illustrates gripping blades 386 and 388. It should be noted that gripping blades 392 and 396 are identical to gripping blades 386 and 388, respectively. As the end of cable 190 is fed through the tapered cable guide channels, it travels in the direction of arrow 398 and passes between blades 386 and 388. Blades 386 and 388 have tapered sections 400 and 402 respectively, which guides cable 190 between the blades. Blades 386 and 388 have semicircular cutting portion 404 and 406, respectively. These cutting portions nearly encompass the diameter of the sheathing of cable 190 when the blades are driven into the sheathing by their respective air cylinders, and thereby securely grip the sheathing. Positioned behind the cutting edge of each blade is stopper 408. Stopper 408 acts to limit the depth of the cut into the sheathing. For a cable with a sheathing of approximately 0.020 inches, it is desirable that stops 408 be positioned approximately 0.015 inches behind the cutting portion of the blade. This permits the blades to grip the sheathing without cutting through it and thereby damaging the conductors within the cable.

After the blades have gripped the sheathing, and after coiled heating element 354 has softened the sheathing positioned within the heating element for approximately 3.5 sec., blocks 358, 364, 368 and 374, and blades 386, 388, 392 and 396 move back as one unit and thereby pull the sheathing of cable 190. While the sheathing is being pulled, the cable is held in a fixed position by the gripping action of cable guide and clamp mechanism 44. As a result, the sheathing of cable 190 is broken in the area where it is heated by coiled heating element 354, and the sheathing is pulled backward until the conductors at the end of the cable are desheathed. It is preferable to desheath the end of cable 190 beginning at a point approximately 7.25 inches from the end of the cable.

Blocks 358, 364, 368 and 374 are secured together and are attached to connecting rod 410. Rod 410 is mounted to rodless air cylinder 412. The blocks are moved in the direction of arrow 414 by rodless air cylinder 412. The blocks ride on roller bearings that slide along rods 416 and 418. The position of rodless air cylinder 412 and thereby the position of the blocks is determined using switch sensors 420 and 422.

Bolts 420 pass through block 352 and are secured to block 358. Springs 422 maintain a spacing between blocks 352 and 358. The heads of bolts 420 are spaced approximately 0.25 inches away from the front surface of block 352. After blocks 358, 364, 368 and 374 have travelled approximately 0.25 inches in the direction of arrow 414, the gap between the heads of bolts 420 and the front surface of block 352 is closed, and block 352 is pulled backward in the direction of arrow 414 along with the blocks 358, 364, 368 and 374. It should be noted that heating element 354 also moves with block 352. By allowing this one-quarter inch of travel before moving block 352 and heater element 354, the portion of the sheathing grasped by the gripping blades is moved away from the heating elements to prevent possible melting or charring of the sheathing. After the one-quarter inch travel has been used, heating element 354 and block 352 move so that the portion of sheathing remaining on the cable, and the conductors composing the cable are not damaged by prolonged exposure to heating element 354.

When blocks 352, 358, 364, 368 and 374 reach the end of their travel, as sensed by sensor 420, pneumatic gripping blades 423 grip the portion of the sheathing that extends out of channel 372 and beneath plate 376. Once the blocks and heating element have slid to the rear position, the desheathed end of cable 190 is free of the cable channels 350, 362, 366 and 372, and can be moved upward to combing substation 342. After the blocks and heating element have moved to the rear position, cable guide and clamp mechanism 44 moves clamps 370 and 372 vertically to raise the desheathed end of cable 190 into combing substation 342. After cable 190 has been moved to the combing substation, blocks 352, 358, 364, 368 and 374 move back to their forward position along with heater element 354. This forward position is sensed by sensor 422. Once the blocks and heater element have moved forward, that is in the direction opposite to arrow 414, pneumatic grippers 423 are opened to release the cable sheathing so that it can drop through opening 424 into a waste receptacle. At this point, desheathing substation 340 is ready to desheath another cable.

FIG. 9*b* illustrates a front view of cable desheathing substation 340. It illustrates tapered cable channel 350 and block 352, connecting rod 410 and rodless air cylinder 412. Rodless air cylinder 412 is available from TOL-O-MATIC, Inc. in Minneapolis, Minn. FIG. 9*b* also illustrates a portion of pancake cylinders 390 and 394. The pancake air cylinders are available from Bimba Manufacturing Company, Monee, Ill.

Figure 9D:
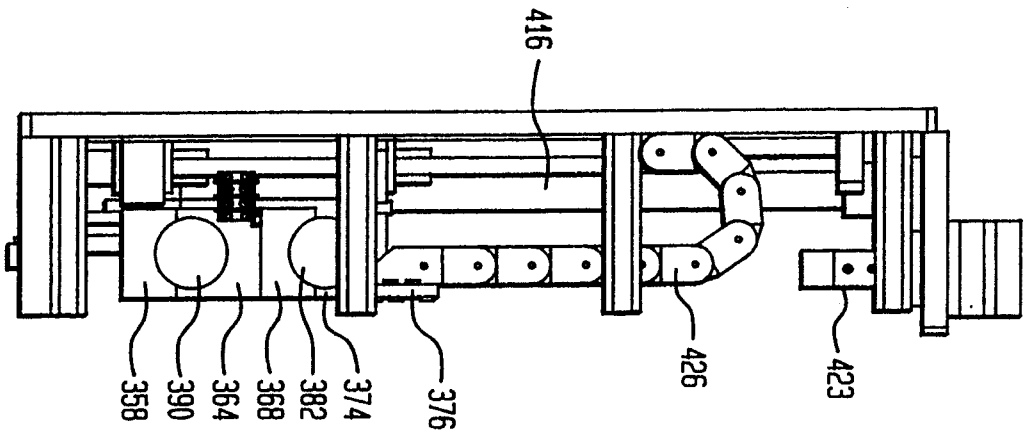

FIG. 9*d* illustrates a side view of desheathing substation 340. The figure shows flexible cable and pneumatic line guide 426 which is used to protect cables and pneumatic lines as the blocks slide between forward and rear positions. It also illustrates pancake air cylinders 382 and 390, and blocks 358, 364, 368, 374 with plate 376 attached to block 374. Pneumatic gripping blades 423 are also visible.

Figure 10A:
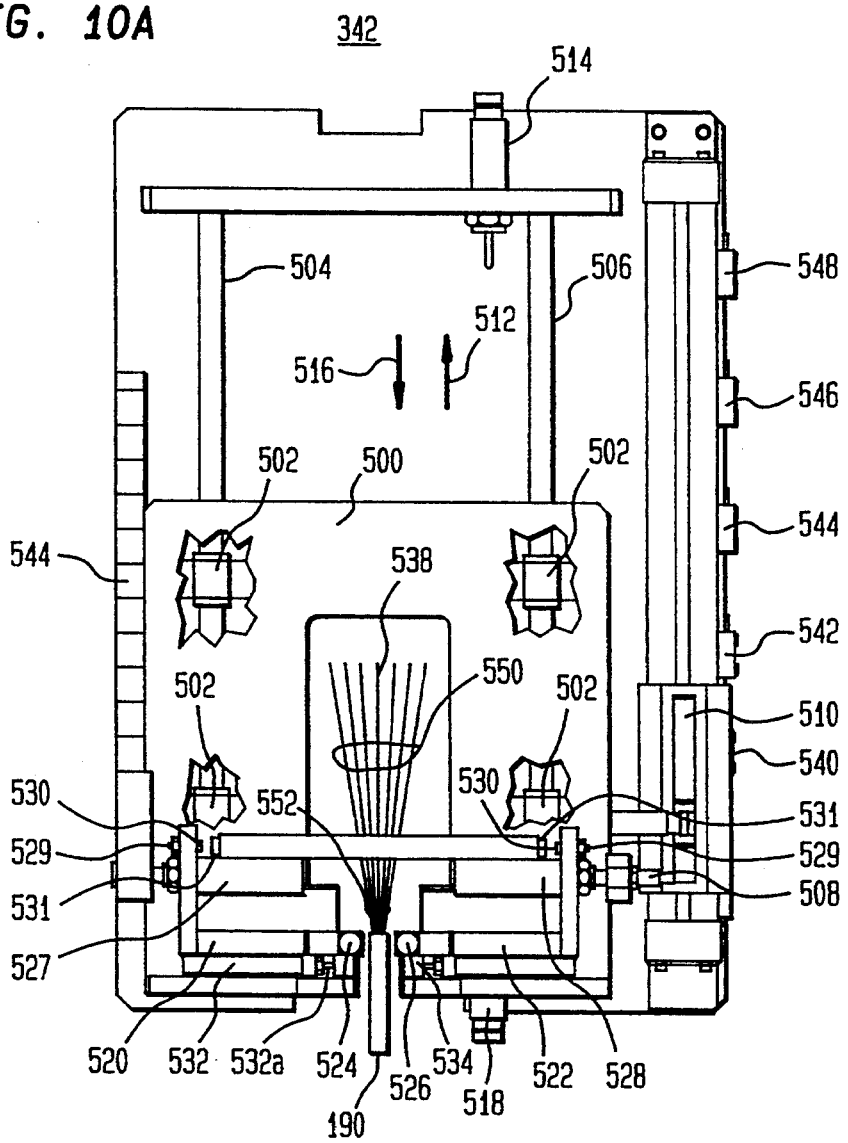
FIGS. 10*a*–10*c* illustrate the top, front and side views, respectively, of the combing station.

As mentioned earlier, desheathed cable 190 is moved upward to combing substation 342 by cable guide and clamp mechanism 44. Combing substation 342 is illustrated in FIGS. 10*a, b* and *c*. Combing substation 342 is used to remove the twists from the twisted pairs of wires now exposed after the desheathing. This is accomplished by two vertical rods pressing against the desheathed conductors while moving along the length of the exposed conductors. This is carried out in several strokes of differing length which remove the twists from the twisted pairs of conductors. Removing the twists facilitates separating and identifying the individual conductors, at identify and connectorization station 60.

Figure 10B:
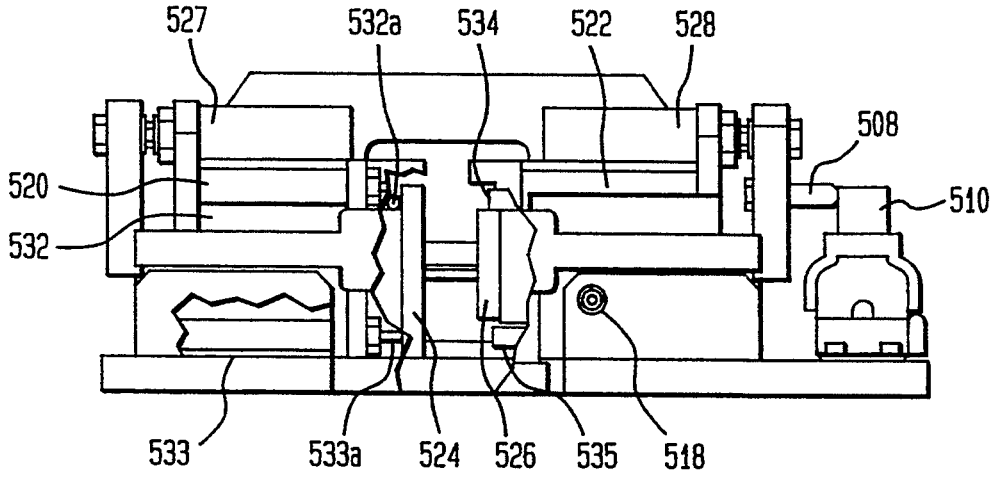
Figure 10C:
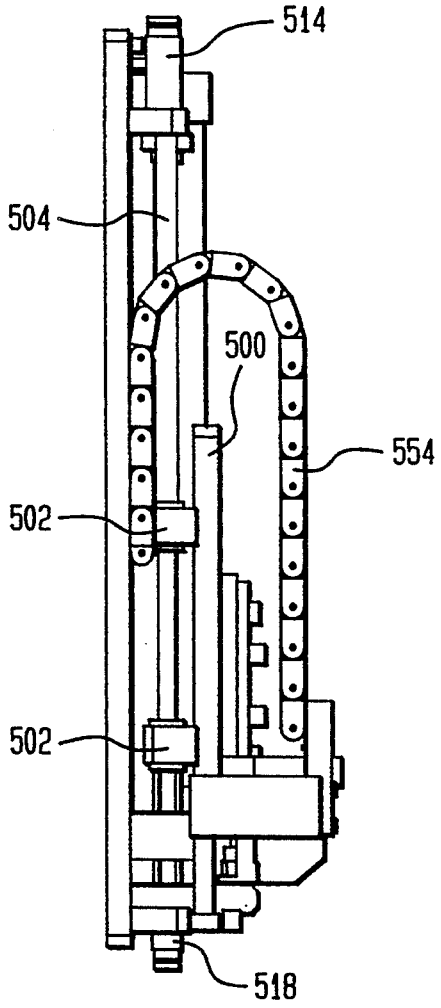

FIG. 10*a* is a top view of combing station substation 342, and FIGS. 10*b* and 10*c* are front and side views, respectively. U-shaped frame 500 is mounted to roller bearings 502. Roller bearings 502 enable frame 500 to move along rods 504 and 506 with little friction. Frame 500 is attached to connecting rod 508 which is attached to rodless air cylinder 510. As mentioned earlier, rodless air cylinders are available from TOL-O-MATIC, Inc., of Minneapolis, Minn. By activating air cylinder 510, frame 500 can be moved in the direction of arrow 512, which points toward the back of substation 342. Shock absorber 514 absorbs any impact that frame 500 may have at the end of its travel in the direction of arrow 512. In a similar fashion, rodless air cylinder 510 can move frame 500 forward in the direction of arrow 516, and shock absorber 518 is used to absorb the impact of frame 500 as it reaches the end of its forward travel. Positioned on sliding members 520 and 522, are vertical rods 524 and 526 respectively. These rods press against the twisted conductors to remove the twists. Sliding members 520 and 522 are moved either inward or outward by the action of air cylinders 527 and 528, respectively. The maximum amount of travel in the inward direction is limited by set screws 529. Set screws 529 are turned so that end portions 530 extend outward toward stop 531. When air cylinders 527 and 528 are extended, their motion is limited by the impact of ends 530 against stop 531. When the average wire diameter of the conductors within cable 190 is approximately 0.030 inches, it is desirable to adjust the set screws so that cylindrical rods 524 and 526 are separated by about 0.035 inches when air cylinders 527 and 528 are extended.

In reference to FIGS. 10*a* and 10*b*, once desheathed cable 190 is positioned at combing substation 342, air cylinders 532 and 533 extend pistons 532*a* and 533*a*, respectively. Air cylinders 532 and 533 are mounted on frame 500. The ends of pistons 532*a* and 533*a* are received by counter bores 534 and 535 of frame 500, respectively. Extending pistons 532*a* and 533*a* control the vertical position of the conductors of cable 190 so that the conductors stay between vertical rods 524 and 526.

When air cylinders 527 and 528 are extended, cylindrical rods 524 and 526 press against conductors 538. Once pressed against the conductors, U-shaped frame 500 is moved in the direction of arrow 512 to press out the twists in conductors 538. It should be noted that even though vertical rods 524 and 526 are adjusted to come within 0.035 inches of each other, their travel may be limited by twisted conductors that will separate the rods by more than 0.035 inches. Therefore, when conductors 538 are still in their twisted configuration, the distance between vertical rods 524 and 526 is limited by the diameter of the bundle of conductors 538.

Next to, and along the direction of travel of rodless air cylinder 510 are sensors 540, 542, 544, 546 and 548. These sensors are used to detect the approximate position of rodless cylinder 510, and therefore, the position of frame 500 and vertical rods 524 and 526. When attempting to press out the twists in the twisted pairs of conductors 538, it is desirable to begin the pressing or combing action from a point near end 550 of conductor 538. This prevents the twists in the area of 550 from interfering with pressing out twists in the area of 552.

The combing operation begins by moving frame 500 in the direction of arrow 512 so that sensor 546 is triggered. At this point, frame 550 is stopped and vertical rods 524 and 526 are pressed against conductors 538 in the area 550. Frame 500 is then moved in the direction of arrow 512 until sensor 548 is triggered; sensor 548 detects when frame 500 is in a position that places vertical rods 524 and 526 within approximately 0.25 inches of the end of conductors 538. This first combing action removes twists from the conductors in the area of 550. Vertical rods 524 and 526 are then separated and frame 500 is moved to the area of sensor 544. At this point, vertical rods 524 and 526 are pressed into contact with conductors 538, and frame 500 is moved backward in the direction of arrow 512 until sensor 548 is triggered. Again, vertical rods 524 and 526 are separated and frame 500 is moved forward in the direction of arrow 516 until sensor 542 is triggered. At this point, vertical rods 524 and 526 are closed against conductors 538, and frame 500 is moved in the direction of arrow 512 until sensor 548 is triggered. The next two combing strokes are identical to each other. These combing strokes begin by moving frame 500 in the direction of arrow 516 until sensor 540 is triggered. At this point, vertical rods 524 and 526 are pressed against conductors 538 in the area of 552, and frame 500 is moved in the direction of arrow 512 until sensor 548 is triggered. When sensor 548 is triggered, vertical rods 524 and 526 are separated and the next combing stroke is started. The last combing stroke is similar to the previous two except that frame 500 moves to the rear of its travel so that vertical rods 524 and 526 pass over the ends of conductors 538.

The combing is carded out in several strokes. The first stroke combs the last two inches of the conductors, the second stroke combs the last four inches of the conductors, and the last three full strokes comb approximately seven inches of the wire which completes untwisting desheathed conductors 538. Once the combing action is complete, frame 500 moves to the rear of its travel, pistons 532*a* and 533*a* are retracted, and vertical rods 524 and 526 are moved apart to free the untwisted and unsheathed conductors of cable 190. This permits desheath and combed cable 190 to be moved to identify and connectorization station 60 by cable transport 54.

FIG. 10*b* illustrates a front view of combing substation 342. The figure illustrates air cylinders 527 and 528, connecting rod 508 and rodless air cylinder 510. It also shows sliding members 520 and 522 to which vertical rods 524 and 526 are mounted.

FIG. 10*c* is a side view of combing substation 342. It illustrates flexible wire and pneumatic line guide 554. It also illustrates rod 504, roller bearings 502, shock absorbers 514 and 518, and frame 500.

After desheath and comb station 50 has desheathed and combed the conductors comprising the end of cable 190, cable transport mechanism 54 moves the desheathed and combed end of cable 190 to identify and connectorization station 60. The pneumatic cable clamp of cable transport 54 grasps cable 190 while the cable is still being held by cable guide and clamp mechanism 44. Once the pneumatic cable clamp of cable transport mechanism 54 has grasped the cable, cable guide and clamp mechanism 44 releases cable 190. Cable transport mechanism 54 then moves along gantry 114 until the pneumatic cable clamp is aligned with the conductor capture mechanism of identify and connectorization station 60. The pneumatic cable clamp of cable transport 54 holds cable 190 while identify and connectorization station 60 captures the exposed conductors of cable 190. After the conductors are captured, the pneumatic cable clamp moves to its lower position to align cable 190 with the cable clamp of identify and connectorization station 60. After the cable clamp of identify and connectorization station 60 has grasped cable 190, the pneumatic cable clamp of cable transport mechanism 54 releases cable 190.

The cable clamp of identify and connectorization station 60 moves between an upper and lower position. Cable 190 is held in the upper position while the individual conductors of cable 190 are identified and inserted into the insulation displacement type contacts of connector (>4. After all of the conductors have been attached to their respective contacts, the cable clamp moves to a lower position which positions the end of the sheathed portion of cable 190 in a strain relief of connector 64. The strain relief is closed on the end of cable 190 and the pneumatic connector clamp of cable transport 54 moves the connectorized end of cable 190 to the connector nest of cable reeling mechanism 70.

Figure 11A:
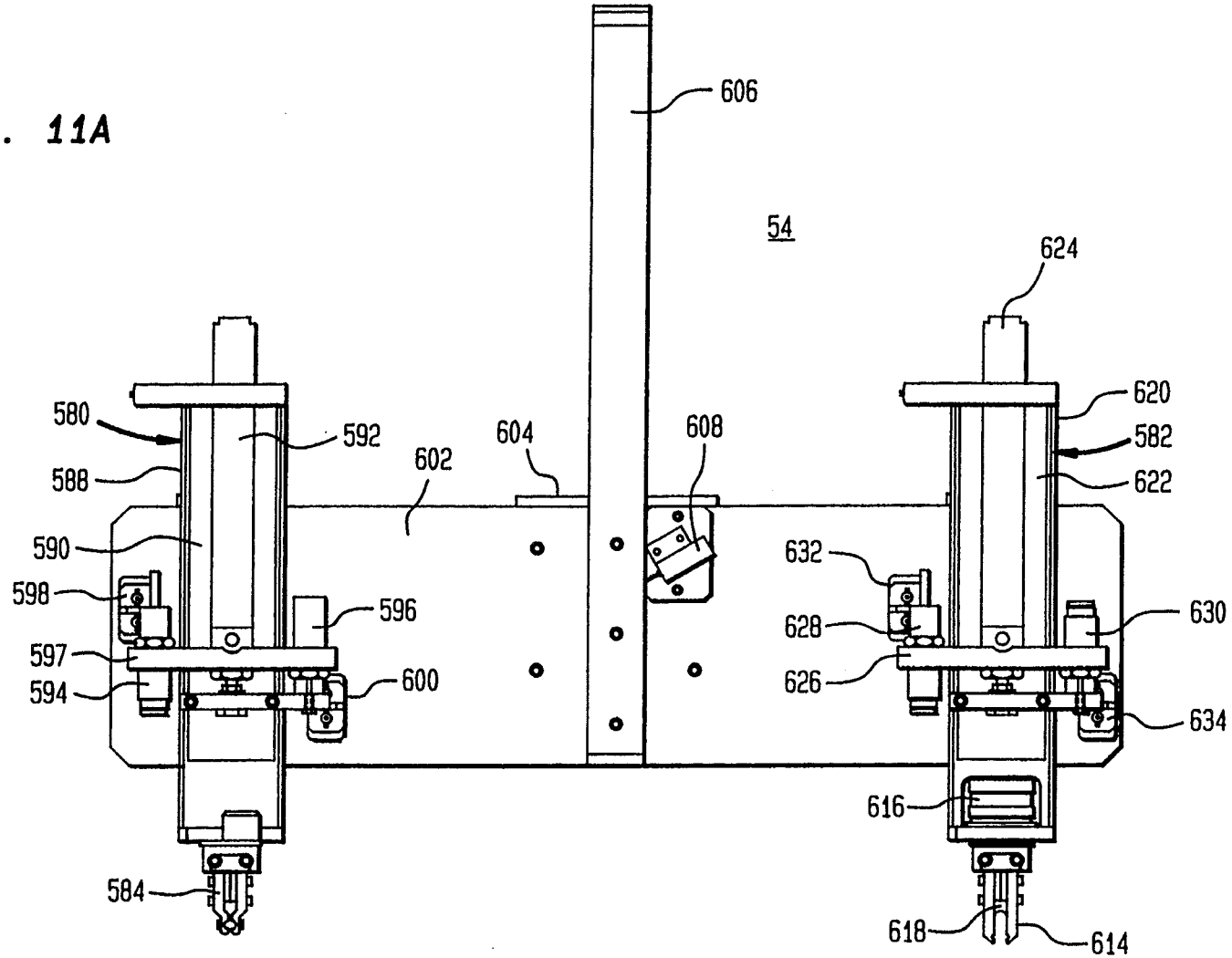
FIGS. 11*a* and 11*b* illustrate cable transport mechanism 54.
Figure 11B:
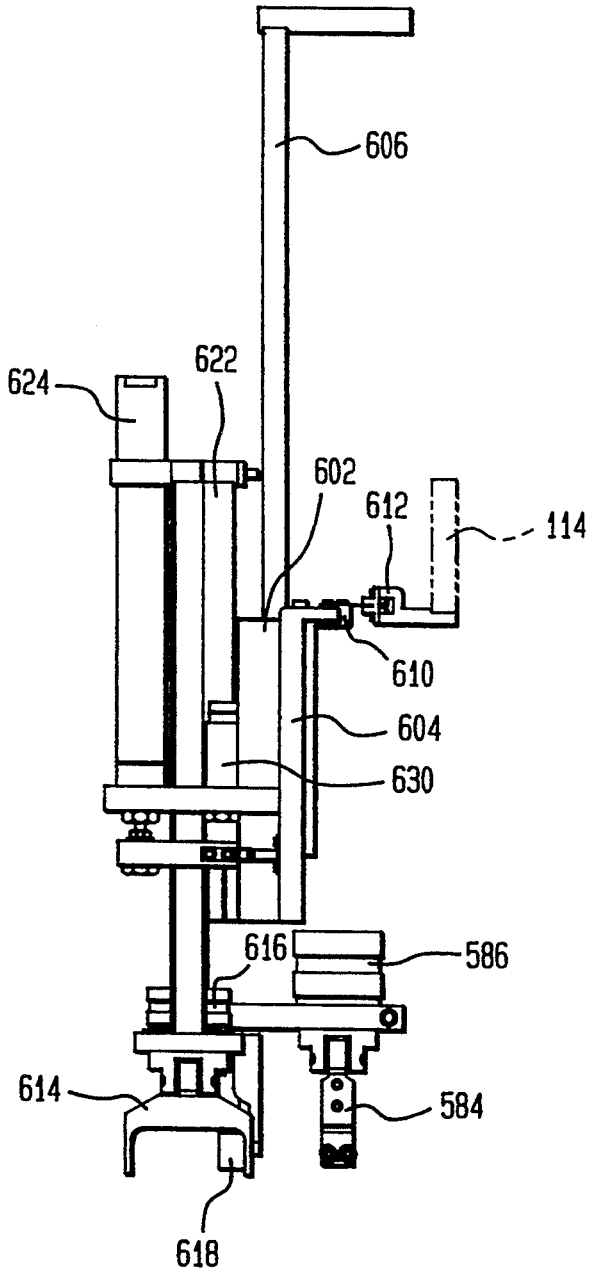

Cable transport mechanism 54 is used to transport cable 190 between the desheath and comb station 50 and identify and connectorization station 60. It is also used to move the newly connectorized end of cable 190 from identify and connectorization station 60 to cable reeling mechanism 70. FIGS. 11*a* and 11*b* illustrate a front view and side view, respectively, of cable transport mechanism 54. Cable transport mechanism 54 includes cable pickup 580 and connector pickup 582. Cable pickup 580 includes pneumatic clamp 584 which is adapted to grasp cable 190 from cable guide and clamp mechanism 44. Cable clamp mechanism 584 is operated by pancake air cylinder 586. Clamp 584 and pancake cylinder 586 are mounted on frame 588 which is mounted on slide 590. Through the action of air cylinder 592, which is mounted to stationary cross frame 597, frame 588 and clamp 584 are moved in a vertical direction. The piston of air cylinder 592 extends to lower cable clamp 584 to capture cable 190 from cable guide and clamp mechanism 44. Cable guide and clamp mechanism 44 then releases cable 190 and air cylinder 592 retracts its piston to raise clamp 584 in a vertical direction. Shock absorbers 594 and 596 are mounted to stationary cross frame 597 and are used to soften the impact of frame 588 as it reaches the end of its downward and upward vertical positions, respectively. In addition, slotted optical switches 598 and 600 are used to sense the position of frame 588 and, therefore, cable clamp 584.

The stationary portion of slide 590 and cross frame 597 are mounted to transport plate 602. Transport plate 602 is mounted to gantry attachment plate 604. Gantry attachment plate 604 is mounted to a gantry where it is moved along a lead screw so that the cable transport mechanism can be moved from desheath and comb station 50 to identify and connectorization station 60. Also attached to transport plate 602 is extension 606 which is used to drape electrical conductors and pneumatic lines to and from cable transport mechanism 54. Also included is a retro-reflective scanner 608 which is aligned so that it will reflect a beam of light using a reflector mounted on rotating coiled cable transport mechanism 80 when mechanism 80 and cable transport mechanism 54 are in close proximity to each other. This is used as a safety feature to prevent an accidental collision between the two transport mechanisms. In addition, and in reference to FIG. 11*b*, plate 604 includes flag 610 which interacts with slotted optical switch 612 of gantry 114. This is used as a sensor to detect when cable transport mechanism 54 is in a home position.

As mentioned earlier, cable clamp 584 is used to move the desheathed and combed end of cable 190 from the desheath and comb station 50 to identify and connectorization station 60. Cable transport mechanism 54 also includes connector pickup 582.

Connector pickup 582 is used to grasp the connector that has been attached to end of cable 190 and transport it from identify and connectorization station 60 to cable reeling mechanism 70.

Connector pickup 582 includes clamp 614 which is used to pickup the connectorized end of cable 190. Clamp 614 is opened and closed through the action of pancake air cylinder 616. It should be noted that clamp 614 includes tab 618 which is used to position the end of cable 190 between the strain release clamps of connector 64. This facilitates capturing the end of cable 190 between the strain relief clamps as the clamps are closed by identify and connectorization station 60. Clamp 614 and pancake air cylinder 616 are mounted to frame 620 which is mounted to slide 622. Slide 622 is mounted to plate 602 which as mentioned before is mounted to gantry 114 via plate 604. Clamp 614 is moved in a vertical direction by the action of air cylinder 624. Air cylinder 624 is mounted to frame 626 which is mounted to plate 602. When air cylinder 624 extends its piston, clamp 614 is moved downward, and when air cylinder 624 retracts its piston, clamp 614 is moved upward. The end of the upward and downward motions of clamp 614 and its frame 620 are cushioned by the action of shock absorbers 628 and 630. Slotted optical switches 632 and 634 are used to sense when clamp 614 is in a upward position or downward position, respectively.

Figure 12A:
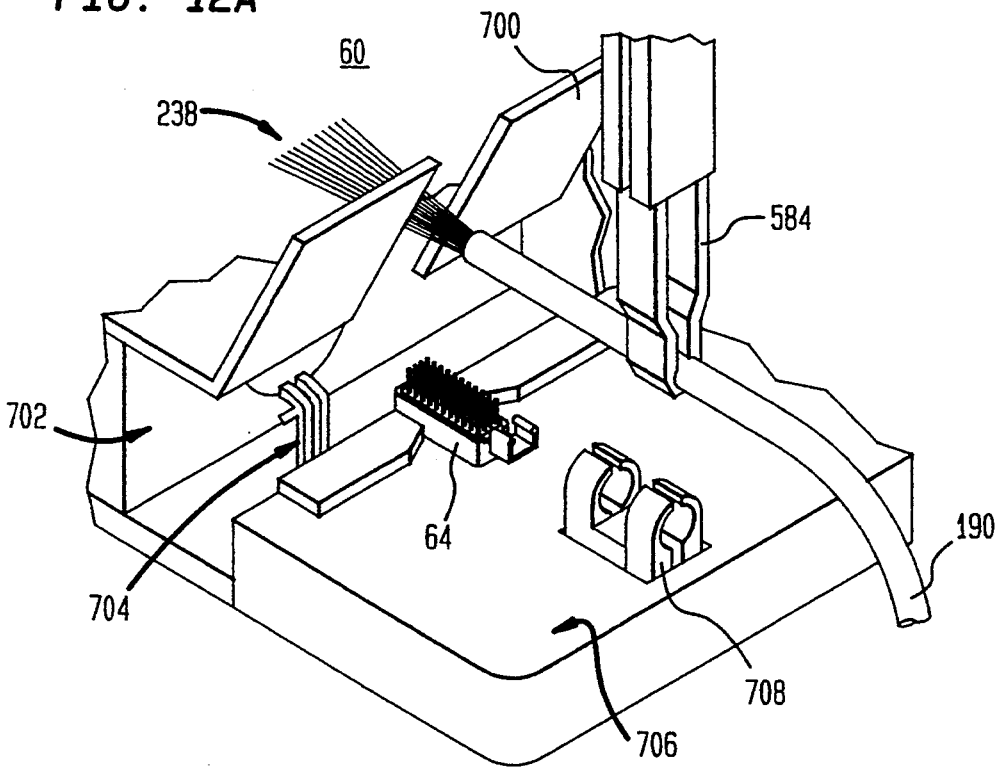
FIGS. 12*a* and 12*b* illustrate a identify and connectorization station.
Figure 12B:
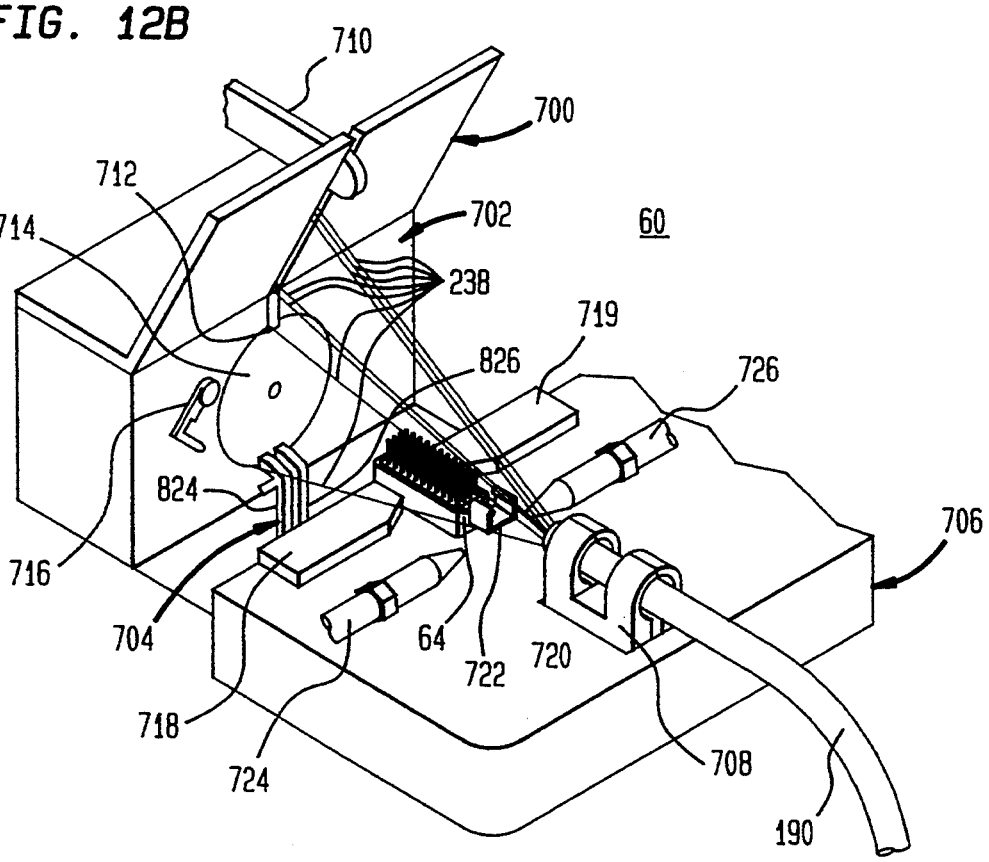

FIGS. 12*a* and 12*b* illustrate identify and connectorization station 60. FIG. 12*a* illustrates station 60's configuration prior to capturing the exposed conductors of cable 190. FIG. 12*b* illustrates the station's configuration after cable transport 54 has completed transferring cable 190 to station 60. Identify and connectorization station 60 includes conductor capture mechanism 700, conductor identification mechanism 702, conductor transfer mechanism 704, connectorization mechanism 706 and cable clamp mechanism 708. Conductor capture mechanism 700 captures and configures conductors 238 as a single column of conductors so that they may be presented to conductor identification mechanism 702 one at a time. Conductor capture mechanism 700 opens and then slides forward to capture conductors 238 while cable 190 is still grasped by pneumatic cable clamp 584 of cable transport mechanism 54. After conductor capture mechanism 700 grasps conductors 238 and slides back to the position shown in FIG. 12*b*, the pneumatic cable clamp of cable 584 moves to a lower position that aligns cable 190 with cable clamp 708. Cable clamp 708 then grasps cable 190 and pneumatic cable clamp 584 releases cable 190. Capturing the conductors while cable 190 is in a position above cable clamp 708 results in a downward tension being placed on conductors 238 when cable 190 is moved to a lower position for transfer to cable clamp 708. This downward tension on conductors 238 helps feed the conductors from cable capture mechanism 700 to conductor identification mechanism 702. Conductor feed mechanism 710 of conductor capture mechanism 700 also places a downward force on conductors 238 to assist in feeding conductors 238 to conductor identification mechanism 702.

The downward tension of conductors 238 and the downward force provided by conductor feed mechanism 710 feed conductors 238, one at a time, into slot 712. Slot 712 in wheel 714 is large enough to accommodate only one conductor at a time. Wheel 714 rotates to identification cutter 716 so that cutter 716 slices through the insulation of the conductor being identified so that electrical contact is made with the conductive material within the conductor. Cutter 716 completes a circuit that comprises the conductor being tested and a contact of a test connector that has been wired to the other end of cable 190 at spool 30. Once this identification is complete, it is possible to decide which contact of connector 64 should receive the conductor under test. After the identification is complete, wheel 714 rotates so that the identified conductor is transferred to conductor transfer mechanism 704. Conductor transfer mechanism 704 grasps the identified conductor and pulls it back and down toward conductor 64.

Once the conductor to be attached to connector 64 has been identified, conductor insertion mechanism 718 of connectorization mechanism 706 aligns itself with the proper contact of connector 64. Conductor transfer mechanism 704 moves the identified conductor along a path that is panelled and next to connector 64, until the conductor is positioned between insertion mechanism 718 and the proper contact of connector 64. The proper positioning of the conductor is detected when the identified conductor contacts a micro switch that triggers insertion mechanism 718 to drive the identified conductor into the proper insulation displacement contact of connector 64. This operation is continued until all of conductors 238 have been fed from conductor capture mechanism 700 to identification mechanism 702, and inserted into the proper insulation displacement contact of connector 64 by connectorization mechanism 706.

After all of the conductors have been attached to the contacts of connector 64, cable clamp 708 moves to a lower position to position cable end 720 between strain relief clamps 722 of connector 64. After clamp 708 moves to its lower position, pistons 724 and 726 close strain relief clamp 722 on cable end 720. Just prior to pistons 724 and 726 extending to close strain relief clamp 722, pneumatic connector clamp 614 of cable transport mechanism 54 grasps connector 64 and provides tab 618 that presses down on cable end 720 to hold cable end 720 between strain relief clamp 722 while they are pressed closed by air cylinders 724 and 726.

After strain relief clamps 722 are closed, cable clamp mechanism 708 releases cable 190 while air cylinders 724 and 726 retract their pistons to allow pneumatic connector clamp 614 of cable transport mechanism 54 to transfer the connectorized connector to the connector nest of cable reeling mechanism 70.

Figure 13A:
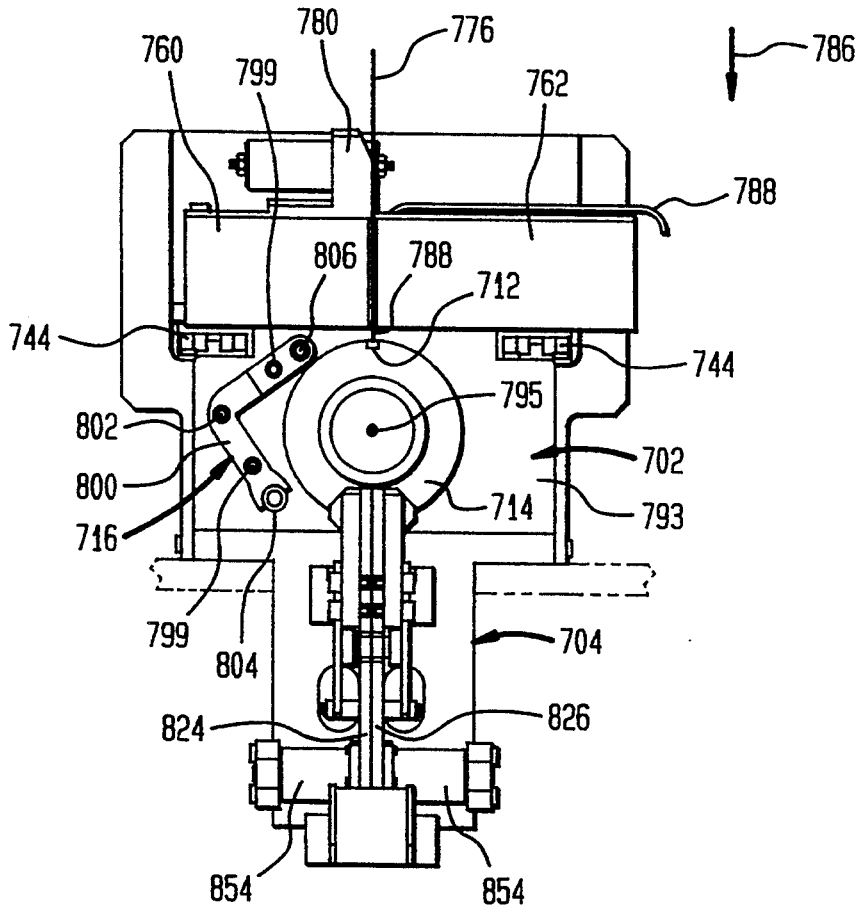
FIGS. 13*a*, *b* and *c* illustrate a front, side and top view, respectively, of a conductor capture mechanism, a conductor identification mechanism and a conductor transfer mechanism.
Figure 13B:
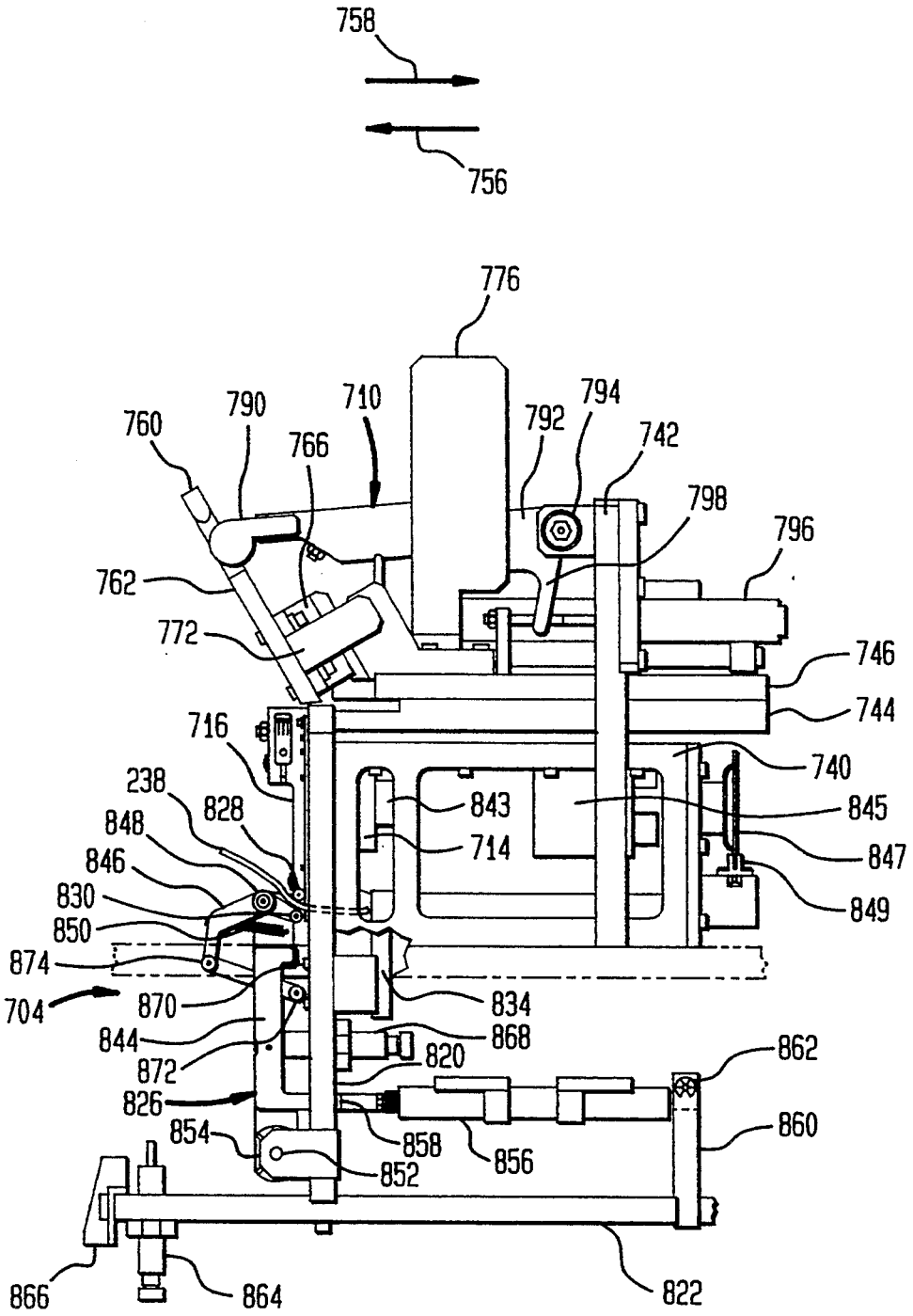
FIG. 13*d* illustrates a conductor identifier.
Figure 13C:
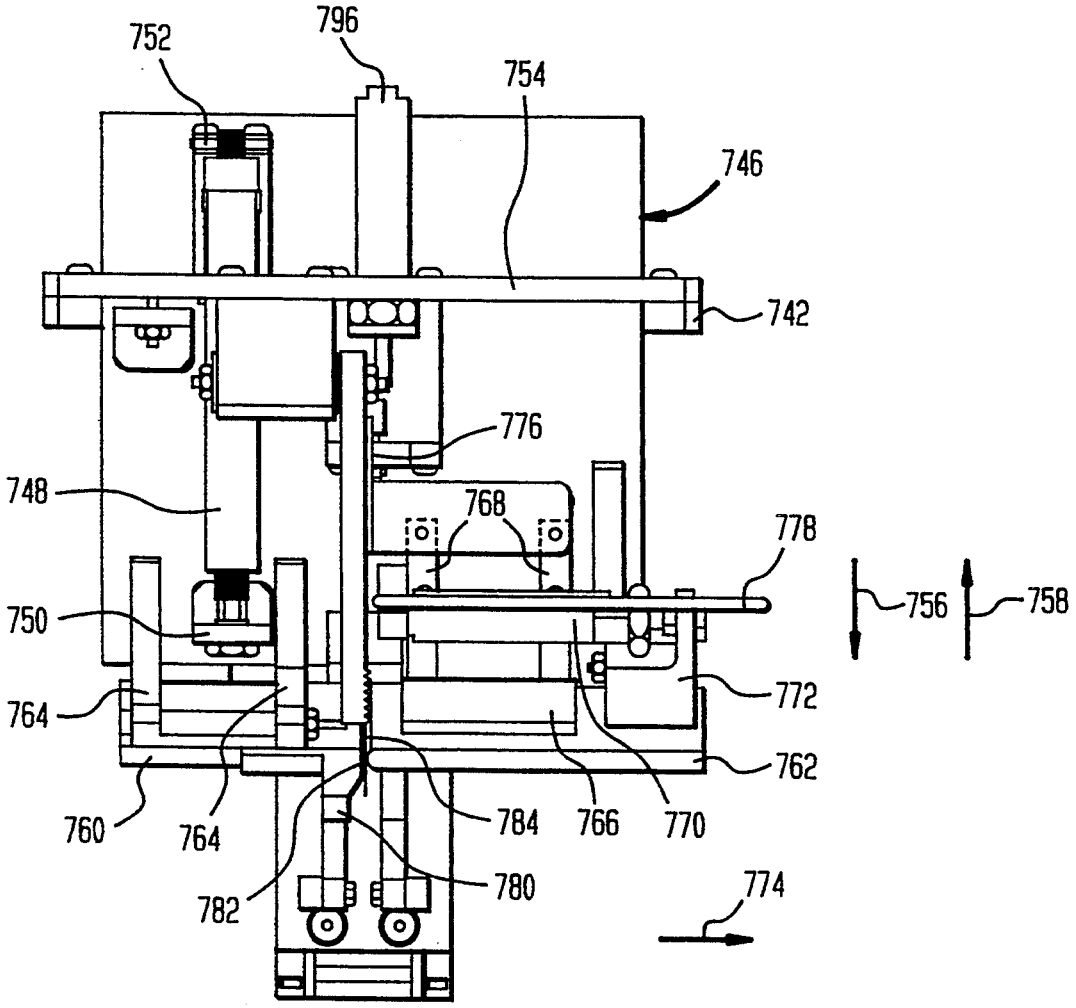

FIGS. 13*a*, 13*b* and 13*c* illustrate conductor capture mechanism 700, conductor identification mechanism 702 and conductor transfer mechanism 704. FIGS. 13*a*, 13*b* and 13*c* are front, side and top views, respectively. FIG. 13*b* illustrates rectangular frame 740 and vertical frame 742 secured to rectangular frame 740. Slide 744 is mounted to the top of rectangular frame 740. Conductor capture mechanism base plate 746 is mounted to the movable portion of slide 744. Base plate 746 is moved forward when conductors are initially captured by conductor capture mechanism 700, and it is moved backward after the initial capture. In reference to FIG. 13c, the sliding motion of plate 746 is controlled using air cylinder 748. The piston of air cylinder 748 is secured to brace 750 of base 746, and the rear portion of air cylinder 748 is secured to brace 752 which is attached to horizontal member 754 which is secured to vertical frame 742. When the piston of air cylinder 748 is extended, base plate 746 and whatever is attached to base plate 746 move in the direction of arrow 756. When the piston of air cylinder 748 is retracted, base plate 746 and its associated components move in the direction of arrow 758.

Mounted on base plate 746 are stationary conductor guide 760 and slidable conductor guide 762. Stationary conductor guide 760 is mounted to base plate 746 by braces 764. Sliding conductor guide 762 is mounted to base plate 746 by slide 766. Stationary portion of slide 766 is mounted to base plate 746 by braces 768. Air cylinder 770 is also mounted to base plate 746. The piston of air cylinder 770 is attached to block 772 which is also attached to slidable base plate 762. When the piston of air cylinder 770 is extended, slidable conductor guide 762 moves in the direction of arrow 774. When the piston of air cylinder 770 is retracted, slidable conductor plate 762 moves in the direction opposite to that of arrow 774. This enables an opening to be formed between conductor guides 760 and 762 so that the untwisted conductors of cable 190 can be placed between conductor guides 760 and 762. To facilitate capture of the conductors between plates 760 and 762, conductor guides 776 and 778 are also attached to base plate 746. Guide 776 is visible in FIG. 13*b* and guide 778 is visible in FIG. 13*a*. These guides, together with extension 780 of plate 760, help to capture the conductors of cable 190 as the cable clamp of cable transport mechanism 54 moves the conductors to a position above the space between plate 760 and 762. Conductor 190 is moved to this location while air cylinder 748 has extended its piston to push based plate 746 and its attached components to a forward position, that is, in the direction of arrow 756, and air cylinder 770 extends its piston to move slidable conductor guide 762 in the direction of arrow 774 to create an opening between guides 760 and 762. (This is illustrated in FIG. 12*a*). Once in this position, the pneumatic cable clamp of cable transport mechanism 54 lowers cable 190 so that the conductors are placed between cable conductor guides 760 and 762. At this point, the piston of air cylinder 770 is retracted to capture the conductors between conductor guide plates 760 and 762. Air cylinder 748 then retracts its piston to move base plate 746 in the direction of arrow 758 so that conductors 238 are aligned in a single column between beveled edges 782 and 784 of conductor guides 760 and 762, respectively. After the pistons of air cylinder 770 and 748 have been retracted, the pneumatic cable clamp of cable transport mechanism 54 moves downward to transfer cable 190 to cable clamp mechanism 708 which is in an upper position. When transferring cable 190 to cable clamp mechanism 708, cable 190 is moved downward approximately 3.0 inches. In reference to FIG. 13*a*, this places a downward tension on conductors 238 to push the conductors in the direction of arrow 786 so that the conductors move into wire channel 788 in wire identification mechanism 702.

In order to facilitate the moving of the conductors positioned between conductor guide plates 760 and 762 in the direction of wire channel 788, blade 790 (FIG. 13*b*) attached to arm 792 of conductor feed mechanism 710 pushes downward on the conductors between conductor guides 760 and 762. Arm 792 is pivotally mounted to frame 742 by pivot 794. The piston of air cylinder 796 acts on extension 798 of arm 792 to move blade 790 upward and downward. Blade 790 is moved upward by extending the piston of air cylinder 796. This upward position is used when the conductors are first captured between plates 760 and 762. Retracting the piston of air cylinder 796 allows blade 790 to press down on the conductors between plate 760 and 762 and thereby facilitates the movement of the conductors into conductor channel 788 of identification mechanism 702.

Conductor identification mechanism 702 is positioned within frame 740. FIG. 13*a* illustrates rotating disk 714 which is positioned in frame plate 793 of rectangular frame 740. As mentioned earlier, conductors positioned between plates 760 and 762 are fed into conductor channel 788 in frame plate 793. Channel 788 is only wide enough to accommodate a single column of wires. Conductor notch 712 is located at the outer perimeter of disk 714 and is large enough to accept only one conductor at a time. A second conductor notch is positioned along the outer circumference of disk 714 at a position 180 degrees from notch 712. As conductors are fed into channel 788 one conductor is accepted into notch 712. Disk 714 then rotates in a counter-clockwise direction to place notch 712 and the conductor within notch 712 under blade of wire identifier 716. The blade of wire identifier 716 cuts through the insulation of the conductor in notch 712 to make electrical contact with the conductive material within the conductor. It completes a circuit that includes a connector that has been attached to the far end of cable 190 at spool 30. It should be noted that at this point cable 190 has not been cut away from spool 30 and therefore is still part of the entire length of cable on spool 30. The wire is identified by determining which of the contacts of the connector at the far end of cable 190 has an electrical signal provided by identifier 716. In this manner, the conductor in notch 712 is identified and it is thereby determined which contact of connector 64 should receive the conductor in notch 712.

Figure 13D:
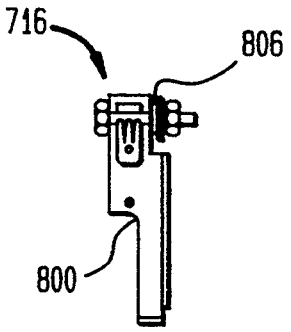

In reference to FIGS. 13*a* and 13*d*, it is important that the blade of identifier 716 is adjusted so that it cuts through the insulation of the conductor in notch 712 and partially into the material within the conductor. The depth of the cut created by identifier 716 is adjusted by loosening lock bolts 799 so that L-shaped arm 800 can rotate about pivot point 802. The amount of rotation about pivot point 802 can be controlled by rotating adjustment mechanism 804. Once the arm 800 has been pivoted to a point that provides the desired depth of cut, lock bolts 799 are tightened to prevent unintentional motion.

Sometimes, the conductor in notch 712 is accidentally nicked while passing through channel 788 to notch 712 and may have a short circuit to frame plate 793 when wire identifier 716 makes electrical contact with the conductive material within the conductor. The short circuit to frame plate 793 prevents detecting a signal at the connector that is attached to the end of cable 190 at spool 30. This problem is alleviated by rotating disk 714 counter-clockwise past wire identifier 716. This motion tends to move the nick away from notch 712 in the direction of cable clamp 708 as seen in FIG. 12*b*. This moves the nick on the conductor a sufficient distance to eliminate the short circuit with frame 793. After removing the short circuit, disk 714 is rotated in a clockwise direction to place the conductor under wire identifier 716 so that the conductor can be identified. It is also possible to move the conductor to a second identifier that is positioned along disk 714. Moving the conductor to the second identifier moves the nick away from notch 712 and eliminates the need to move the conductor back to identifier 716.

After the conductor has been identified by conductor identifier 716, disk 714 rotates to either a clockwise or counter-clockwise direction. With reference to FIG. 12*b*, if the contact of connector 64 that is to receive the conductor is on the left side of connector 64, disk 714 will rotate in a counter-clockwise direction from wire identifier 716. If the contact is on the right side of connector 64, disk 714 will rotate in a clockwise direction from wire identifier 716. It should be noted that as notch 712 passes under channel 788 a new conductor is not received into notch 712 because notch 712 already has a conductor and is only large enough to accommodate one conductor at a time. When disk 714 is rotated to a point that positions notch 712 at a position that is 180 degrees away from channel 788, the conductor in notch 712 is transferred to wire transfer mechanism 704. It should be noted that a second notch in disk 714 that is 180 degrees away from notch 712. The second notch is aligned with slot 788 when notch 712 is rotated to a point where the conductor in notch 712 is transferred to wire transfer mechanism 704. This second notch increases efficiency by allowing a new conductor to be transferred to disk 714 while notch 712 is transferring its conductor to wire transfer mechanism 704. The conductor received by the second notch is treated in the same manner as the conductor that was received by notch 712. Each notch alternately receives conductors from channel 788 until all of the conductors of cable 190 have been identified by wire identifier 716 and have been transferred to wire transfer mechanism 704 by disk 714.

In reference to FIGS. 13*a* and 13*b*, wire transfer mechanism 704 is mounted to vertical frame member 820 and horizontal frame member 822. Left wire transfer arm 824 and right wire transfer arm 826 are pivotally mounted to frame 820. Left wire transfer arm 824 is used to transfer identified conductors from disk 714 to the left side of connector 64 so that the conductor can be inserted into an insulation displacement contact by wire insertion mechanism 718. Right wire transfer arm 826 is used to transfer identified conductors from disk 714 to a position on the right side of connector 64 so that the wire insertion mechanism 719 can insert the conductor into the proper insulation displacement contact on the right side of the connector.

Disk 714 transfers wires to left transfer arm 824 by rotating in a counter-clockwise direction and disk 714 transfers conductors to right transfer arms 826 by rotating in a clockwise direction. For example, as disk 714 rotates in a clockwise direction, conductor 238 in notch 712 is positioned between barrels 828 and 830 of right transfer arm 826. This is illustrated in FIG. 13*b*. Similarly, when disk 714 rotates in a counter-clockwise direction conductor 238 is placed between the barrels of transfer arm 824 as illustrated in FIG. 12*b*.

Figure 14A:
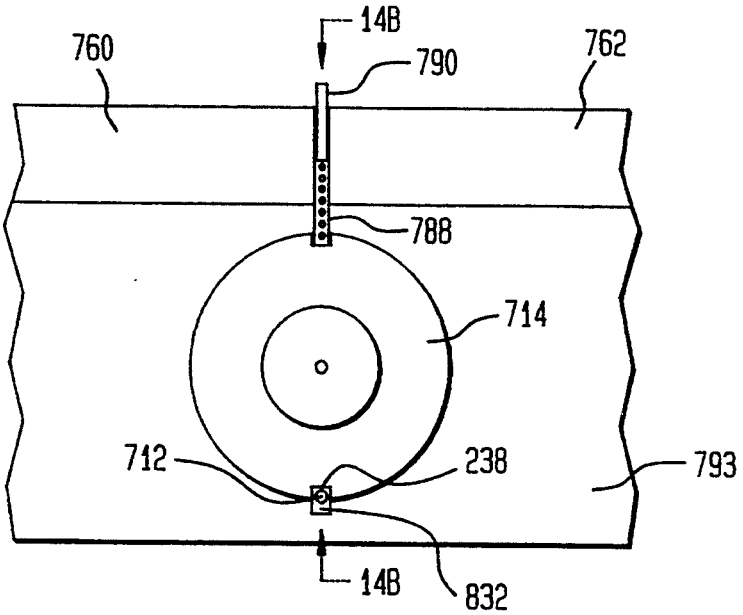
FIGS. 14*a*–14*e* illustrate unloading a wire from disk 714.
Figure 14B:
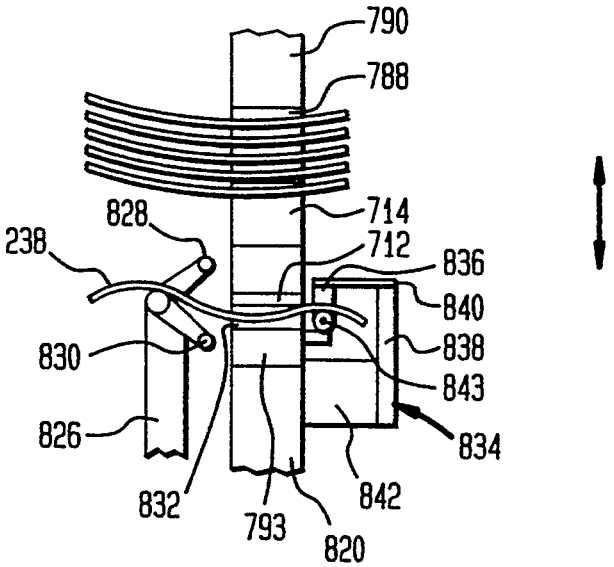
Figure 14C:
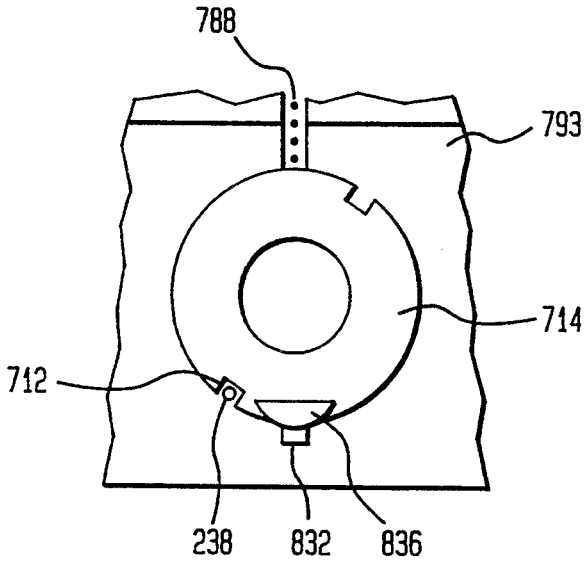
Figure 14D:
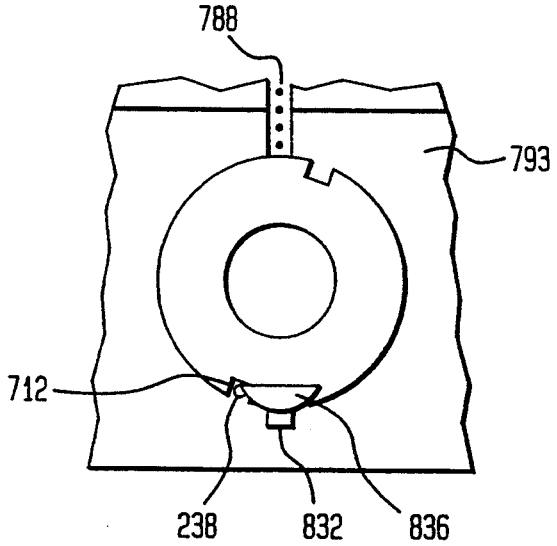
Figure 14E:
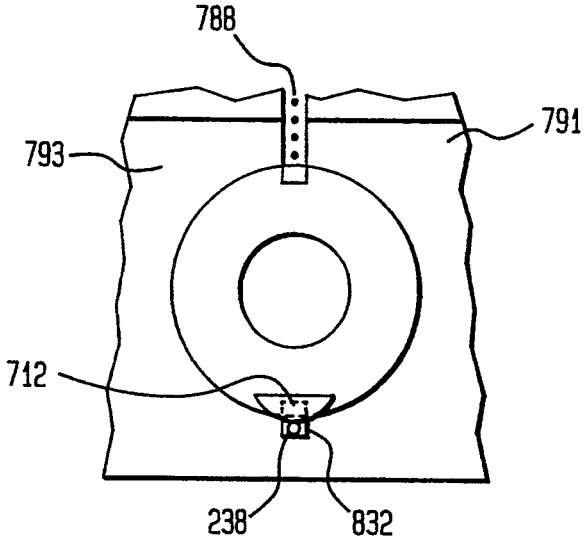

FIG. 14*a* through FIG. 14*e* illustrate how conductor 238 in notch 712 of disk 714 are moved to unload notch 832 in frame plate 793. It should be noted that while notch 712 is aligned with unload notch 832, an additional conductor in slot 788 is loaded into a second notch in disk 714 which is 180 degrees from notch 712. This enables disk 714 to pick up a conductor from channel 788 while unloading another conductor from notch 712 into unload notch 832. FIG. 14*b* is a cross-section of FIG. 14*a* taken along line BB. FIG. 14*b* illustrates the conductors in channel 788 and one conductor loaded into the notch that is positioned 180 degrees from notch 712. It also illustrates conductor 238 after it has been unloaded from notch 712 into notch 832. It should be noted that conductor 238 is moved from notch 712 to notch 832 while maintaining its position between barrels 828 and 830 of conductor transfer arm 826. Conductor 238 is moved between notches 712 and 832 by the action of unload mechanism 834. Unload mechanism 834 comprises a cam surface 836 which is mounted to vertical support 838 via leaf spring 840. Vertical support 838 is mounted to frame 820 via block 842. Once in notch 832, conductor 238 is lightly captivated between cam surface 832 and the surface of rigid bar 843. Rigid bar 843 is mounted to frame plate 793. FIGS. 14*c* through 14*e* illustrate how unload mechanism 834 moves conductor 238 from notch 712 to notch 832. FIG. 14*c* is a rear view of disk 714 and illustrates the position of cam 836 before notch 712 moves conductor 238 into contact with cam 836. FIG. 14*d* illustrates the position of cam 836 after notch 712 has moved the conductor into contact with cam 836. Cam 836 is moved upward against the resistance of leaf spring 840 by conductor 238. Conductor 238 is held and not pushed out of notch 712 because conductor 238 is pressed against the edge of frame plate 793. In FIG. 14*e* disk 714 has rotated to a point so that notches 712 and 832 are aligned. At this point, the force generated by leaf spring 840 pushes conductor 238 from notch 712 into slot 832. At this point it should also be noted that the notch 180 degrees from notch 712 has picked up another conductor from wire channel 788. It should also be noted that both sides of cam 836 are similar so that a conductor can be moved to notch 832 and when disk 714 rotates in either a clockwise or counter-clockwise direction. After conductor 238 has been transferred from notch 712 to notch 832, conductor 238 is ready to be moved to conductor insertion device 719 by conductor transfer arm 826.

FIG. 13*b* illustrates the manner in which disk 714 is rotated. Disk 714 is attached to shaft 843 which is connected to motor driver/indexer 845. At the rear of motor driver/indexer 845 is slotted disk 847. The slotted disk 847 passes between the contacts of slotted optical switch 849. The direction, rate and amount of rotation provided to disk 714 by motor driver/indexer 845 is monitored and controlled through the use of the signal generated by slotted optical switch 849 in a manner well-known in the art. Motor driver/indexer 845 can be obtained from Parker Hannifin Corp. located in Rohnert Park, Calif.

FIG. 13*b* also illustrates right conductor transfer arm 826. Conductor transfer arm 826 comprises support arm 844 and pivoting arm 846. Barrel 828 is mounted on support arm 844 and barrel 830 is mounted on pivotal arm 846. Pivotal arm 846 pivots about point 848 on arm 844. Spring 850 has one end connected to arm 844 and the other end connected to arm 846. Spring 850 acts to bring barrels 828 and 830 into contact so that they may grasp a conductor. Arm 844 is pivotally attached to frame 820 at point 852 via bearing assembly 854. Arm 844 is also pivotally attached to the piston rod of air cylinder 856 at point 858. Air cylinder 856 is pivotally connected to vertical extension 860 of frame 822 at point 862. When the piston of air cylinder 856 is extended, arm 844 pivots about point 852 to assume a nearly horizontal position. When the piston of air cylinder 856 is retracted, arm 844 pivots about point 852 to assume a vertical position as shown in the figure. Shock absorber 864 is used to lessen the impact of arm 844 against stop 866. Shock absorber 868 is used to minimize the impact of arm 844 against stop 870 when arm 844 moves to a vertical position.

When in the vertical position, roller 872 of arm 846 is pressed against the lower portion of stop 870 to act against spring 850 to rotate pivot arm 846 about point 848 and thereby separate barrels 828 and 830. As the piston of air cylinder 856 begins to extend, roller 872 slides along the curved surface of stop 870 until spring 850 pivots arm 846 so that barrels 828 and 830 grasp a conductor.

As arm 844 reaches the end of its travel about pivot point 852, roller 874 contacts stop 866. This acts against the force of spring 850 and causes arm 846 to pivot about point 848 to separate barrels 828 and 830. This action permits releasing the excess portion of the conductor after insertion mechanism 719 has inserted the conductor into the appropriate contact of connector 64. After releasing the conductor, the piston of air cylinder 856 is retracted to move arm 844 to a vertical position where the interaction of roller 872 and stop 870 separates barrels 828 and 830 so that they may accept the next conductor that is placed between them by disk 714.

Figure 15A:
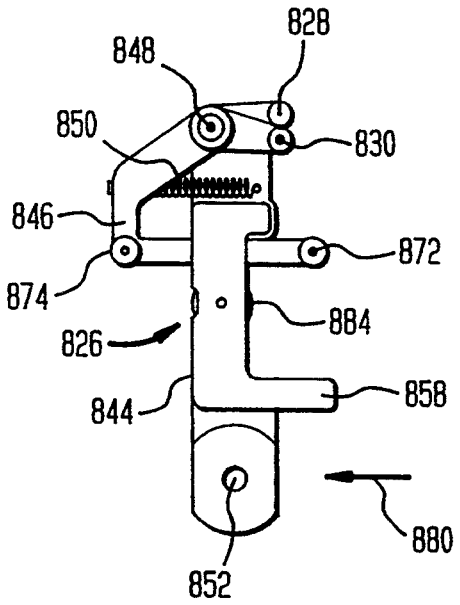
FIGS. 15*a*–15*d* illustrate conductor transfer arms.
Figure 15B:
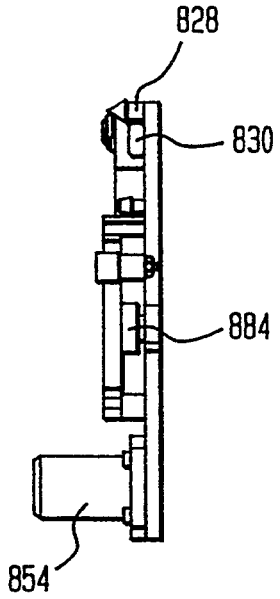
Figure 15C:
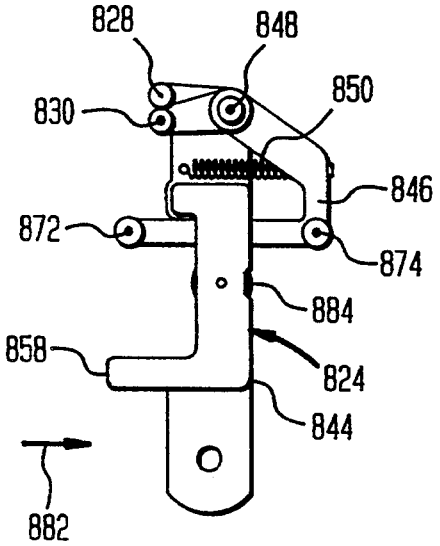
Figure 15D:
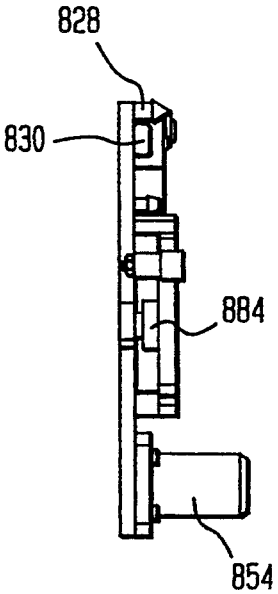

Conductor transfer arms 824 and 826 are mirror images of each other as illustrated in FIGS. 15*a* through 15*d*. FIGS. 15*a* and 15*b* illustrate arm 826 from a side view and from a view in the direction of arrow 880. FIGS. 15*c* and 15*d* illustrate arm 824 from a side view and from a view in the direction of arrow 882, respectively. The figures show arm 846 pivoted so that barrels 828 and 830 are in a position that is used to grasp a conductor. Views 15*b* and 15*d* illustrates rollers 884 that impact shock absorbers 868.

Figure 16A:
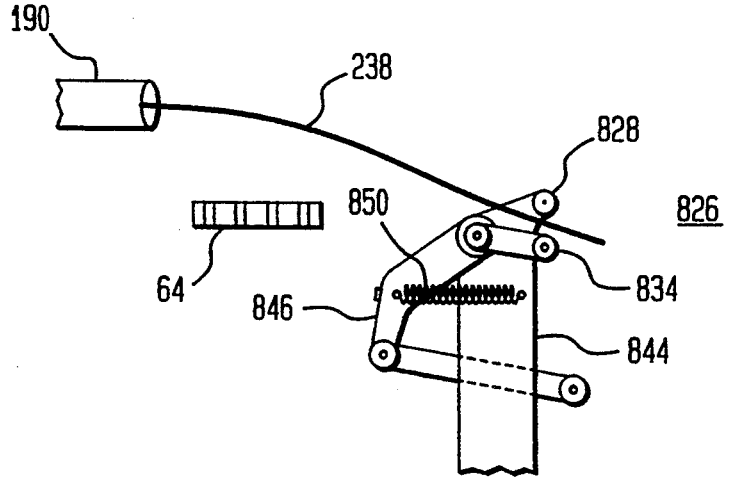
FIGS. 16*a*–16*e* illustrate transferring a conductor to a connector.

FIGS. 16*a* through 16*e* illustrate how conductor transfer arm 826 grasps a conductor and transfers it to conductor insertion mechanism 719. Conductor transfer arm 726 and 724 operated in a similar fashion. FIG. 16*a* is a side view that illustrates the position of conductor 238 of cable 190 just prior to barrels 828 and 830 grasping the conductor. This occurs when arm 844 is in a vertical position. At this point, it should be noted that conductor 238 has been unloaded from notch 712 of disk 714 by unload mechanism 834 and is held in notch 832 by unload mechanism 834. The figure also illustrates the relative position of connector 64 with respect to the end of the sheathed portion of cable 190 and arm 844 when in a vertical position.

Figure 16B:
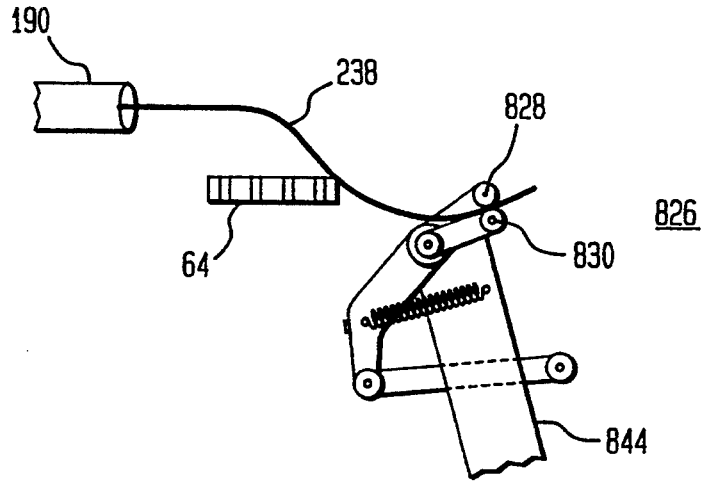

FIG. 16*b* illustrates the relationship between conductor 238, connector 64 and conductor transfer arm 826 after the piston of air cylinder 856 is extended to begin the rotation of arm 844 about point 852. Barrels 828 and 830 have moved together to grasp conductor 238. Conductor 238 has now been pulled free of notch 832 and is beginning to be bent downward to align it with the appropriate contact of connector 64.

Figure 16C:
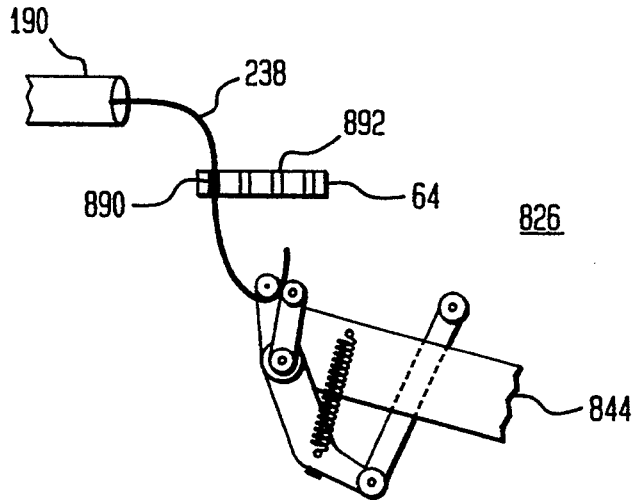
Figure 16D:
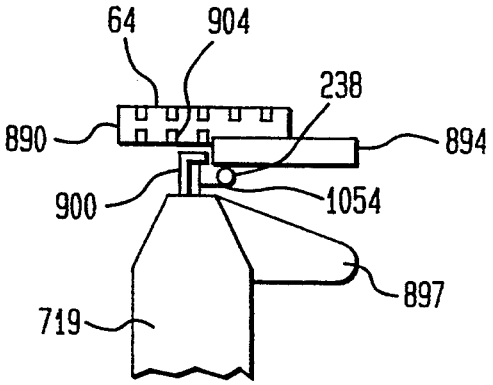
Figure 16E:
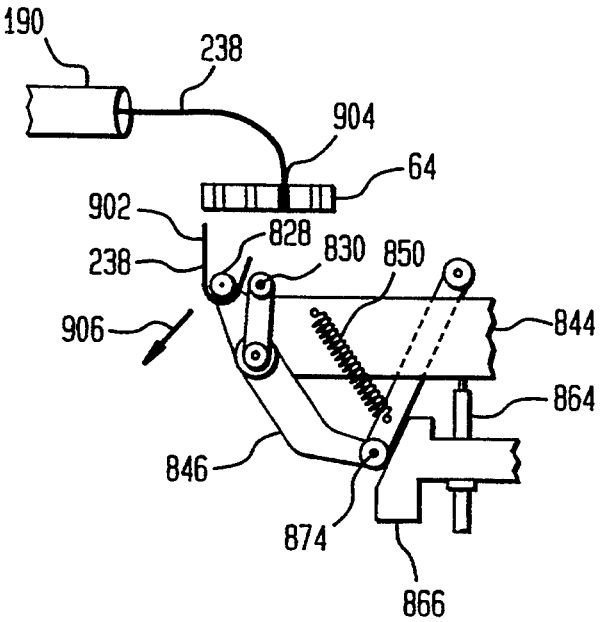

FIG. 16*c* illustrates the position of conductor 238 with respect to connector 64 and conductor transfer arm 826 when arm 844 is rotated to a nearly-horizontal position. It can be seen that conductor 238 has been pulled downward and backward toward end 890 of connector 64. It should be noted that conductor 238 has passed in front of each of the contacts of connector 64 as arm 844 is rotated toward a horizontal position. FIG. 16*d* is a simplified illustration of a top view of a portion of connector insertion mechanism 719 and conductor guides 894 and 897. As conductor transfer arm 826 moves towards a horizontal position, conductor 238 is drawn between guides 894 and 897. It should be noted that conductor insertion mechanism 719 is positioned in front of contact 904 of connector 64 based on the identification of conductor 238 that was carried out earlier. As arm 844 rotates from a vertical to a horizontal position, conductor 238 is brought into contact with rotating hook 900. At this point, conductor 238 also contacts microswitch mechanism 1054 which triggers conductor insertion mechanism 719 to rotate hook 900 out of conductor 238's path as it inserts conductor 238 into insulation displacement contact 904 of connector 64. This action also cuts conductor 238 at point 902 as seen in FIG. 16*e*. FIG. 16*e* illustrates arm 844 in a horizontal position. It should be noted that shock absorber 864 minimizes the impact of roller 874 against stop 866. It should also be noted that from the relationship of cut end 902 and contact 904, that arm 844 continued to pivot to a horizontal position after conductor 238 was inserted into contact 904. When roller 874 contacts stop 866, arm 846 pivots to separate barrels 828 and 830 to release the cut end portion of conductor 238. As barrels 828 and 830 separate, the motion of arm 844 projects the cut portion of conductor 238 in the direction of arrow 906 and into a waste receptacle.

Figure 17A:
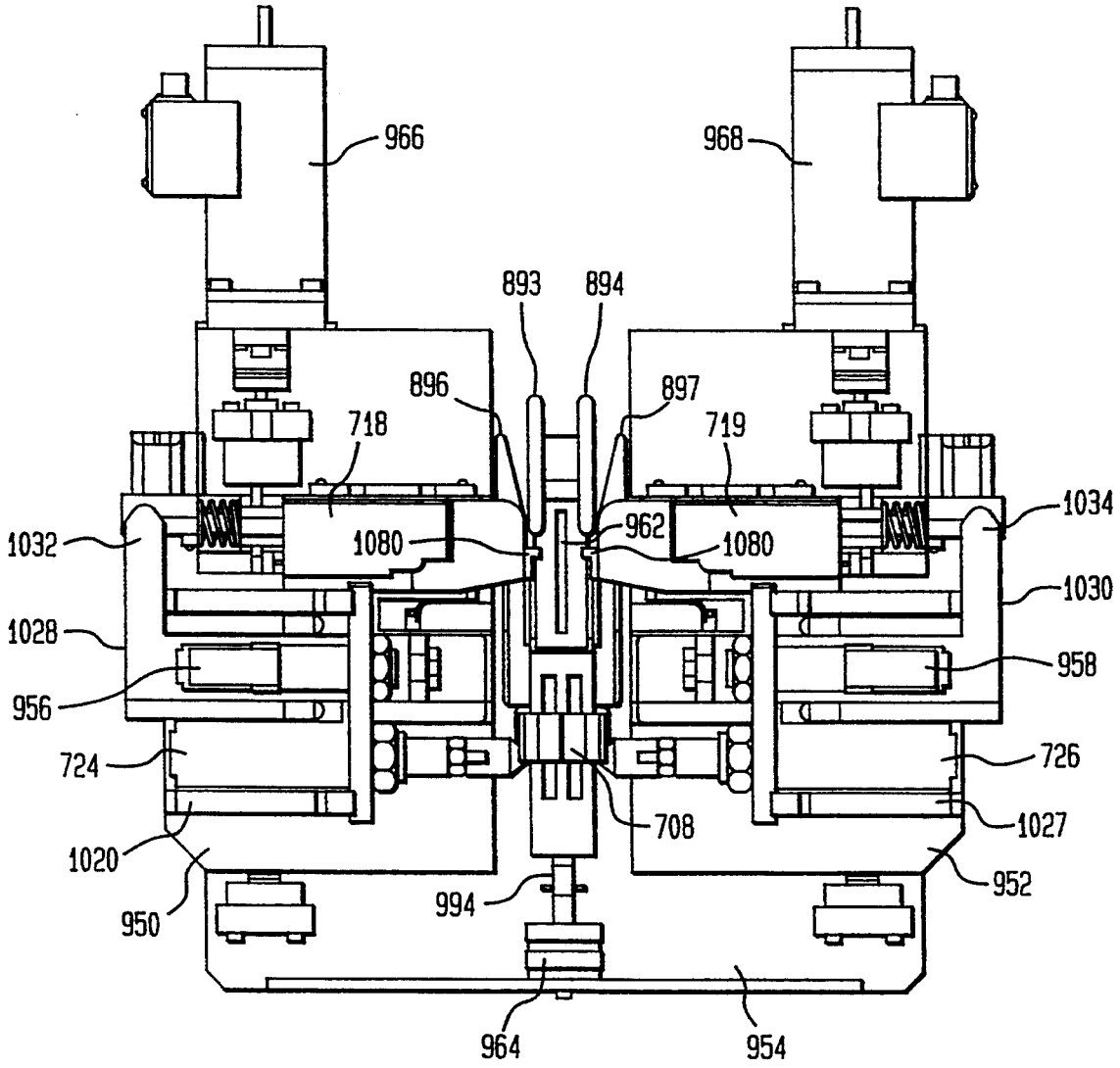
FIGS. 17*a*–17*i* illustrate a connectorization mechanism and a conductor insertion mechanism.

FIG. 17*a* illustrates a top view of connectorization mechanism 706. Left sliding base 950 and right sliding base 952 are mounted on base plate 954. Left sliding base 950 includes air cylinder 724 which is used to close strain relief 722, and air cylinder 956 which is used to operate conductor insertion mechanism 718. Likewise, right sliding base plate 952 includes air cylinder 726 which is used to close strain relief clamp 722 and air cylinder 958 which is used to operate conductor insertion mechanism 719. Base plate 954 includes cable clamp 708, connector mandrel nest 962, conductor guides 896 and 897, pancake air cylinder 964, left motor 966 and right motor 968.

Figure 17B:
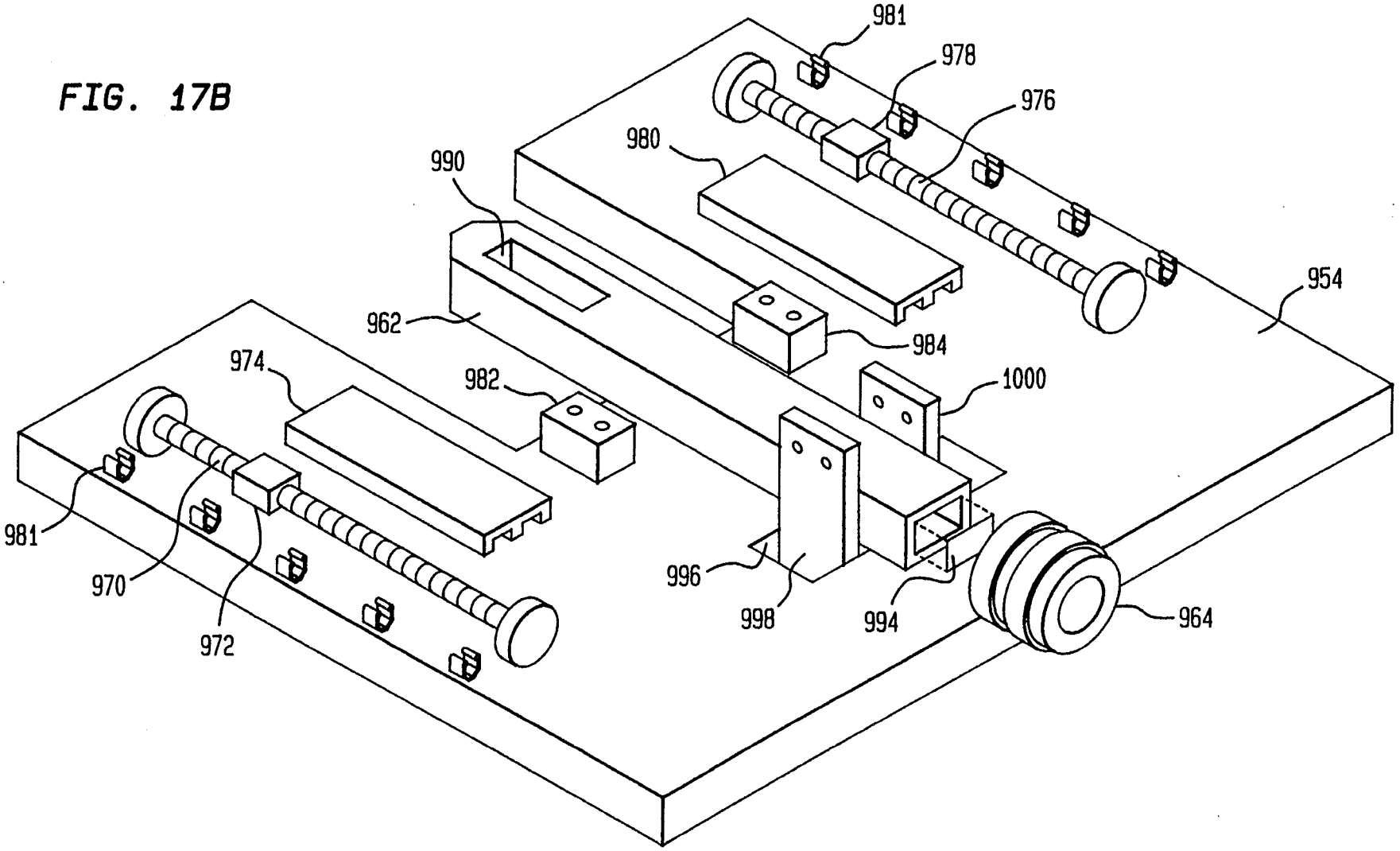

FIG. 17*b* illustrates base plate 954 without sliding base plates 950 and 952. Left screw 970 is rotated by motor 966. As motor 966 rotates screw 970, block 972 moves along the length of screw 970. Base plate 954 also includes slide 974. Sliding base plate 950 is mounted to block 972 and slide 974 so that sliding base plate 950 can move in a direction parallel to screw 970 as motor 966 rotates. This enables aligning connector insert mechanism 718 which is mounted on sliding base plate 950 with the proper contact of connector 64. In similar fashion, screw 976 is rotated by motor 968 so that block 978 moves along the length of screw 976. Also mounted to base plate 954 is slide 980. Sliding base plate 952 is mounted to slide 980 and block 978 so that sliding base plate 952 can move along the length of screw 976 as motor 968 turns. This enables aligning connector insertion mechanism 719 with the proper contact of connector 64. Base plate 954 also includes mounting blocks 982 and 984. Mounting block 982 and 984 support conductor guides 896 and 897. Connector mandrel nest 962 is also mounted to base plate 954. Switches 981 are used to determine the positions of sliding base plates 950 and 952.

Figure 17C:
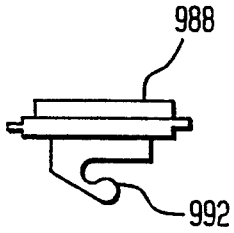

FIG. 17*c* illustrates mandrel 988 which is received into opening 990 in nest 962. Connector 64 is mounted to mandrel 988 when conductors are being attached to the connector. It should be noted that mandrel 988 is provided in both male and female forms so that connector 64 can be either a male or female connector. Mandrel 988 is inserted into opening 990 so that catch 992 is facing the direction of pancake air cylinder 964. The piston of air cylinder 964 is attached to mandrel shaft 994. When the piston of pancake air cylinder 964 is extended, mandrel shaft 994 interacts with notch 992 of mandrel 988 to hold the mandrel within mandrel nest 962. When it is desirable to change mandrels, the piston of pancake air cylinder 964 is retracted to retract mandrel shaft 994 so that mandrel 988 can be removed from mandrel nest 962.

Base plate 954 also includes opening 996 through which vertical arms 998 and 1000 of cable clamp 708 extend.

Figure 17D:
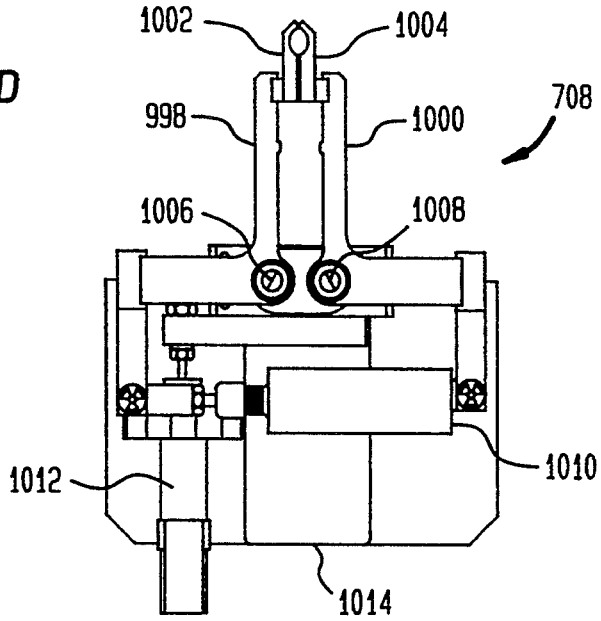

FIG. 17*d* illustrates clamp 708. Attached to vertical arms 998 and 1000 are cable clamps 1002 and 1004, respectively. Vertical arms 998 and 1000 rotate about points 1006 and 1008, respectively, so that clamps 1002 and 1004 may be opened and closed to grasp and release a cable. Arms 998 and 1000 are rotated about points 1006 and 1008 by the action of air cylinder 1010. Additionally, arms 998 and 1000 are moved in a vertical direction so that the cable can be held in an upper position while the conductors are attached to connector 64 and then move to a lower position so that the cable is properly aligned with strain relief clamp 722 when air cylinders 724 and 726 close the strain relief clamp about the cable. Vertical arms 998 and 1000 are moved vertically by the action of air cylinder 1012 which moves the arms in a vertical direction by moving slide 1014 in a vertical direction. Arms 998, 1000 and air cylinder 1010 are all mounted on slide 1014 so that they can be moved in a vertical direction by the action of air cylinder 1012.

Figure 17G:
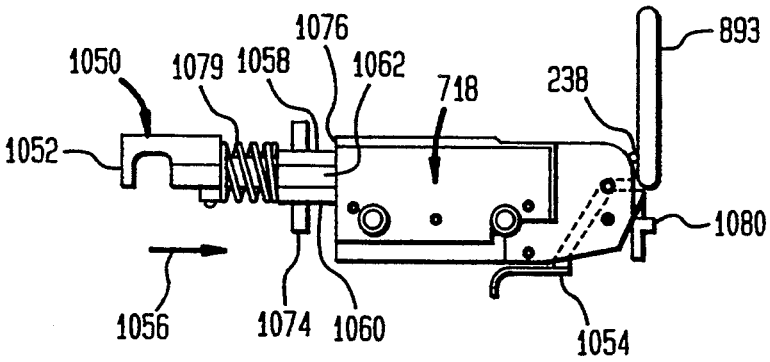
Figure 17E:
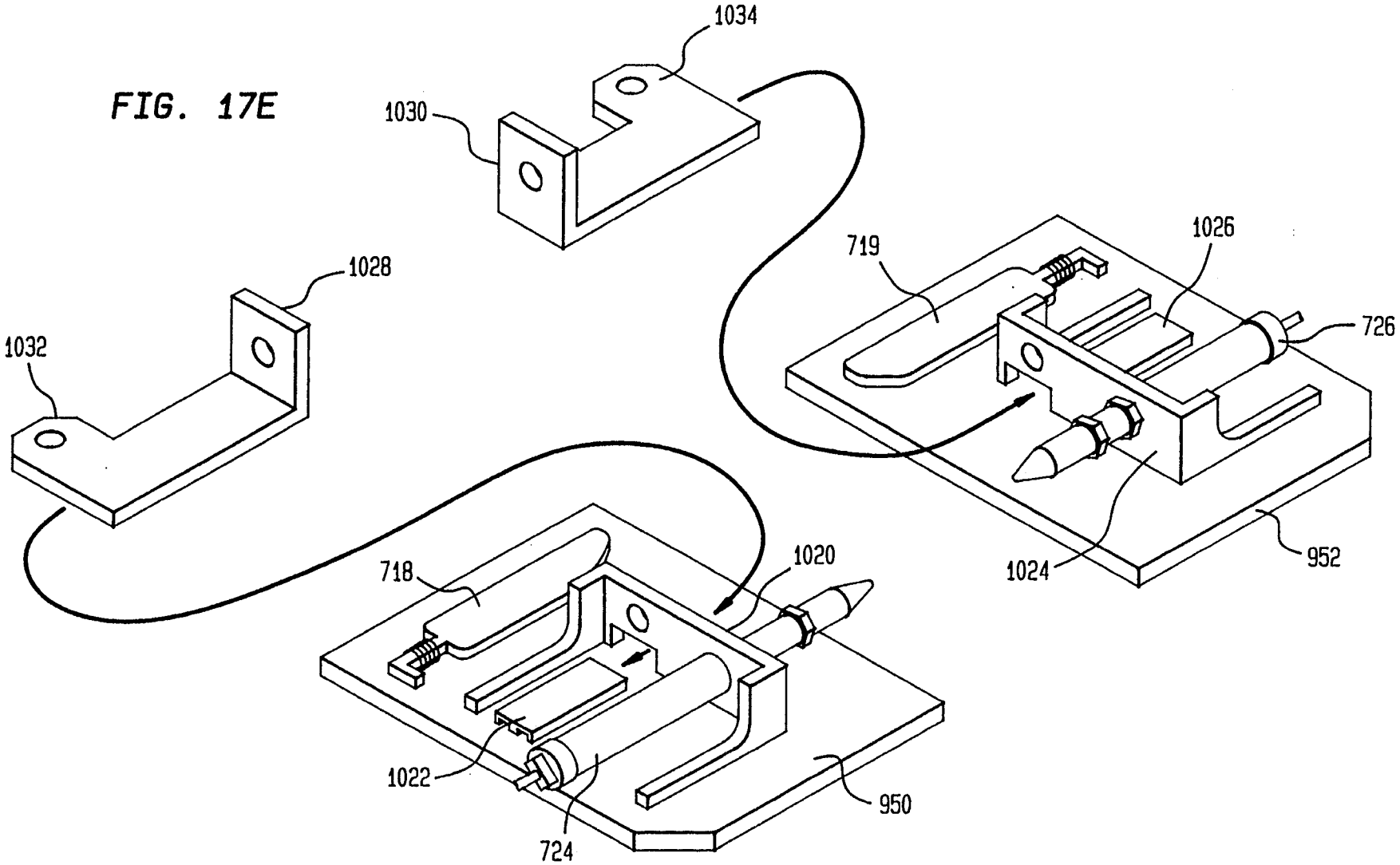
Figure 17F:
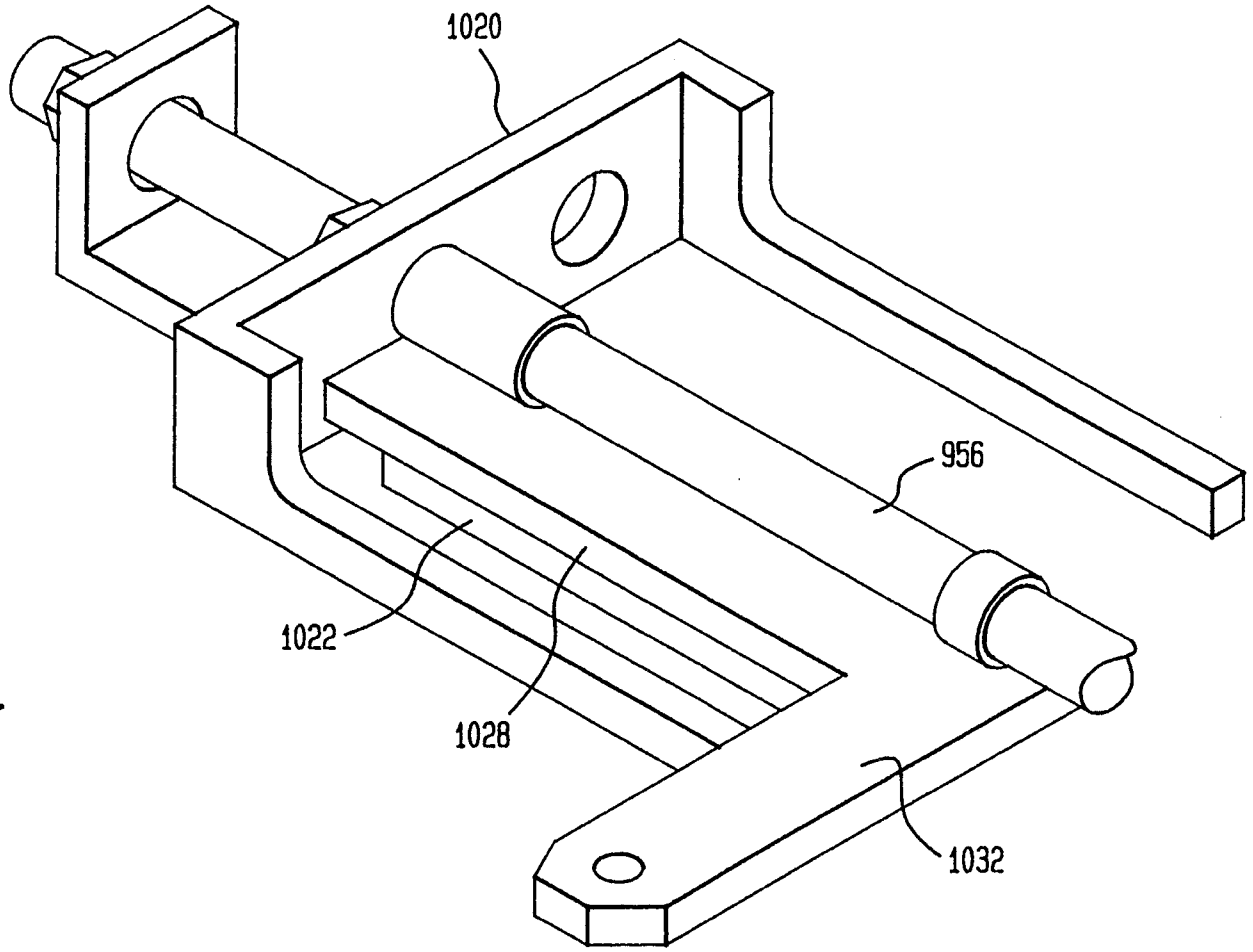

FIG. 17*e* illustrates sliding base plates 950 and 952. Sliding base plate 950 includes frames 1020 and 1028, and slide 1022. Likewise, sliding base plate 952 includes frames 1024 and 1030, and slide 1026. In reference to FIG. 17*f*, frame 1028 is mounted to slide 1022. Frame 1028 slides along slide 1022 by the action of air cylinder 956. Air cylinder 956 is mounted to frame 1020 and when the piston of air cylinder 956 is extended or retracted, frame 1028 moves in a direction parallel to slide 1022. Frame 1030, slide 1026 and air cylinder 958 operate in a similar manner.

Returning to FIGS. 17*a* and 17*f*, extension 1032 of frame 1028 is used to control conductor insertion mechanism 718. Likewise, extension 1034 of frame 1030 is used to control conductor insertion mechanism 719.

FIG. 17*g* illustrates conductor insertion mechanism 718. Only connector 718 will be discussed; however, conductor insertion mechanism 718 and conductor insertion mechanism 719 are mirror images of each other. Conductor insertion mechanism 718 includes shaft 1050 with end 1052 that interacts with a pin that connects end 1052 to frame extension 1032 of frame 1028. As a result, when frame 1028 is moved in the direction parallel to air cylinder 956 shaft 1050 is also moved in that direction.

Figure 17I:
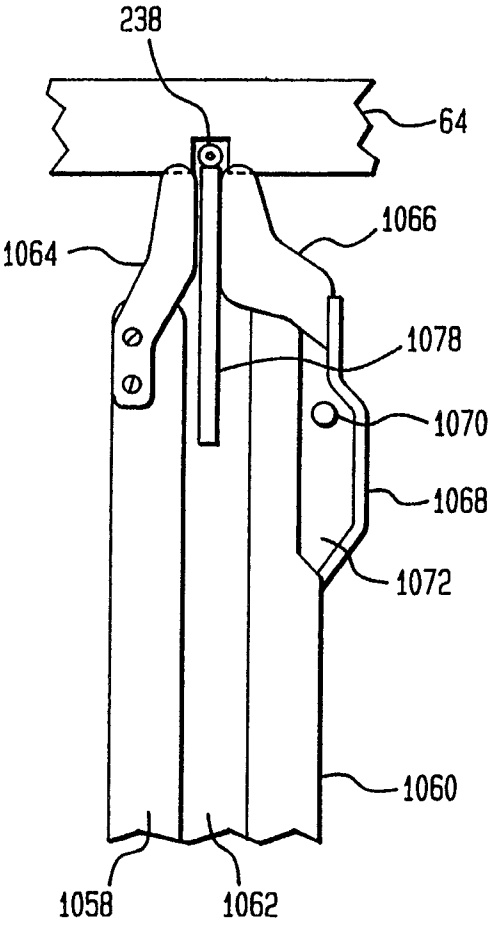
Figure 17H:
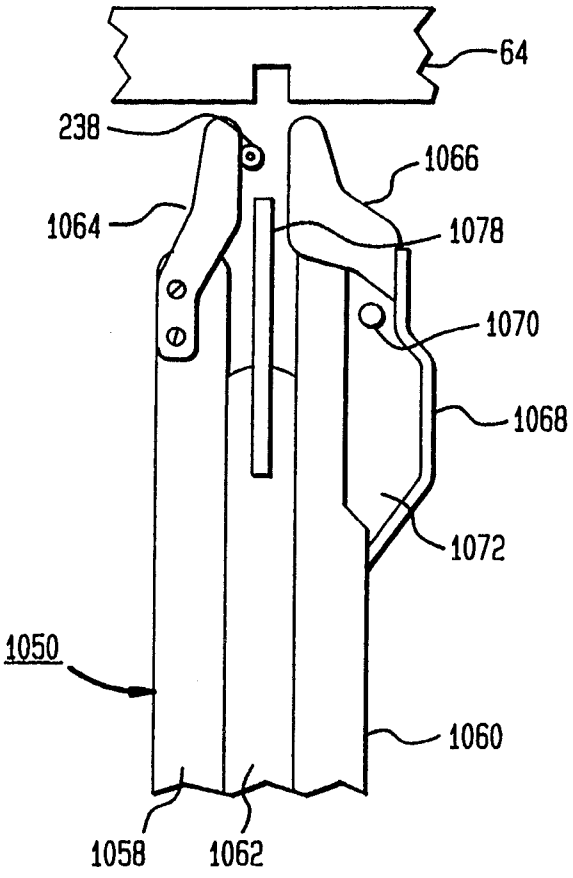

As conductor transfer arm 826 moves conductor 238 into position, for insertion into a contact of connector 64, the conductor is guided by conductor guides 896 and 893. Conductor guide 896 is mounted to block 982 of base plate 954 and conductor guide 893 is mounted to conductor insertion mechanism 718. Conductor 238 is eventually captured in the space between conductor guides 896 and 893 by rotating hook 900 (recall FIG. 16*d*). In addition, when conductor 238 is captured between guides 896 and 893, the conductor strikes microswitch mechanism 1054 which is activates air cylinder 956. As air cylinder 956 is activated, shaft 1050 is driven in the direction of arrow 1056. As illustrated in FIG. 17*h*, shaft 1050 includes outer portions 1058 and 1060 and inner portion 1062. Attached to portions 1058 and 1060 are left wire gripper 1064 and right wire gripper 1066, respectively. Right wire gripper 1066 is attached to cammed leaf spring 1068. As shaft 1050 is moved forward, conductor 238 is positioned between wire grippers 1064 and 1066. In addition, as shaft 1050 continues to move forward, the relative positions of stationary pin 1070 and cammed leaf spring 1068 change so that pin 1070 is in area 1072 and thereby allows wire grippers 1064 and 1066 close on conductor 238 (see FIG. 17*i*). Once the wire is gripped, rotating hook mechanism 900 is rotated so that the hook will not interfere with inserting conductor 238 into the proper contact of connector 64. Returning to FIG. 17*g*, as shaft 1050 is moved in the direction of arrow 1056, stops 1074 contact body 1076 to stop the motion of outer shaft portions 1058 and 1060. At this point, inner shaft portion 1062 continues to slide in the direction of arrow 1056 so that conductor insertion blade 1078 forces conductor 238 in between the contact surfaces of the insulation displacement contact of connector 64. As conductor 238 is inserted into the contact, the excess portion of conductor 238 is cut by a blade. FIG. 17*i* indicates the relative positions of shaft members 1058, 1060 and 1062, insertion blade 1078 and conductor 1038 as conductor 238 is inserted into a contact of connector 64. After conductor 238 has been inserted, the piston of air cylinder 956 is retracted so that shaft 1050 moves in the direction opposite to arrow 1056. The center portion 1062 of shaft 1050 is returned to its original position by the action of spring 1079.

In reference to FIGS. 17*g* and 17*a*, conductor insertion devices 718 and 719 include connector support extensions 1080. These extensions are used to support the side of the connector that is opposite to the side where a conductor is being inserted. This helps to provide a solid base against which conductor 238 can be pushed so that it is forced into the contact of connector 64. For example, when conductor insertion mechanism 718 is inserting a conductor into a contact of connector 64, support extension 1080 of conductor insertion mechanism 719 supports the opposite side of connector 64 so that it does not move as conductor 238 is inserted.

Conductor insertion mechanisms 718 and 719 less connector support extensions 1080 and conductor guides 893 and 894 may be purchased from Cinch, Connector Division, 1500 Morse Avenue, Elk Grove Village, Ill. 60007, phone number 708-981-6000.

After connectorization and identification station 60 has completed inserting the conductors of cable 190 into the contacts of connector 64, clamp 614 of cable transport 54 is lowered onto connector 64 and grasps connector 64. In addition, tab 618 of clamp 614 facilitates positioning the end of cable 190 between the strain relief clamps of the connector to allow the strain relief clamps to be closed upon cable 190. After the strain relief clamps are closed, clamp 614 is raised to an upper position and cable transport mechanism 54 moves along gantry 114 to position clamp 614 over cable reeling mechanism 70. Clamp 614 is then moved to a lower position to allow cable reeling mechanism 70 to grasp connector 64.

In reference to FIG. 2, when cable 190 with connector 64 is moved to cable reeling mechanism 70, cable 190 is in the position of cable 122. After cable reeling mechanism 70 grasps connector 64 and after clamp 614 releases connector 64, cable reeling mechanism 70 rotates to reel up the cable as it is fed by cable pull mechanism 42. Cable reeling mechanism 70 continues to reel cable until the proper length has been fed by cable pull mechanism 42. Once the proper amount of cable has been fed by cable pull mechanism 42, cable pull mechanism 42 cuts cable 190 free from spool 30. Additionally, cable locating mechanism 74 controls the height of the windings of cable 190 on cable reeling mechanism 70. The unreeled portion of cable 190 that remains after cable reeling mechanism 70 stops rotating, is taken up by a loop created by cable locating mechanism 74.

Figure 18A:
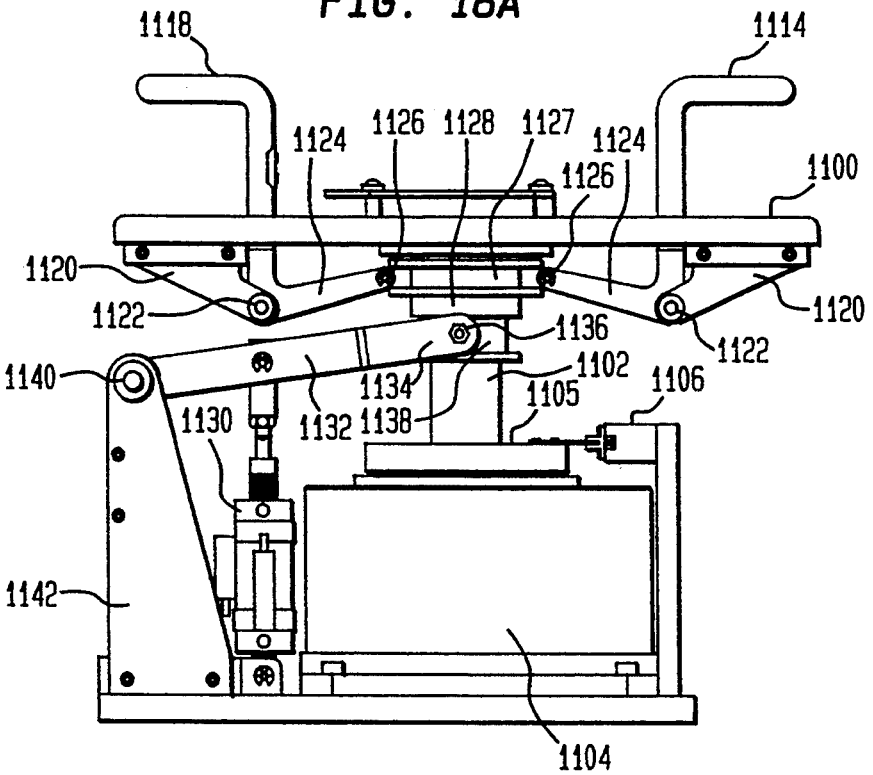
FIGS. 18*a*–18*c* illustrate cable reeling mechanism 70.
Figure 18B:
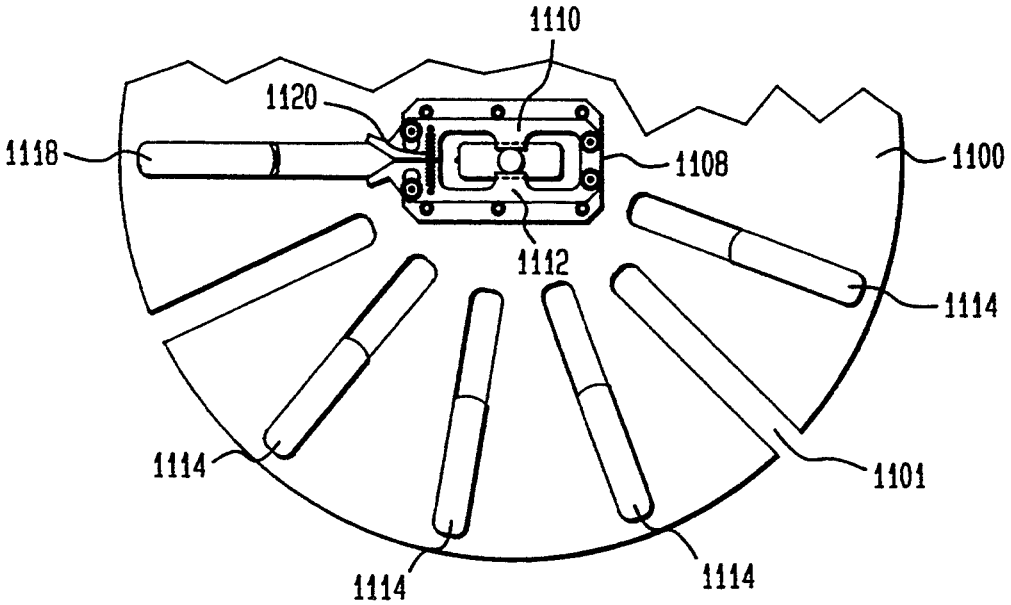

FIGS. 18*a* and 18*b* illustrate a side view and partial top view of cable reeling mechanism 70, respectively. Cable reeling mechanism 70 includes platter 1100. Platter 1100 includes slots 1101 that receive the cable coil pickup clamps of rotating cable transport mechanism 80. Platter 1100 is supported on rotating shaft 1102 and rotating shaft 1102 is rotated by motor 1104. Also attached to rotating shaft 1102 is disk 1105. Slotted optical switch 1106 senses the rotation of disk 1105 by means of a sensing flag so that the rotation of shaft 1102 and, therefore, platter 1100 can be controlled. Located in the center of platter 1100 is connector nest 1108. Connector nest 1108 includes connector clamps 1110 and 1112 which grasp connector 64 when it is inserted by clamp 614 of cable transport 54. Fingers 1114 are used to coil the cable and grasp the coiled cable while it is on cable reeling mechanism 70. When connector 64 is placed into nest 1108, fingers 1114 are retracted toward the center of platter 1100. When finger 1118 is retracted it presses against a V-shaped opening between connector clamps 1110 and 1112 to force them to separate so that connector 64 can be placed between them. Once connector 64 is placed between cable clamps 1110 and 1112, fingers 1114 and 1118 are returned to an outer position which allows cable clamps 1110 and 1112 to close on connector 64 so that it remains secure. Spring 1120 is used to retract connector clamps 1110 and 1112.

Figure 18C:
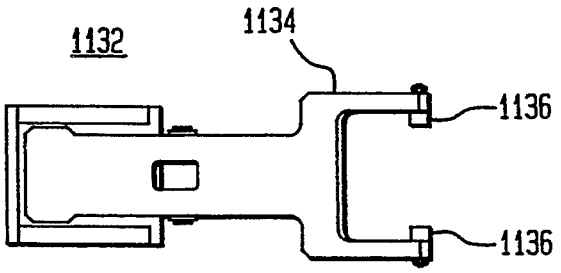

Each of fingers 1114 and 1118 is supported by brace 1120 with pivot 1122. Lower portion 1124 of fingers 1118 and 1114 contain rollers 1126 which ride in a channel of sheave 1128. Sheave 1128 can slide along the length of shaft 1102. When sheave 1128 is in an upward position, fingers 1114 and 1118 are extended outward, and when sheave 1128 is lowered, fingers 1118 and 1114 retract toward the center of platter 1100. Sheave 1128 is moved upward and downward through the action of air cylinder 1130 which moves arm 1132. In reference to FIG. 18*c*, arm 1132 has a U-shaped end 1134 with rollers 1136 that ride in lower channel 1138 of sheave 1128. Arm 1132 pivots about rod 1140 which is supported by brace 1142.

It should be noted that when fingers 1114 and finger 1118 are in their extended position, they maintain cable 190 in a coiled configuration. This configuration is maintained until rotating cable transport mechanism 80 is ready to move coiled cable 190 and connector 64 to coiled cable holding mechanism 82. When rotating cable transport mechanism 80 has grasped coiled cable 190, fingers 1114 and finger 1118 are retracted by moving sheave 1128 to a lower position; this also opens connector clamps 1110 and 1112 so that connector 64 can be removed from connector nest 1108. This enables coiled cable 190 to be lifted by rotating cable transport 80.

Figure 19A:
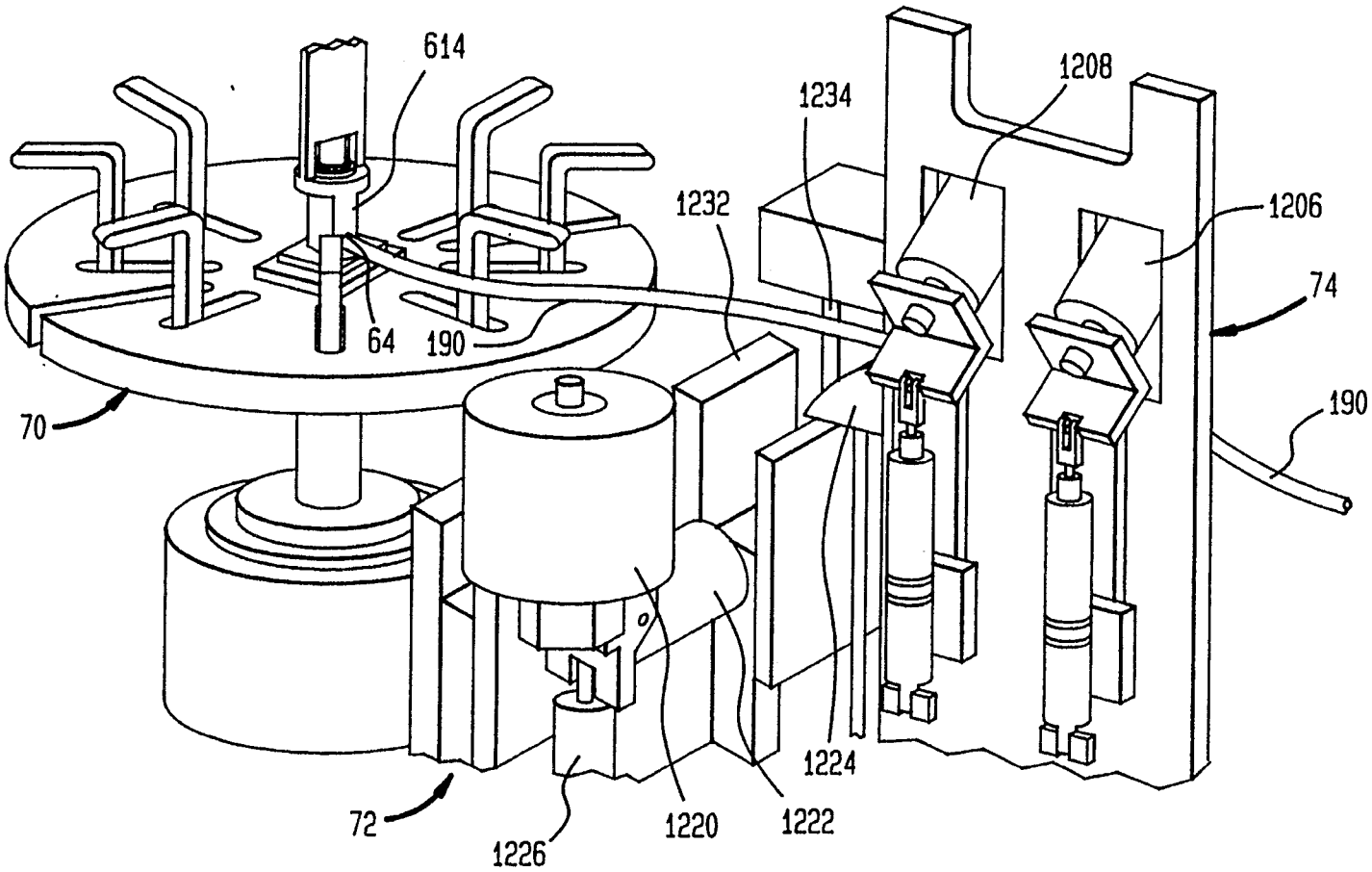
FIGS. 19*a*–19*c* illustrate cable reeling mechanism 70, cable positioning mechanism 72 and cable locating mechanism 74.
Figure 19B:
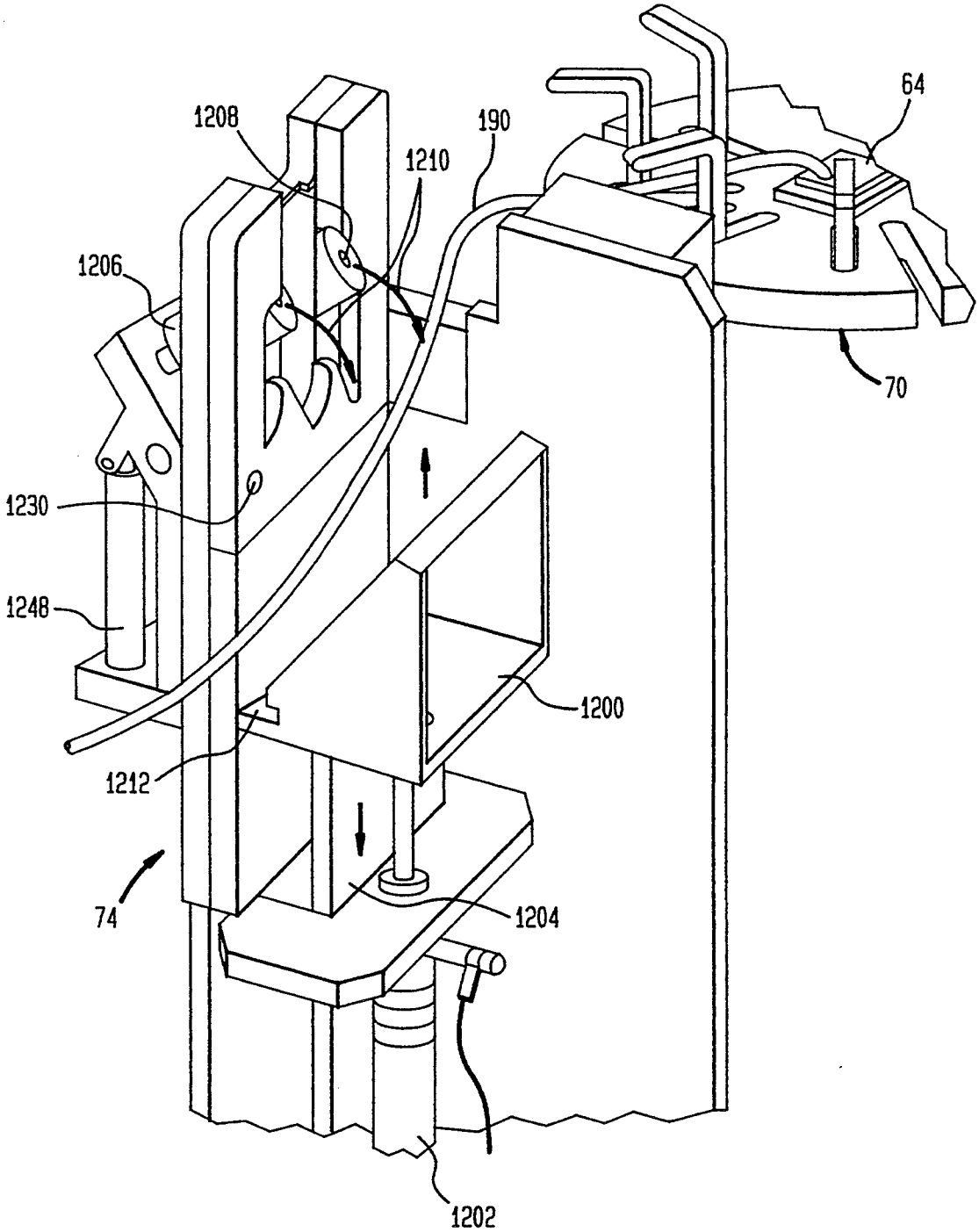

In reference to FIGS. 19*a, b* and *c*, as cable reeling mechanism 70 reels cable 190, the height of each coil on cable reeling mechanism 70 is controlled by cable locating mechanism 74. In reference to FIG. 2, when cable 190 is in the position of cable 122, cable 190 is draped across cable locating mechanism 74 so that cable locating mechanism 74 can capture the cable and control the height of the coils on cable mechanism 70.

Figure 19C:
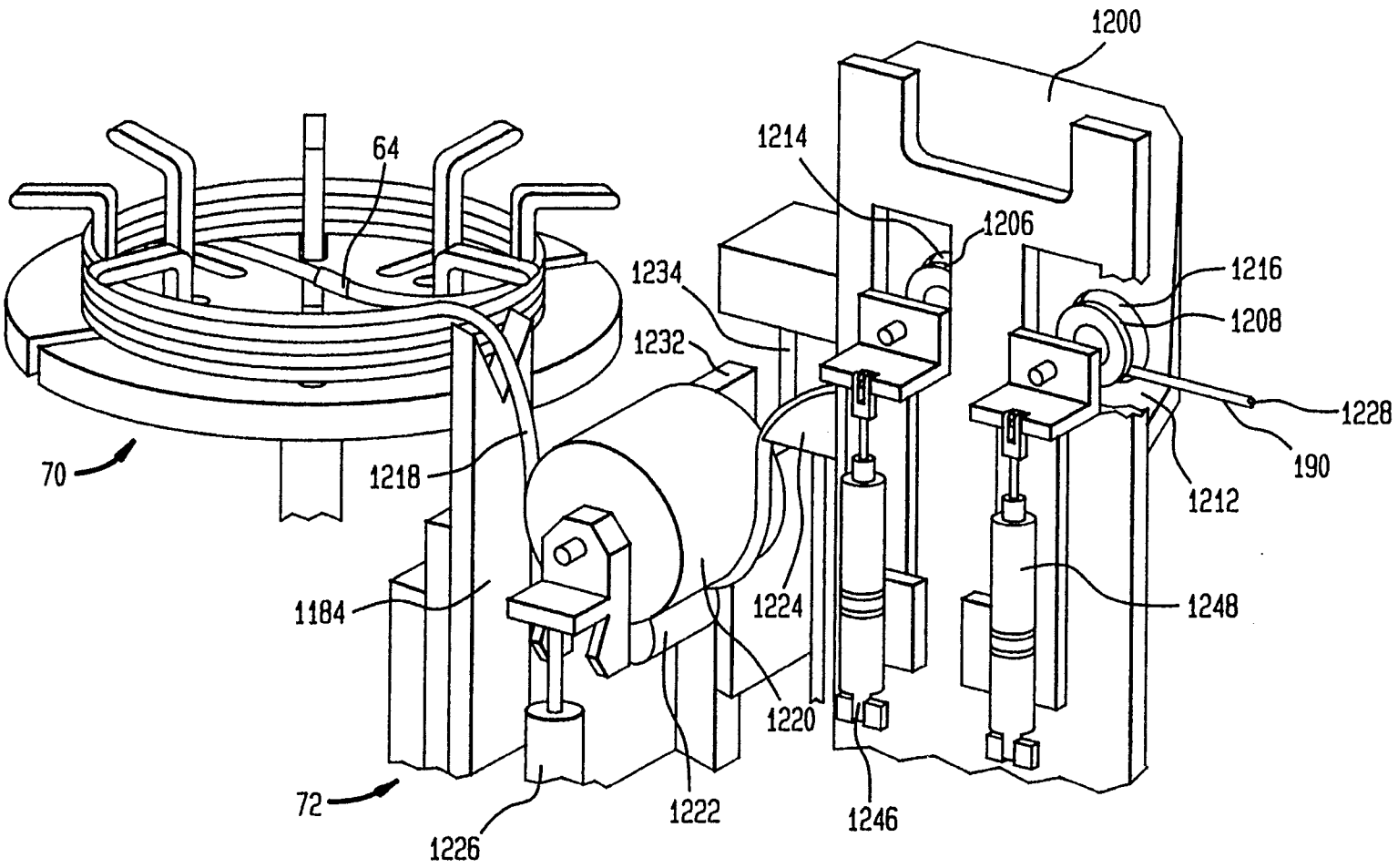

After connector 64 has been moved to the connector nest of cable reeling mechanism 70, cable positioning mechanism 74 captures the portion of the cable that is draped across the mechanism. Capture bracket 1200 is moved in a vertical direction by air cylinder 1202 and is supported by slide 1204. After capture bracket 1200 has reached its upper position to capture cable 190, rollers 1206 and 1208 are moved in the direction of arrows 1210. This results in cable 190 being captured in a channel consisting of rollers 1206 and 1208 on the top and surface 1212 of bracket 1200 on the bottom. With reference to FIG. 19*c*, openings 1214 and 1216 of capture bracket 1200 receive rollers 1206 and 1208, respectively. After being captured between rollers 1206 and 1208, and surface 1212, roller 1220 is rotated to a horizontal position and captures cable 190 between rollers 1220 and 1222. Roller 1220 is moved between a vertical and horizontal position by air cylinder 1226. Rollers 1220 and 1222 then move in an upward and downward direction to control the height of the coils of cable 190 and as cable reeling mechanism 70 rotates to wind cable 190 around its retractable fingers.

After cable 190 has been cut by cable pull mechanism 42 and when the remaining portion of cable 190 is less then the amount of cable that will be taken up by one revolution of cable reeling mechanism 70, cable reeling mechanism stops rotating and returns to a home position. The remaining portion of cable 190 is taken up by creating loop 1218 using roller 1220, 1222, cable guide 1224 and the extended guide 1184 of cable positioning mechanism 72. Rollers 1220 and 1222 then move in a downward direction to draw cable 190 over cable guide 1224 until cut cable end 1228 is detected by optical sensor 1230. It is also possible to use cable reeling mechanism 70 to take up the cable until end 1228 is detected by optical sensor 1230 or by another type of sensor that detects end 1228. After cable end 1228 is detected, rotating cable transport mechanism 80 grasps coiled cable 190 and moves the coiled cable to coiled cable holding mechanism 82.

Figure 20A:
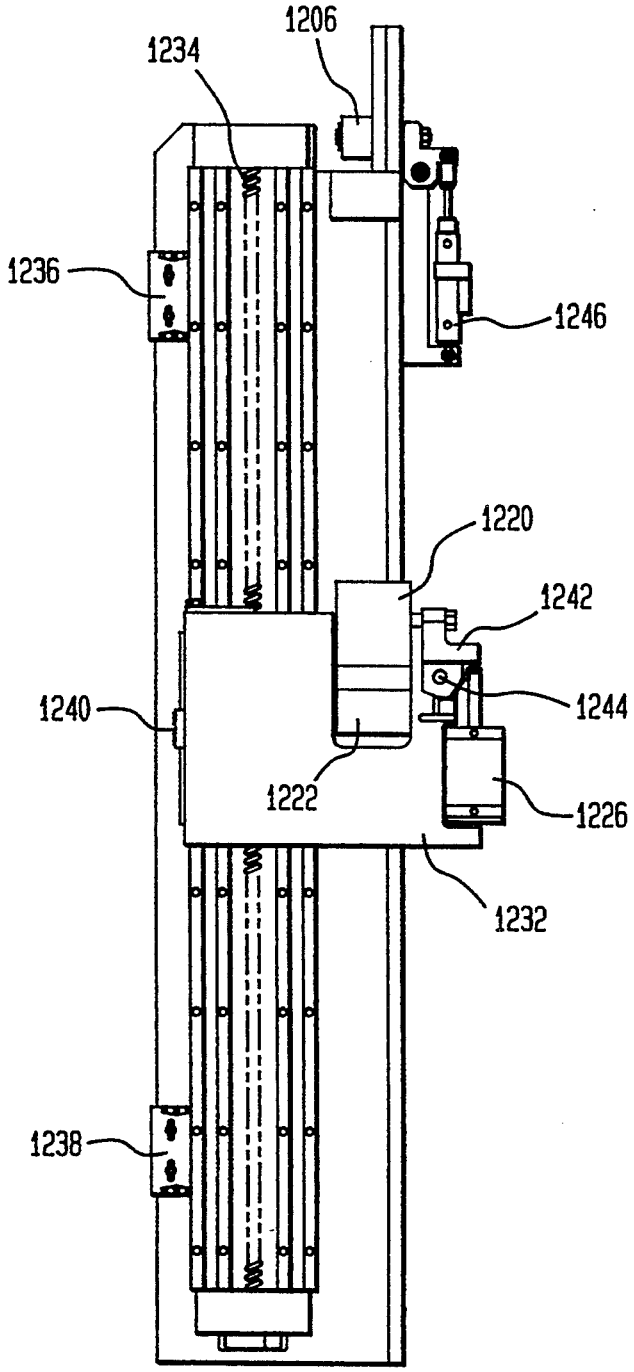
FIGS. 20*a* and *b* illustrate cable locating mechanism 74.

FIG. 20*a* and *b* illustrate portions of cable locating mechanism 74. FIG. 20*a* illustrates rollers 1220 and 1222 which are supported by base plate 1232. Base plate 1232 is mounted to lead screw 1234. Lead screw 1234 is rotated by an electric motor which is used to move base plate 1232 in a vertical direction. The position of base plate 1232 is monitored by the use of slotted optical switches 1236 and 1238. Optical switch 1236 detects when base plate 1232 is in a top most position and optical sensor 1238 detects when base plate 1232 is in a lower most position. The position of base plate 1232 is detected by the slotted optical switches sensing flag 1240.

Figure 20B:
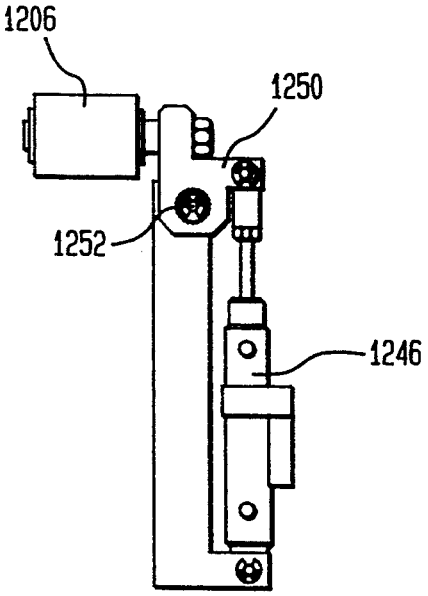
Figure 21:
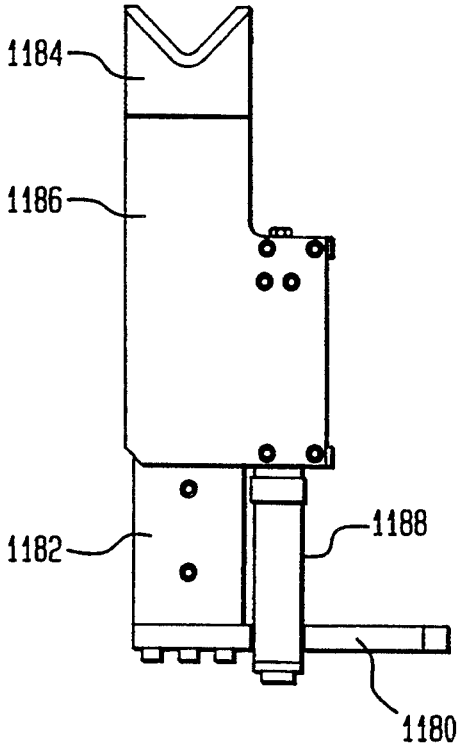
FIG. 21 illustrates cable positioning mechanism 72.
Figure 22B:
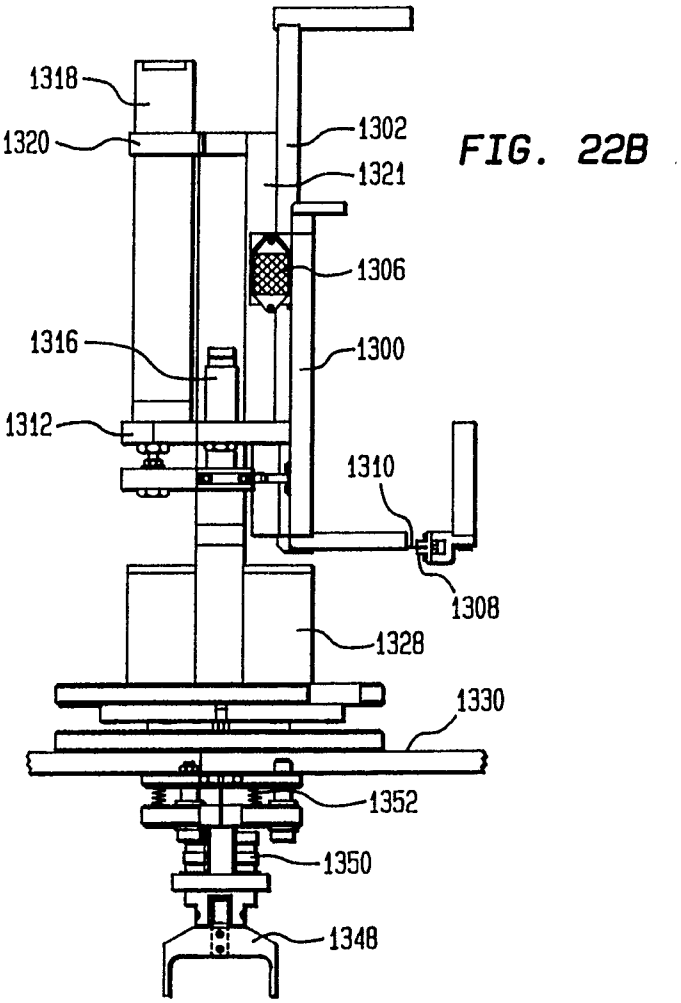
FIGS. 22a–22e illustrate rotating cable transport 80.
Figure 22A:
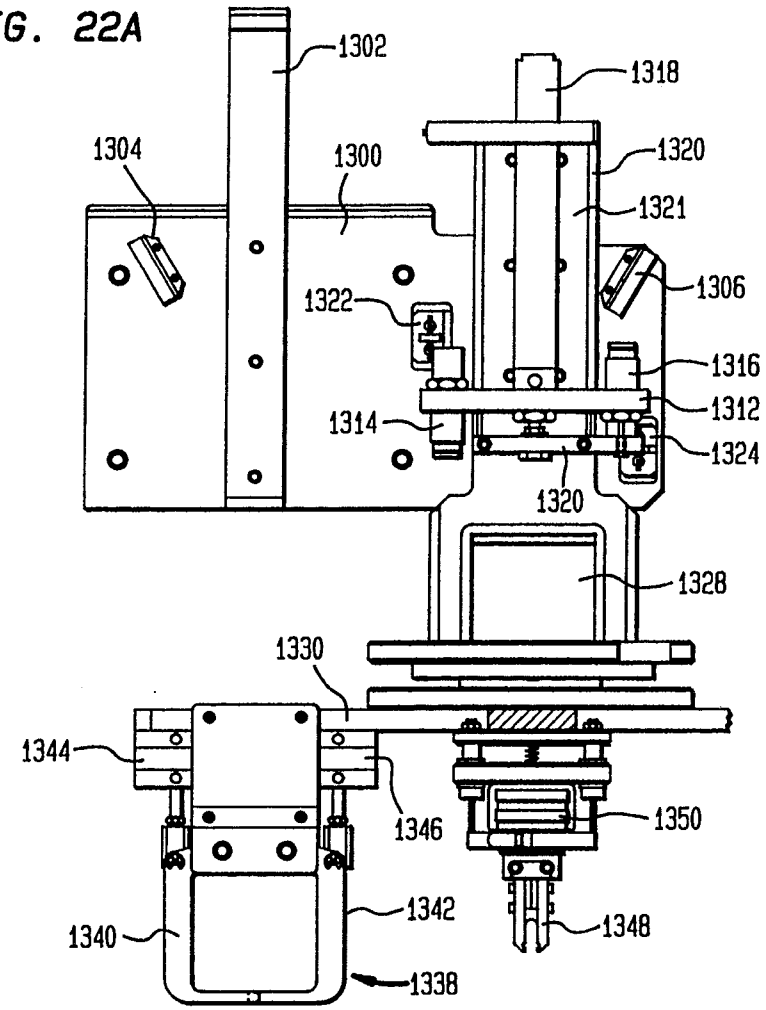
Figure 22C:
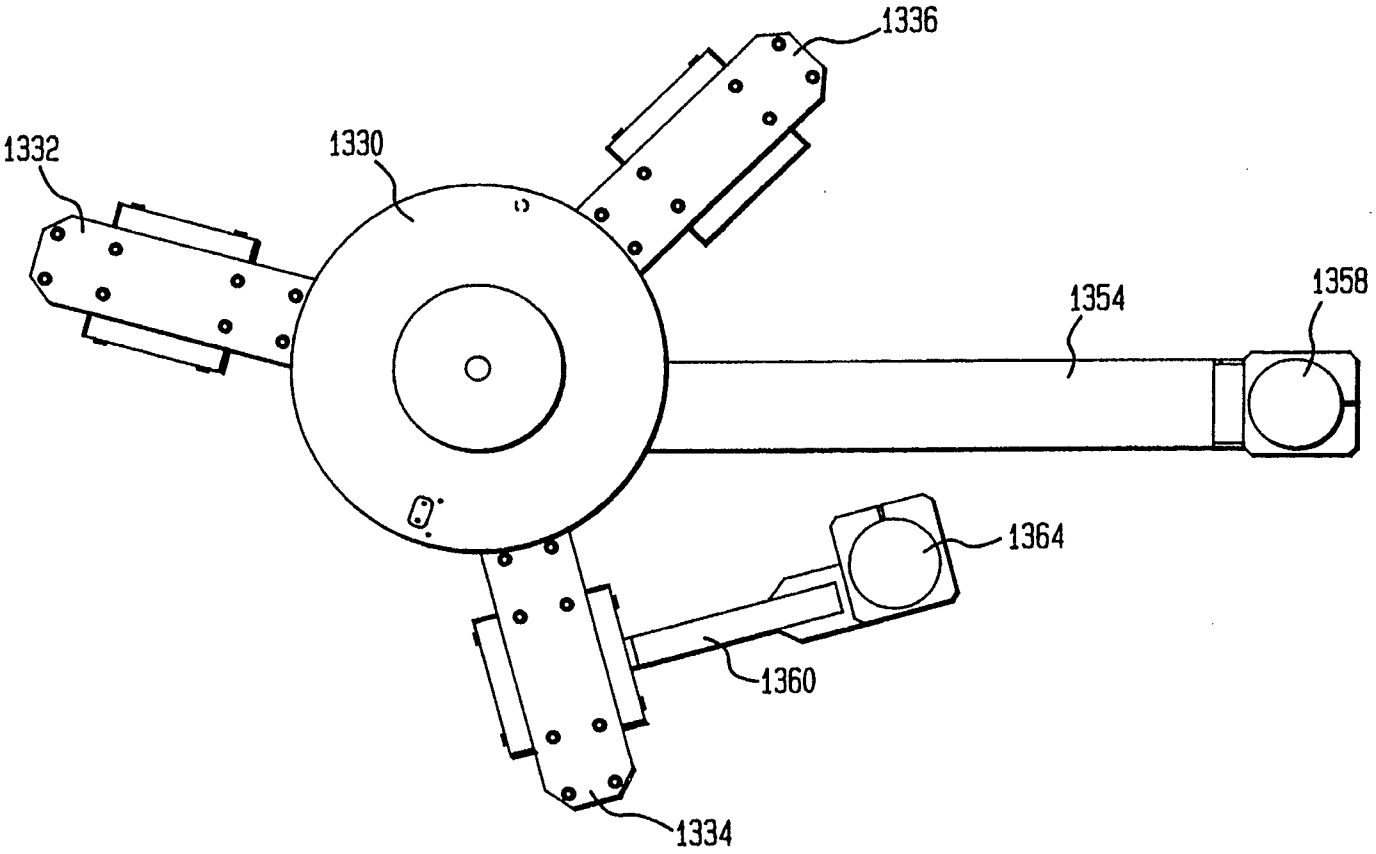
Figure 22D:
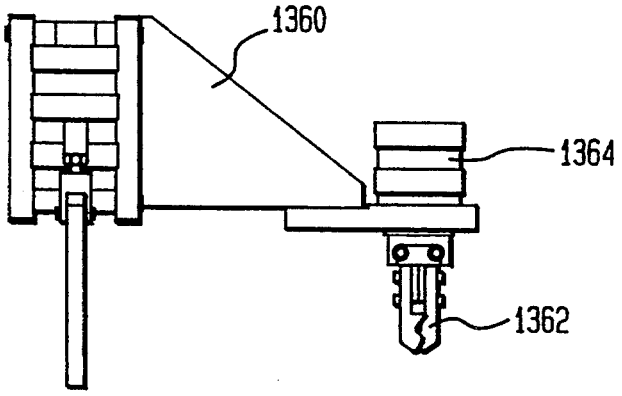
Figure 22E:
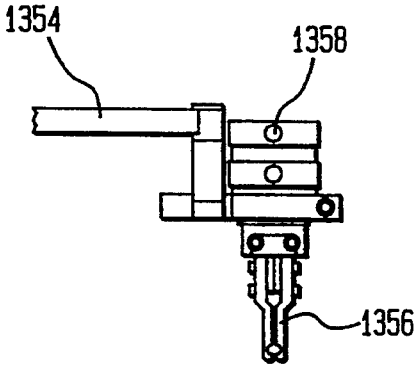

Roller 1220 is moved between a vertical and horizontal position by the action of air cylinder 1226. When the piston of air cylinder 1226 is extended, bracket 1242, which supports the axle of roller 1220, is rotated about point 1244 to place roller 1220 in a horizontal position. When the piston of air cylinder 1226 is retracted, bracket 1242 rotates around point 1244 to position roller 1220 in a vertical position. Rollers 1206 and 1208 are moved between an upward and horizontal position by the action of air cylinders 1246 and 1248, respectively. FIG. 20*b* only illustrates roller 1206; however, rollers 1206 and 1208 are moved in an identical manner. Roller 1206 is moved between a horizontal and a vertical position by the action of air cylinder 1246. When air cylinder 1246 extends its piston, bracket 1250 rotates about point 1252 to place roller 1206 in a horizontal position. When air cylinder 1246 retracts its piston, roller 1206 is placed in a vertical position. FIG. 21 illustrates cable positioning mechanism 72. Cable positioning mechanism 72 positions the portion of cable 190 that is grasped by cable clamp 1362 of rotating cable transport 80 and facilitates forming cable loop 1218. Cable positioning mechanism 72 is mounted on stand 1180 which supports a vertical brace 1182. V-shaped guide 1184 is attached to vertical brace 1182 by slide 1186 (not shown). Slide 1186 allows V-shaped guide 1184 to move upward and downward so that the "V" of v-shaped guide 1184 can capture cable 190 and hold it in position for cable clamp 1362. The vertical motion of V-shaped guide 1184 is controlled by air cylinder 1188.

In reference to FIGS. 22*a–e*, rotating cable transport mechanism 80 moves coiled cable 190 from cable reeling mechanism 70 to coiled cable holding mechanism 82. Rotating cable transport mechanism 80 moves coiled cable 190 by grasping connector 64, the coils of the cable and the unreeled portion of the cable. The unreeled portion of cable 190 extends over V-shaped support 1184 of cable positioning mechanism 72, and includes the loop added by cable locating mechanism 74 and the end portion of cable 190 located at the twin rollers of cable locating mechanism 74.

Rotating cable transport mechanism 80 is mounted to base plate 1300 which is attached to gantry 114. Base plate 1300 includes extension 1302 for routing electrical wires and air hoses to the rotating cable transport assembly. Support plate 1300 also includes reflectors 1304 and 1306 which are used to avoid collisions with cable transport mechanism 54 and coiled cable transport mechanism 92 respectively. Collisions are avoided when retro-reflective scanners located on cable transport 54 or coiled cable transport 92 detect a reflection by reflectors 1304 or 1306. The home position for rotating cable transport mechanism 80 is located through the use of slotted optical switch 1308 which is mounted on gantry 114 and interacts with flag 1310 which is mounted to base plate 1300. Mounted to base plate 1300 is frame 1312 which supports shock absorbers 1314 and 1316. Also mounted to frame 1312 is air cylinder 1318. By retracting or extending the piston of air cylinder 1318, frame 1320 is moved in a vertical direction. Frame 1320 is supported by slide 1321. The downward and upward motions of frame 1320 are cushioned by shock absorbers 1314 and 1316, respectively. In addition, optical switches 1322 and 1324 are used to detect when frame 1320 is in a lower and upper position, respectively.

Mounted to frame 1320 is motor 1328 which rotates support plate structure 1330. Attached to support plate 1330 are cable coil pickup arms 1332, 1334, and 1336. Each of the coil pickup arms include a coil pickup clamp 1338 which includes an outer clamp portion 1340 and an inner clamp portion 1342. Each coil pickup arm also includes outer air cylinder 1344 and inner air cylinder 1346. When the pistons of air cylinders 1344 and 1346 are extended, clamp portions 1340 and 1342 come together to grasp a coiled section of cable 190, and when the pistons of air cylinders 1344 and 1346 are retracted, the clamp portions 1340 and 1342 are separated to release the coiled section of cable 190.

Also attached to support plate 1330 is connector clamp 1348 which is used to grasp connector 64 from the connector nest of cable reeling mechanism 70. Connector clamp 1348 is open and closed through the action of air cylinder 1350. Air cylinder 1350 and connector clamp 1348 are spring mounted using springs 1352 to prevent clamp 1348 from crushing connector 64 if clamp 1348 and connector 64 are misaligned when air cylinder 1318 lowers support plate 1330 and clamp 1348. Also attached to support plate 1330 is arm 1354. Arm 1354 includes cable clamp 1356 at the far end. Cable clamp 1356 is operated by air cylinder 1358. Cable clamp 1356 is used to grasp the end portion of cable 190 that is positioned between the twin rollers of cable positioning mechanism 74. Cable coil arm 1334 includes extension 1360 that has mounted to its far end cable pickup clamp 1362. Cable clamp 1362 is operated by air cylinder 1364. Cable clamp 1362 is used to pick up the portion of cable 190 that is supported by V-shaped bracket 1184 of cable positioning mechanism 72.

After cable reeling mechanism 70 has stopped rotating, and the end of cable 190 has been located by cable locating mechanism 74, rotating cable transport mechanism 80 transports coiled cable 190 to coiled cable holding mechanism 82. This process begins by coiled cable transport mechanism 80 moving along gantry 114 to position itself over cable reeling mechanism 70. Once positioned over cable reeling mechanism 70, air cylinder 1380 extends its piston to lower support plate 1330 and its associated clamps over coiled cable 190. Cable coil clamps 1342, connector clamp 1348, and cable clamps 1362 and 1356 are open at this time. Connector clamp 1348 is positioned to grasp connector 64 in connector nest 1108. Cable clamp 1356 is positioned between the twin rollers of cable locating mechanism 74 to grasp the end of cable 190, and cable clamp 1362 is positioned to grasp cable 190 at V-shaped guide 1184 of cable positioning mechanism 72. Cable clamps 1356 and 1362 are used to maintain control over the end of cable 190 and to maintain the loop that was added to cable 190 by the large roller of cable locating mechanism 74. Cable coil clamps 1342 extend around the coiled section of cable 190 by extending into slots 1101 of cable reeling mechanism 70. By extending into these slots, clamps 1342 can get beneath the coiled section of cable 190 so that when the clamps are closed they can encircle the entire coiled section without missing one of the cable's coils or damaging the cable.

After the clamps have been lowered onto coiled cable 190, the coiled sections of the cable, connector 64 and the ends of cable 190 are grasped by closing clamps 1338, 1348, 1356 and 1362. The coiled sections of the cable, connector 64 and Fingers 1114 and 1118 of cable reeling mechanism 70 are then retracted and rollers 1206, 1208 and 1220 are moved to a vertical position to allow coiled cable 190 to be lifted by rotating cable transport mechanism 80. After lifting coiled cable 190 by retracting the piston of air cylinder 1318, motor 1328 activates to rotate coiled cable 190 into a position that will align the unreeled end of cable 190 with cable feed and clamp mechanism 84. After rotating, coiled cable transport mechanism 80 moves along gantry 114 so that cable 190 is aligned above coiled cable holding mechanism 82. At this point, air cylinder 1318 extends its piston to lower coiled cable 190 onto coiled cable holding mechanism 82.

Figure 23A:
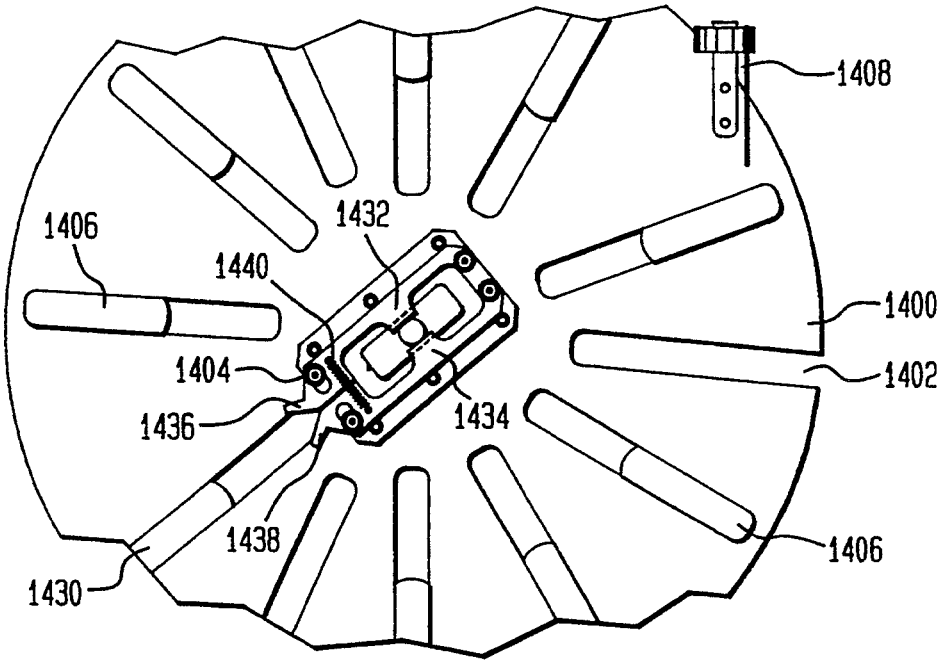
FIGS. 23a and b illustrate coiled cable holding mechanism 82.
Figure 23B:
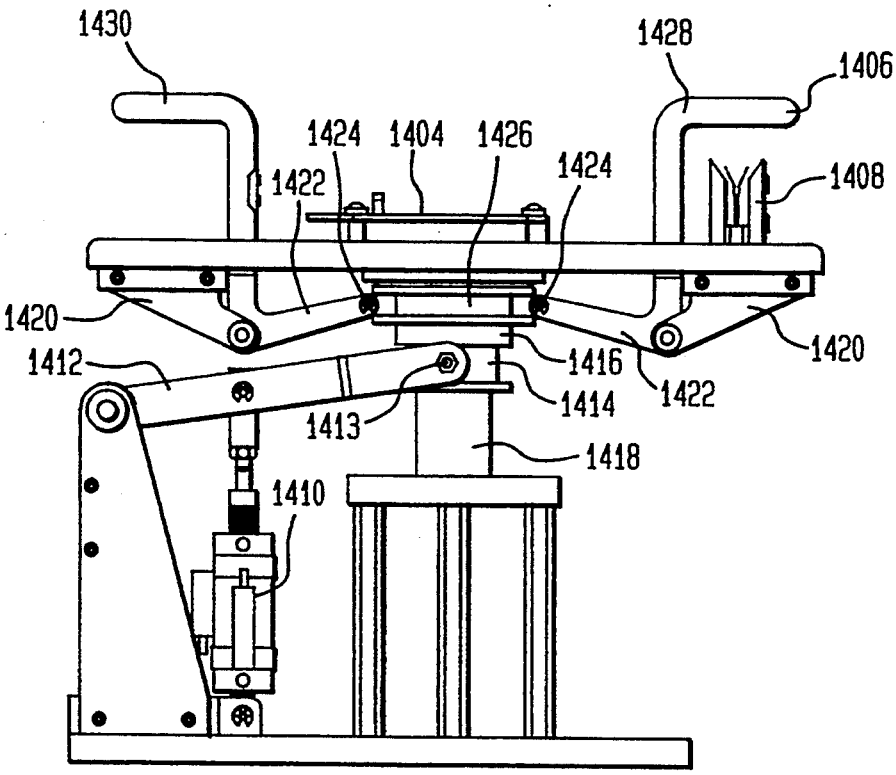

FIGS. 23*a* and *b* illustrate coiled cable holding mechanism 82. Coiled cable holding mechanism 82 is similar to cable reeling mechanism 70 in the way that it maintains the coiled configuration of cable 190; however, this mechanism does not rotate. Coiled cable holding mechanism 82 comprises table 1400 with slots 1402 which receive cable coil clamps 1338 when rotating cable transport 80 lowers coiled cable 190 onto coiled cable holding device 82. Connector nest 1404 receives connector 64 from connector clamp 1348 of rotating cable transport 80. Fingers 1406 are retracted to accept the coiled cable 190, and clip 1408 accepts the portion of cable 190 held by cable clamp 1362. The end of cable 190 held by cable 1356 is received by cable feed and clamp mechanism 84.

Fingers 1406 are retracted by retracting the piston of air cylinder 1410. Air cylinder 1410 lowers forked-shaped arm 1412. Forked-shaped arm 1412 is similar to forked-shaped arm 1132 of FIG. 18*c*. Rollers 1413 of arm 1412 ride in channel 1414 of sheave 1416. When air cylinder 1410 retracts its piston, arm 1412 moves sheave 1416 downward on shaft 1418 and when piston 1410 extends sheave 1416 is moved upward on shaft 1418. Fingers 1406 are pivotally supported by brackets 1420. Fingers 1406 also include extensions 1422 that include rollers 1424 that ride in channel 1426 of sheave 1416. When sheave 1416 is lowered, the upper portions 1428 of fingers 1406 are retracted toward the center of table 1440. By retracting the fingers, coiled cable 190 can be lowered over the fingers. After cable 190 is lowered over the fingers, sheave 1416 is raised so that finger portions 1428 extend outward and grasp the coils of cable 190.

Finger 1430 is used to separate left half connector clamp 1432 and right half connector clamp 1434. When finger 1430 is retracted toward the center of cable 1400, finger 1430 interacts with the connector clamp ends 1436 and 1438 to separate clamps 1432 and 1434 so that connector 64 can be received by connector nest 1404. After cable 190 has been lowered onto table 1400, and when finger 1430 is extended toward the outer portion of table 1400, spring 1440 acts to pull clamp ends 1436 and 1438 together so that clamps 1432 and 1434 grasp connector 64.

Figure 24A:
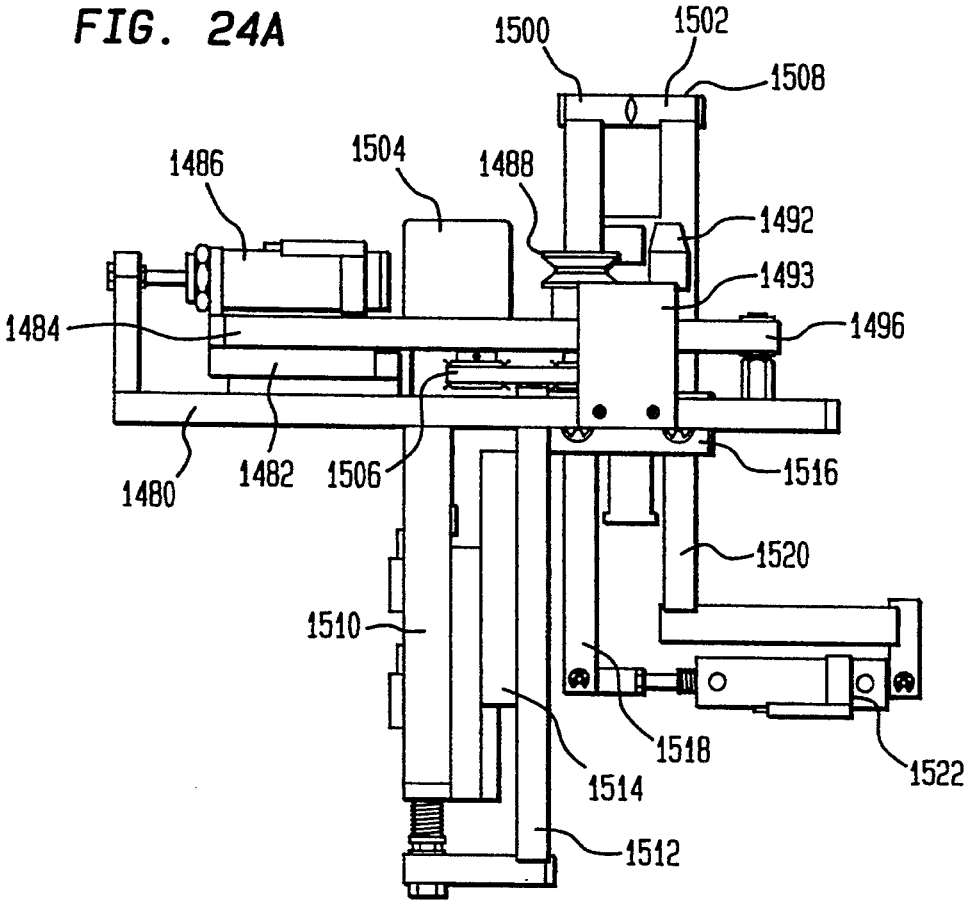
FIGS. 24a and b illustrate cable feed and clamp mechanism 84.
Figure 24B:
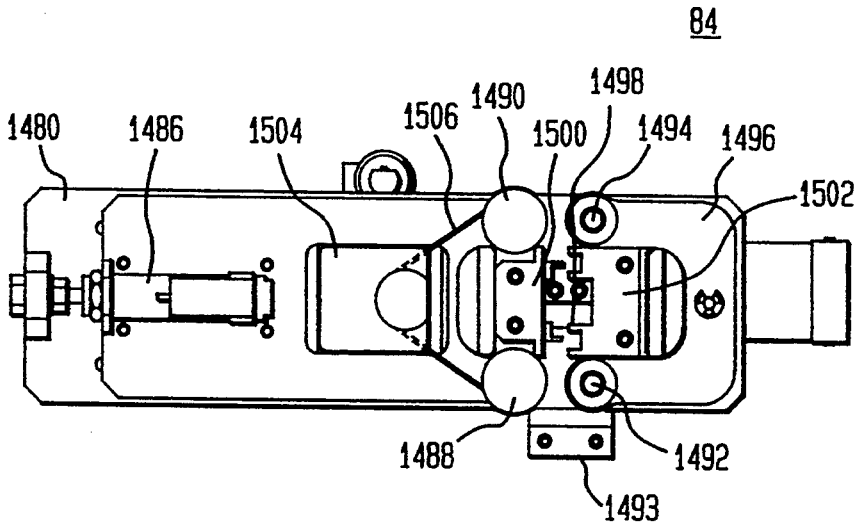

As mentioned earlier, the end of cable 190 is held by cable clamp 1356 of rotating cable transport 80 while coiled cable 190 is moved between cable reeling mechanism 70 and coiled cable holding mechanism 82. The end of cable 190 held by clamp 1356 is captured by cable feed and clamp mechanism 84 which feeds the end of cable 190 into desheath and comb station 86. FIGS. 24*a* and *b* illustrate cable feed and clamp mechanism 84. Cable feed and clamp mechanism 84 is similar to cable guide and clamp mechanism 44 of FIG. 7. Cable feed and clamp mechanism 54 includes support plate 1480. Support plate 1480 holds slide 1482 that supports sliding plate 1484. Sliding plate 1484 is moved to the left or right by the action of air cylinder 1486. Sliding plate 1484 includes powered rollers 1488 and 1490. Opposite power rollers 1480 and 1490 are unpowered rolers 1492 and 1494 which are supported by stationary bracket 1496.

Cable clamp 1356 of rotating cable transport 80 places the end of cable 190 into cable feed and clamp mechanism 84 by lowering clamp 1356 into space 1498. When lowered into space 1498, clamp 1356 of rotating cable transport mechanism 80 positions the end of cable 190 between rollers 1488 and 1490, and opposing rollers 1492 and 1494. Cable 190 is also positioned between left cable clamp section 1500 and right cable section clamp 1502. In addition, the cable is supported by the top surface of cable support 1493. Once the end of cable 190 is positioned between the rollers, air cylinder 1486 extends its piston to capture the cable between the opposing sets of rollers. At this point, clamp 1356 releases the end of cable 190 and then the clamp moves upward as rotating cable transport mechanism 80 retracts the piston of its air cylinder. After the end of cable 190 is captured between the rollers, motor 1504 is activated to drive belt 1506 so that rollers 1490 and 1488 rotate to feed the end of cable 190 into desheath and comb station 86. When an optical sensor in desheath and comb station 86 detects the end of cable 190, motor 1504 stops. At this point cable clamp 1508, which comprises cable left clamp section 1500 and right cable clamp section 1502, is in a lower position. When clamp 1508 is in a lower position, the opening between cable clamp sections 1500 and 1502 is co-linear with the path along which rollers 1488 and 1490 feed cable 190. After motor 1504 stops, cable clamp sections 1500 and 1502 grasp cable 190. At this point, air cylinder 1486 retracts its piston to disengage rollers 1488 and 1490 from cable 190.

Cable clamp 1508 is moved between a lower and upper position by the action of air cylinder 1510. When in an extend position, air cylinder 1510 aligns clamp 1508 so that cable 190 is positioned within the desheathing section of desheath and comb station 86. When cylinder 1510 retracts the piston, cable clamp 1508 is moved to an upper position so that the desheathed end of cable 190 is placed in the comb section of desheath and comb station 86. Clamp 1508 is moved upward and downward by moving frame 1512 which is mounted to slide 1514. When frame 1512 is moved upward or downward, block 1516 is also moved upward and downward. Vertical clamp members 1518 and 1520 which support left clamp section 1500 and right clamp section 1502, respectively, are pivotally mounted to block 1516 and, therefore, move clamp 1508 in a vertical direction with frame 1512.

Clamp 1508 is opened and closed by the action of air cylinder 1522. When air cylinder 1522 retracts its piston, the lower portion of vertical clamp members 1518 and 1520 are drawn together and pivot about their mounting points on block 1516 so that left clamp section 1500 and right clamp half section 1502 separate. When air cylinder 1522 extends its piston, vertical clamp 15 18 and vertical clamp 1520 pivot so that left clamp 1500 and right clamp half 1502 grasp cable 190.

Desheath and comb station 86 desheaths the end of cable 190 and combs the conductors exposed by the desheathing operation in a fashion identical to desheath and comb station 50. Desheath and comb station 86 is identical to desheath and comb station 50. After the desheathing and combing operation is complete, coiled cable transport 92 moves coiled cable 190, with the desheathed and combed end, to identify and station 96. At identify and connectorization station 96, connector 98 is attached to the desheathed and combed end of cable 190.

Figure 25A:
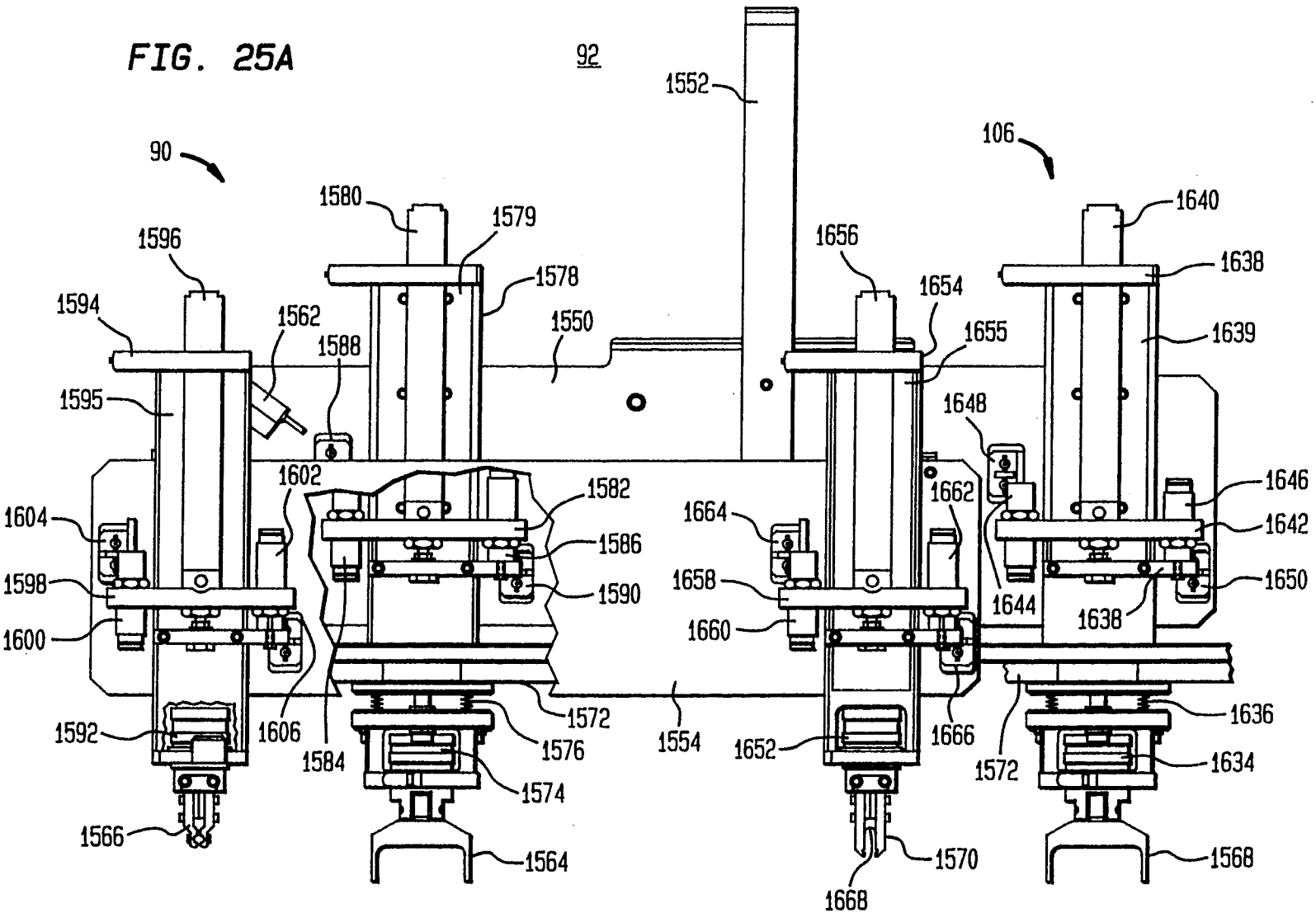
FIGS. 25a–25d illustrate coiled cable transport mechanism 92.
Figure 25B:
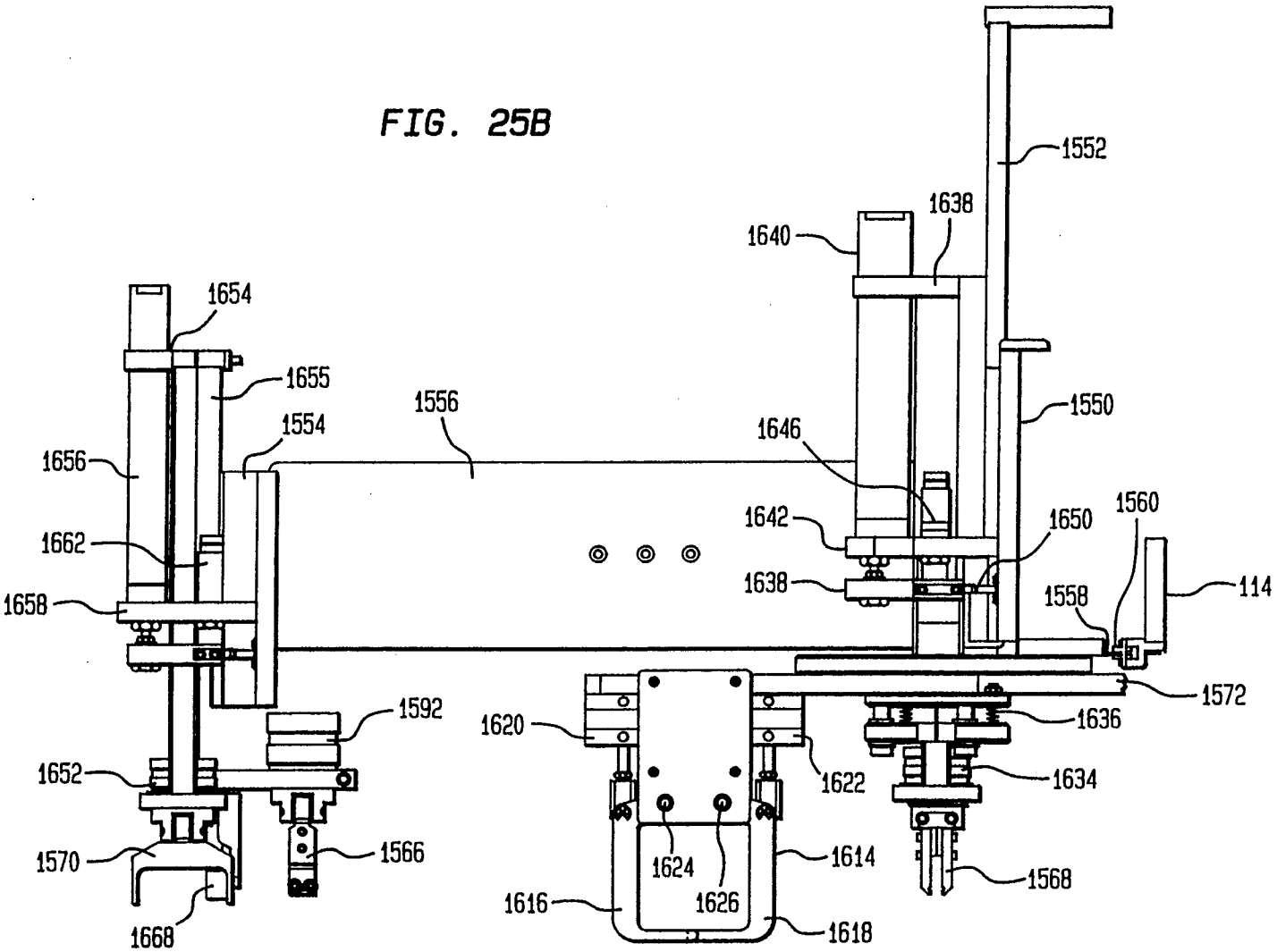

FIG. 25*a, b* and *c* illustrate coiled cable transport mechanism 92. Coiled cable transport mechanism 92 comprises left transport mechanism 90 and right transport mechanism 106. Left transport mechanism 90 is used to transport coiled cable 109 from desheath and comb station 86 to identify and connectorization station 96. Right cable transport 106 is used to transport cable 190 from identify and connectorization station 96 to cable slack take up mechanism 104, and from cable slack take up mechanism 104 to conveyor 112.

Cable transport mechanism 92 comprises base plate 1550 which is mounted to gantry 114. Attached to base plate 1550 is vertical support 1552 which is used to guide wires and air hoses from the gantry to cable transport mechanism 92. Parallel support plate 1554 is supported by extension plate 1556 which is perpendicular to plates 1550 and 1554. The location of cable transport 92 is determined by detecting when flag 1558 enters the slot of slotted optical switch 1560. In addition, retro-reflective device 1562 is used to avoid collisions with rotating coiled cable transport mechanism 80. When retro-reflective device 1562 detects a reflection from a reflector mounted on rotating cable transport 80, an error is detected and motion stops to avoid a collision.

Left cable transport 90 includes connector clamp 1564 and cable clamp 1566. Right cable transport 106 includes connector clamp 1568 and connector clamp 1570. Cable transports 90 and 106 each include coiled cable pickup table 1572 and its associated pickups.

Cable clamp 1564 is opened and closed by the action of air cylinder 1574. Cable clamp 1564 and air cylinder 1574 are spring mounted to the center bottom of table 1572 by springs 1576. The spring mounting prevents cable clamp 1564 from crushing connector 64 in the event of a misalignment. Table 1572 of cable transport 90 is mounted to sliding frame 1578 which is moved up and down by the action of the piston of cylinder 1580. Frame 1578 is mounted to slide 1579. Cylinder 1580 is mounted to cross frame 1582 which is mounted to base plate 1550. Cross frame 1582 also includes shock absorbers 1584 and 1586 to cushion the end motions of frame 1578. The lower most and upper most positions of frame 1578 are detected using slotted optical switches 1588 and 1590 respectively. Cable clamp 1566 is also associated with left cable transport 90. Cable clamp 1566 and its associated supports are mounted to parallel support plate 1554. Cable clamp 1566 is actuated by air cylinder 1592. Clamp 1566 and air cylinder 1592 are mounted to sliding frame 1594 which is moved upward and downward by the piston of air cylinder 1596. Frame 1594 is mounted to slide 1595. Air cylinder 1596 is mounted to cross frame 1598 which is mounted to parallel support plate 1554. Also mounted to cross frame 1598 are shock absorbers 1600 and 1602 which soften the end of the travel of frame 1594 when moving in a downward and upward direction, respectively. Slotted optical switches 1604 and 1606 detect when frame 1594 is in a lower or upper position, respectively.

Coiled cable pickup table 1572 of left cable transport 90 is identical to table 1572 of right cable transport 106.

Table 1572 includes cable coil pickup arms 1608, 1610 and 1612. Each of these arms include cable coil pickup clamp 1614 which comprise left clamp 1616 and right clamp 1618. Left clamp 1616 is operated by air cylinder 1620 and right clamp 1618 is operated by air cylinder 1622. Clamp 1616 rotates about pin 1624 and clamp 1618 rotates about pin 1626. When air cylinders 1620 and 1622 extend their pistons, clamps 1616 and 1628 close around a coiled section of cable, and when air cylinders 1620 and 1622 retract their pistons, clamps 1616 and 1618 open. In addition, arm 1610 includes extension 1628 which, at its far end, includes cable clamp 1630 and air cylinder 1632. Air cylinder 1632 opens and closes clamp 1630.

When moving coiled cable 190 from coiled cable holding mechanism 82 and desheath and comb station 86, to coiled cable holding mechanism 88 and identify and terminate station 96, cable transport 90 lowers its connector clamp and cable clamps by the action of air cylinders 1580 and 1596. Air cylinder 1580 lowers connector clamp 1564 and the cable coil clamps attached to table 1572. Air cylinder 1596 extends to lower cable clamp 1566. Connector clamp 1564 removes connector 64 from the connector nest of coiled cable holding mechanism 82. The cable coil clamps grasp the coiled section of the cable and cable clamp 1566 grasps the desheathed and combed end of cable 190 from cable clamp 1508 of cable feed and clamp mechanism 84. It should also be noted that cable clamp 1630 grasps cable 190 at clip 1408 of coiled cable holding mechanism 82. After all the clamps are closed, the fingers of coiled cable holding mechanism 82 are retracted and clamp 1508 is opened so that coiled cable 190 can be lifted when air cylinders 1596 and 1580 retract their pistons. After retraction, coiled cable transport mechanism 92 travels along gantry 114 to align cable transport 90 over coiled cable holding mechanism 88. Air cylinders 1596 and 1580 then lower the coiled cable so it can be grasped by coiled cable holding mechanism 88 and the cable clamp of identify and connectorization station 96.

Figure 25C:
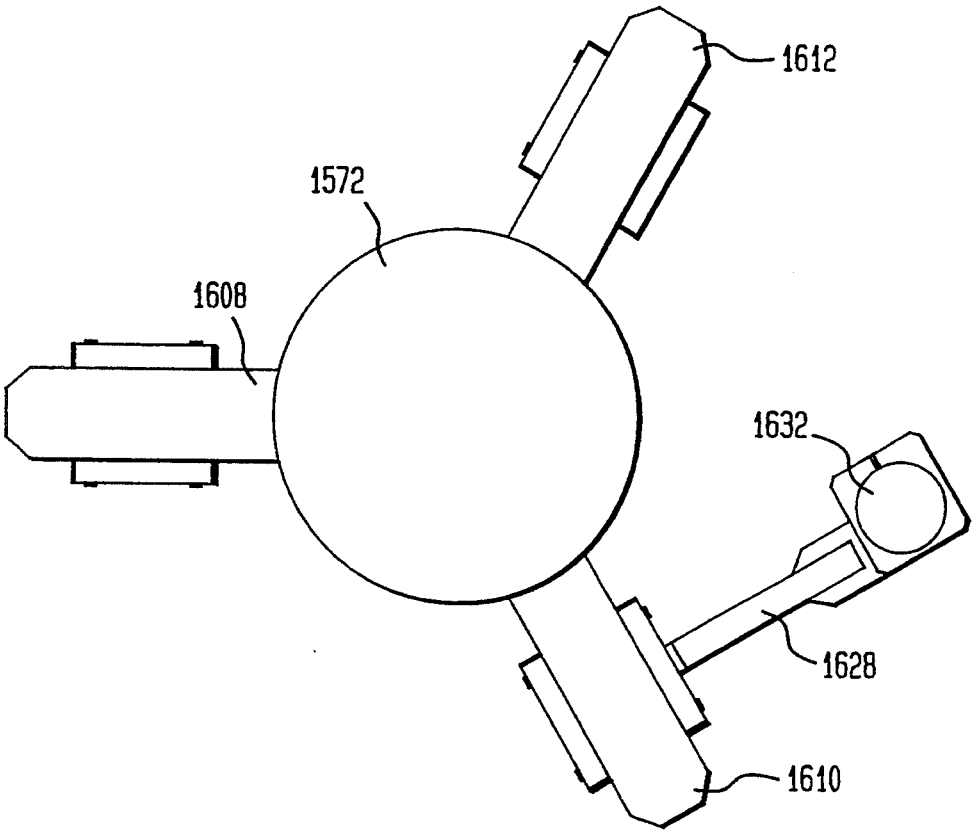
Figure 25D:
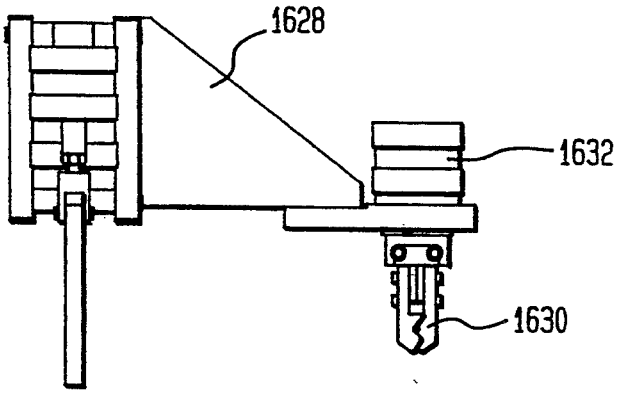

Right cable transport 106 is used to move coiled cable 190 from coiled cable holding device 88, and identify and connectorization station 96, to cable slack take up mechanism 104. Right cable transport mechanism 106 includes connector clamp 1568 which is operated by air cylinder 1634. Air cylinder 1634 and connector clamp 1568 are mounted to table 1572 by springs 1636. The spring mounting prevents connector clamp 1568 from crushing connector 64 in the event of a misalignment. Table 1572 of cable transport 106 is identical to table 1572 of cable transport 90 as shown in FIG. 25*c*. Table 1572 of cable transport 106 is mounted to sliding frame 1638 which is supported by slide 1639. Sliding frame 1638 is moved upward and downward by the action of the piston of air cylinder 1640. Air cylinder 1640 is mounted to cross frame 1642. Cross frame 1642 includes shock absorbers 1644 and 1646 which cushion the impact of frame 1638 at its lower most and upper most points of travel, respectively. Frame 1642 is mounted to plate 1550. Slotted optical switches 1648 and 1650 detect the lower most and upper most points of travel of frame 1638, respectively. Right cable transport 106 also includes connector clamp 1570. Connector clamp 1570 is supported by parallel support plate 1554. Connector clamp 1570 is operated by air cylinder 1652 which is mounted to sliding frame 1654. Sliding frame 1654 is supported by slide 1655. Sliding frame 1654 is moved upward and downward by the piston of air cylinder 1656. Air cylinder 1656 is mounted to cross frame member 1658 which is mounted to parallel support plate 1554. Cross frame 1658 includes shock absorbers 1660 and 1662 which cushion the travel of frame 1654 at its lower most and upper most points of travel respectively. Slotted optical switches 1664 and 1666 detect the lower most and upper most points of travel of frames 1664, respectively.

When moving coiled cable 190 from coiled cable holding device 88 and identify and connectorization station 96, cable transport 106 lowers its clamps by extending the pistons of cylinders 1640 and 1656. Cylinder 1640 lowers cable clamp 1568 which grasps connector 64 from the connector nest of cable holding mechanism 88. The cable coil clamps mounted to table 1572 of cable transport 106 are also lowered to grasp the coiled sections of cable 190. Cable clamp 1630 of table 1572 grasps the portion of cable 190 that is held by the cable clip of cable holding mechanism 88. In addition, connector clamp 1570 is lowered by air cylinder 1656 to grasp connector 98 from identify and connectorization station 96. After the clamps have closed, the fingers of cable holding mechanism 88 retract and the cable clamp of identify and connectorization station 96 open, to allow coiled cable 190, which includes connectors 64 and 98, to be lifted by the action of cylinder 1656 and 1640.

It should be noted that cable clamp 1570 operates in a fashion similar to connector clamp 614 of cable transport mechanism 54. Clamp 1570 includes tab 1668 which is used to hold the end of cable 190 in position while the strain relief clamps of connector 98 are closed around the end of cable 190.

Returning to coiled cable holding mechanism 82, after cable 190 has been desheathed and combed by desheathing and combing station 86, left cable transport 90 of coiled cable transport 92 moves coiled cable 190 to coiled cable holding mechanism 88.

Figure 26A:
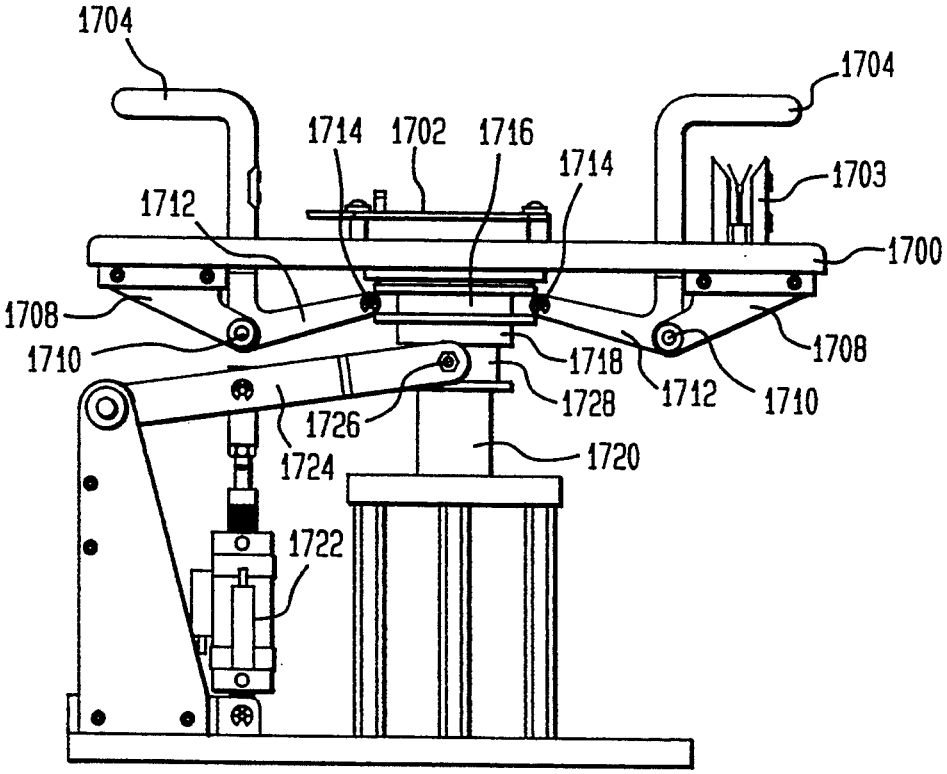
FIGS. 26a and b illustrate coiled cable holding mechanism 88.
Figure 26B:
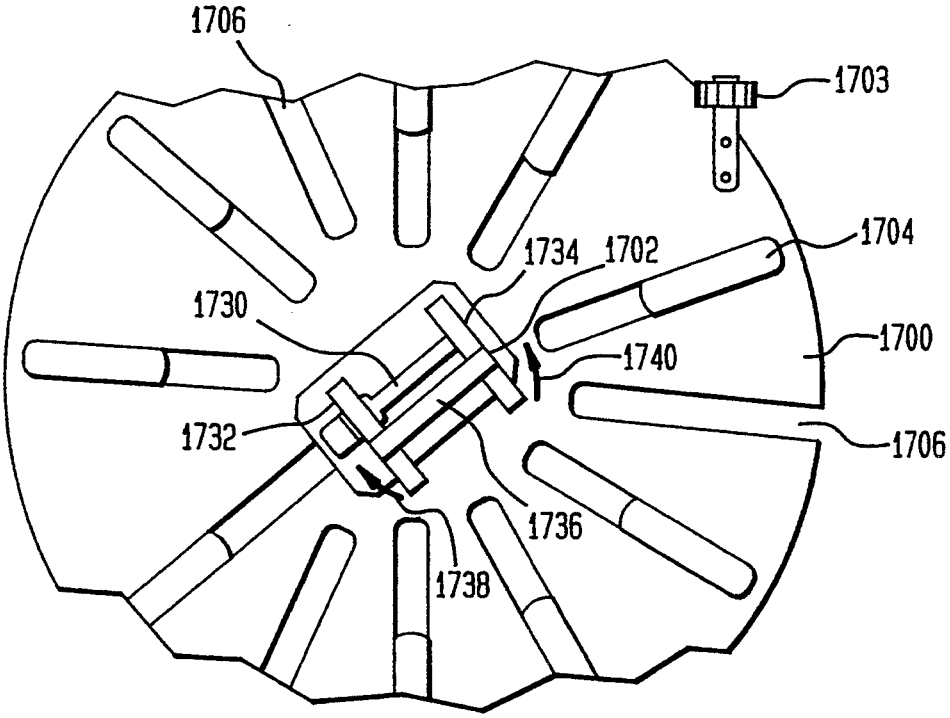

FIGS. 26*a* and *b* illustrate coiled cable holding mechanism 88.

Coiled cable holding mechanism 88 is similar to coiled cable holding mechanism 82 of FIGS. 23*a* and *b*. Coiled cable holding mechanism 88 includes table 1700 with centrally located connector nest 1702 and cable clip 1703 which receives the portion of cable 190 held by clamp 1630. Cable clip 1703 is used to secure the portion of cable 190 as it extends toward identify and connectorization station 96. Fingers 1704 are used to hold the coils of coiled cable 190 and slots 1706 receive cable coil clamps 1614 of coiled cable transport mechanism 92. As discussed earlier, these spaces allow clamps 614 to encircle the entire coiled portion of cable 190 by insuring that clamp 614 gets below the lower coils of cable 190 by permitting clamp 614 to get below the level of table 1700. Fingers 1704 are pivotally mounted to brackets 1708 and pivot around pin 1710. Portions 1712 of finger 1704 have rollers 1714 at the end of section 1712. Rollers 1714 ride in slot 1716 of sheave 1718. Sheave 1718 can move vertically on shaft 1720. When sheave 1718 is in an upward position, fingers 1704 are extended and when sheave 1718 is in a lowered position on shaft 1720 fingers 1704 are retracted. Sheave 1718 is moved upward and downward on shaft 1720 by the action of air cylinder 1722. Air cylinder 1722 moves forked-am 1724 upward and downward. Ann 1724 is similar to arm 1132 of FIG. 18*c*. Rollers 1726 at the end of forked-arm 1724 ride in slot 1728 of sheave 1718 and thereby move sheave 1718 upward and downward when arm 1724 is moved upward and downward by air cylinder 1722.

Connector nest 1702 includes central portion 1730. Central portion 1730 includes a connector that mates with connector 64 of coiled cable 190. The connector that mates with connector 64 provides an electrical circuit to each contact of connector 64 so that the conductors of cable 190 can be identified at identify and connectorization station 96. The conductors are identified using the same process that identified conductors at identify and connectorization station 60. Identify and connectorization station 96 sends a current through each conductor of cable 190 using identifier 716. The current is used to identify each conductor so that the conductor can be attached to the proper contact of connector 98. The mating connector at central location 1730 of connector nest 1702 provides electrical contacts necessary to test each conductor of cable 190. It should be noted that the mating connector at location 1730 can be either male or female depending on whether connector 64 is female or male. Braces 1732 and 1734 are used to hold the mating connector into central location 1730. When changing mating connectors, locking brace 1736 is released and braces 1732 and 1734 are moved in the direction of arrows 1738 and 1740.

As mentioned earlier, right cable transport 106 of coiled cable transport mechanism 92 moves coiled cable 190 from coiled cable holding mechanism 88 to cable slack take up mechanism 104. It should be noted that at this point both ends of coiled cable 190 have a connector. Right cable transport mechanism 106 moves coiled cable 190 so that connector 64 is received by the connector nest of cable slack mechanism 104 and connector 98 is received by sliding connector nest 108.

Cable slack take up mechanism 104 is used to receive coiled cable 190 and to remove the loop of cable created by cable locating mechanism 74. Sliding connector nest 108 slidably holds connector 98 as cable slack take up mechanism 104 rotates to remove this loop. After the loop is removed, sliding connector nest 108 releases connector 98 so that the end of cable 190 can be drawn into the coiled section of cable 190 by the rotation of cable slack take up mechanism 104. In addition, cable tie mechanism 110 ties the coiled sections of cable 190 after cable slack take up mechanism 104 draws connector 98 into the coiled section of cable 190. These ties maintain the coiled configuration of cable 190 after it has been removed from cable slack take up mechanism 104.

Figure 27A:
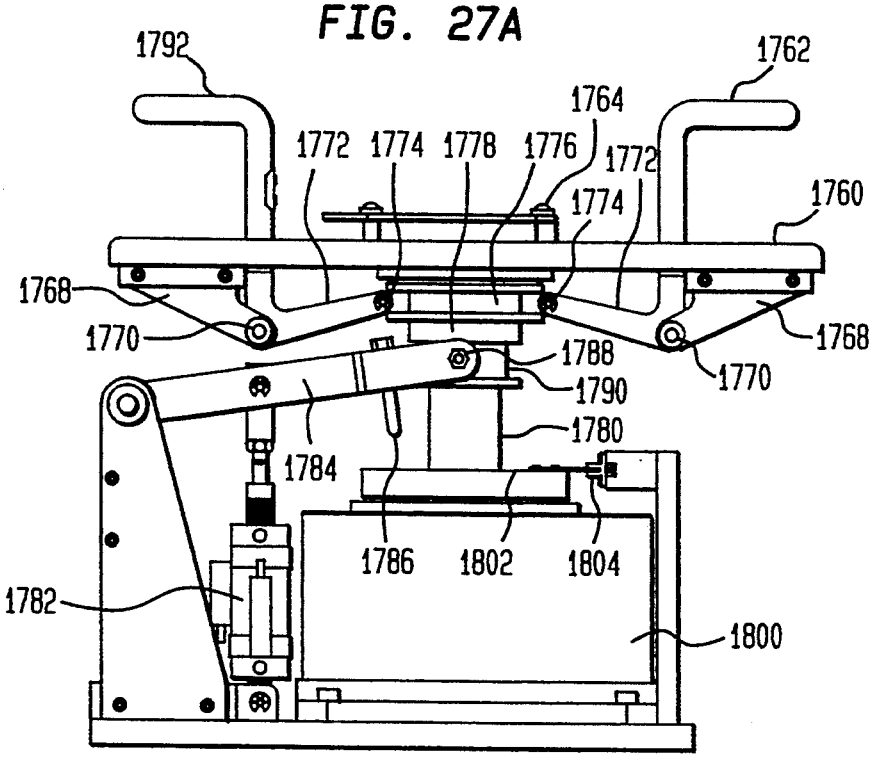
FIGS. 27a and b illustrate cable slack takeup mechanism 104.
Figure 27B:
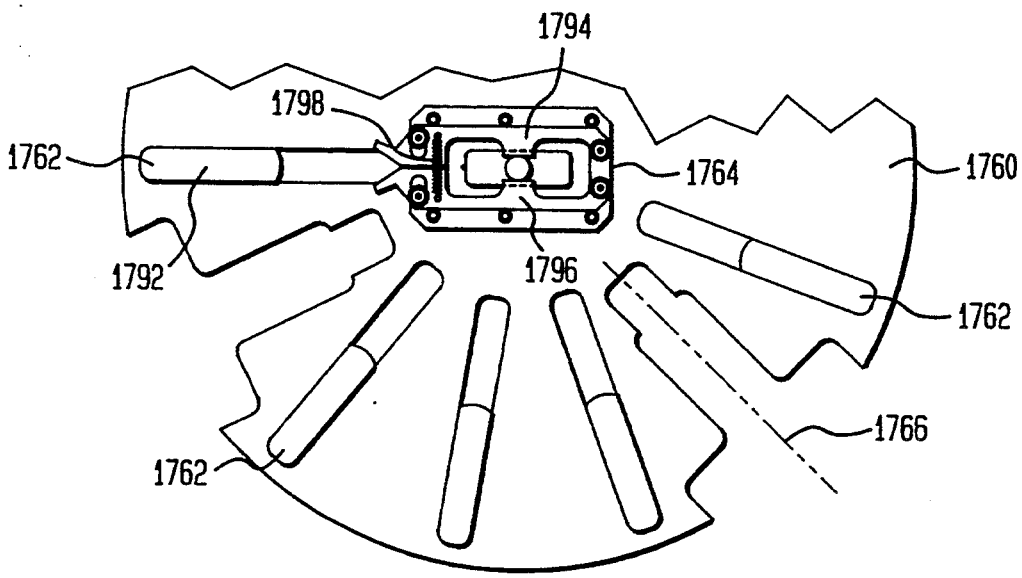

FIGS. 27*a* and *b* illustrate cable slack take up mechanism 104. Mechanism 104 is similar to coiled cable holding mechanism 82 of FIG. 23*a* and *b* except that mechanism 104 rotates. Cable slack take up mechanism 104 includes table 1760 with retractable finger 1762. Table 1760 also includes a centrally located connector nest 1764 and slots 1766. Slots 1766 accept coiled cable clamps 1614 of coiled cable transport mechanism 92; however, in this case the slots are somewhat larger so that they may accept a portion of cable tie mechanism 110. The slots enable the feed portion of tie mechanism 110 to encircle the coiled section of cable 190 in the same way that the slots enable clamp 1614 to encircle the coiled section of cable 190. As described with regard to other coil cable holding mechanisms, fingers 1762 are pivotally mounted to support brackets 1768 so that fingers 1762 pivot about pin 1770. Extensions 1772 of fingers 1762 include rollers 1774. Rollers 1774 ride in slot 1776 of sheave 1778. As sheave 1778 is slid upward and downward on shaft 1780, fingers 1762 are extended and retracted respectively. Sheave 1778 is moved by the action of air cylinder 1782 which moves forked-arm 1784. Forked-arm 1784 is similar to forked arm 1132 of FIG. 18*c* except that it includes extension 1786. Rollers 1788 located at the forked end of arm 1784 ride in slot 1790 of sheave 1778 so that sheave 1788 is moved upward and downward as air cylinder 1782 extends and retracts its piston.

When fingers 1762 are retracted, finger 1792 interacts with the ends of connector clamp halves 1794 and 1796. When retracted, finger 1792 separates clamp 1794 and 1796 so that they may receive or release connector 64. When finger 1792 is extended, spring 1798 pulls clamps 1794 and 1796 together so that connector 64 is secured in connector nest 1764.

Motor 1800 is used to rotate shaft 1780 and thereby rotate table 1760 so that the slack or loop introduced by cable locating mechanism 74 is taken up. Once the loop is taken up, sliding connector nest 108 slides in the direction of cable slack take up mechanism 104. When sliding connector nest 108 reaches the end of its travel, it releases connector 98 so that the end of coil cable 190, which includes connector 98, is drawn into the coiled section of the cable. The rotation of shaft 1780 is controlled by observing flagged wheel 1802 with slotted optical switch 1804.

Wheel 1802 includes an opening that receives extension 1786 of arm 1784. The opening in wheel 1802 is such that the opening is aligned with extension 1786 only when wheel 1802 is in its home position. Extension 1786 prevents fingers 1762 and 1792 from fully opening except when wheel 1802 is in home position. In all other positions, which are the tie positions, extension 1786 hits the top surface of wheel 1802. Under these conditions, the fingers can open only about 90% of the total. The last 10% of the stroke is what opens the connector clamp halves 1794 and 1796. If the clamp is opened, the connector might come out of the nest and interface with the fie operation. Fingers 1762 and 1792 are opened pan way during the tying process so that the coil of cable can collapse from its rigid confinement and conform to a more circular cross section as the tie is actually being made. After the tie is completed, the fingers are again extended which re-centers the coil on disk 1760. The disk 1760 is rotated 120 degrees to the next open slot and the process is repeated. If another tie is desired, disk 1760 rotates another 120 degrees and the cable is tied a third time. At all three of the tie positions, the fingers cannot quite open all of the way and consequently the connector cannot escape from its nest. After the ties are made, wheel 1802 returns to its home position, which is not a tie position. At the home position, extension pin 1782 is aligned with a hole in disk 1802 allowing the full travel of arm 1784 to be achieved, and consequently allowing connector clamp halves 1794 and 1796 to fully open. As a result, the home position fully releases the cable so that the cable can re removed by right cable transport mechanism 106.

Figure 28A:
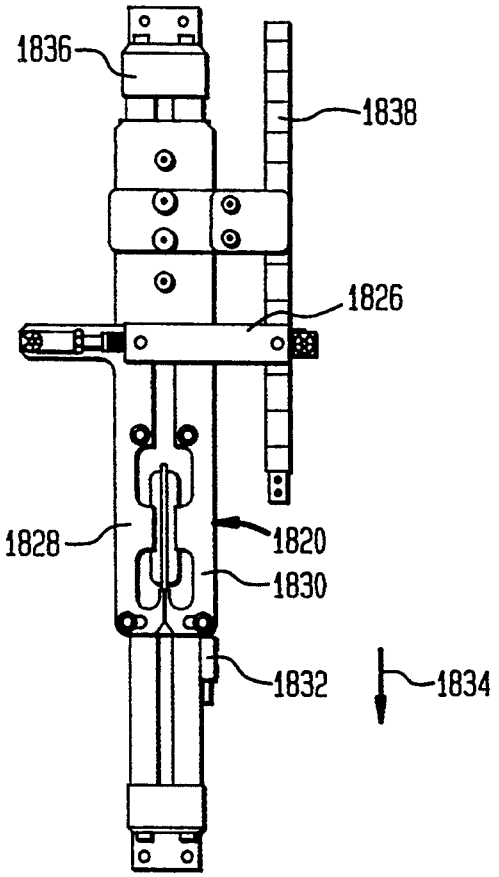
FIGS. 28a and b illustrate sliding cable nest 108.
Figure 28B:
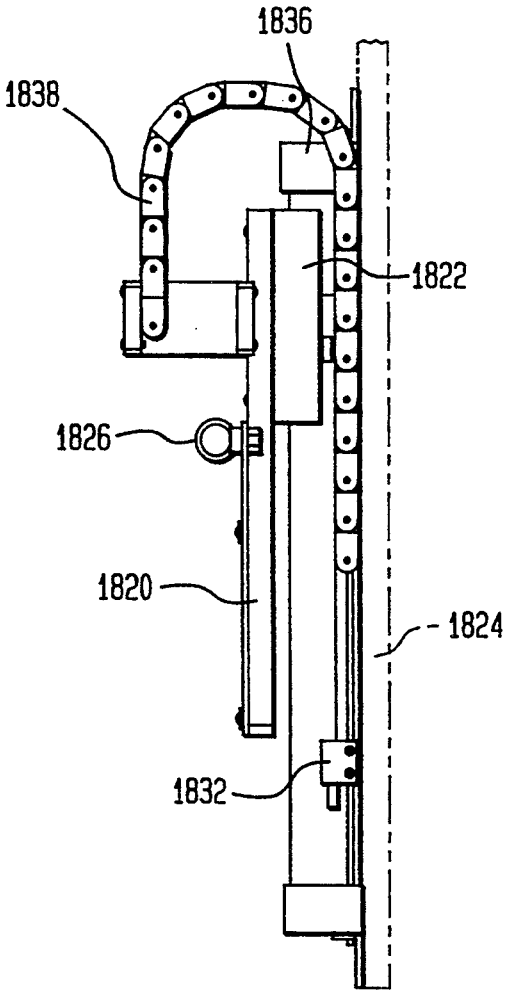

FIG. 28*a* and *b* illustrates sliding connector nest 108. Connector nest 1820 is mounted on slide 1822 which slides along support base 1824. Air cylinder 1826 opens and closes left connector clamp 1828 and right connector clamp 1830. When the piston of cylinder 826 is retracted, clamps 1828 and 1830 separate to permit receiving or releasing connector 98. When the piston of air cylinder 826 is extended, clamps 828 and 830 close to retain connector 98. Optical sensor 1832 senses when connector nest 1830 has been slid to the end of its travel in the direction of arrow 1834. At this point, all of the slack or loop in cable 190 has been taken up by the rotation of cable slack take up mechanism 104. To permit the remaining portion of cable 190 to be drawn into the coiled section of cable 190, clamps 1828 and 1830 are separated by air cylinder 1826 when optical switch 1832 is triggered. This releases connector 98 and permits it to be drawn into the coiled section of cable 190 by cable slack take up mechanism 104. After cable connector 98 has been released, air cylinder 1836 retracts its piston to draw connector nest 1830 in the direction opposite to that of arrow 1834. When air cylinder 1836 moves connector nest 1830 to the end of its travel, sliding connector nest 108 is once again ready to receive connector 98 of the next coiled cable from right cable transport mechanism 106. Guide 1838 is used to provide a protective channel for the wires and air tubes that operate sliding connector nest 108.

Figure 29:
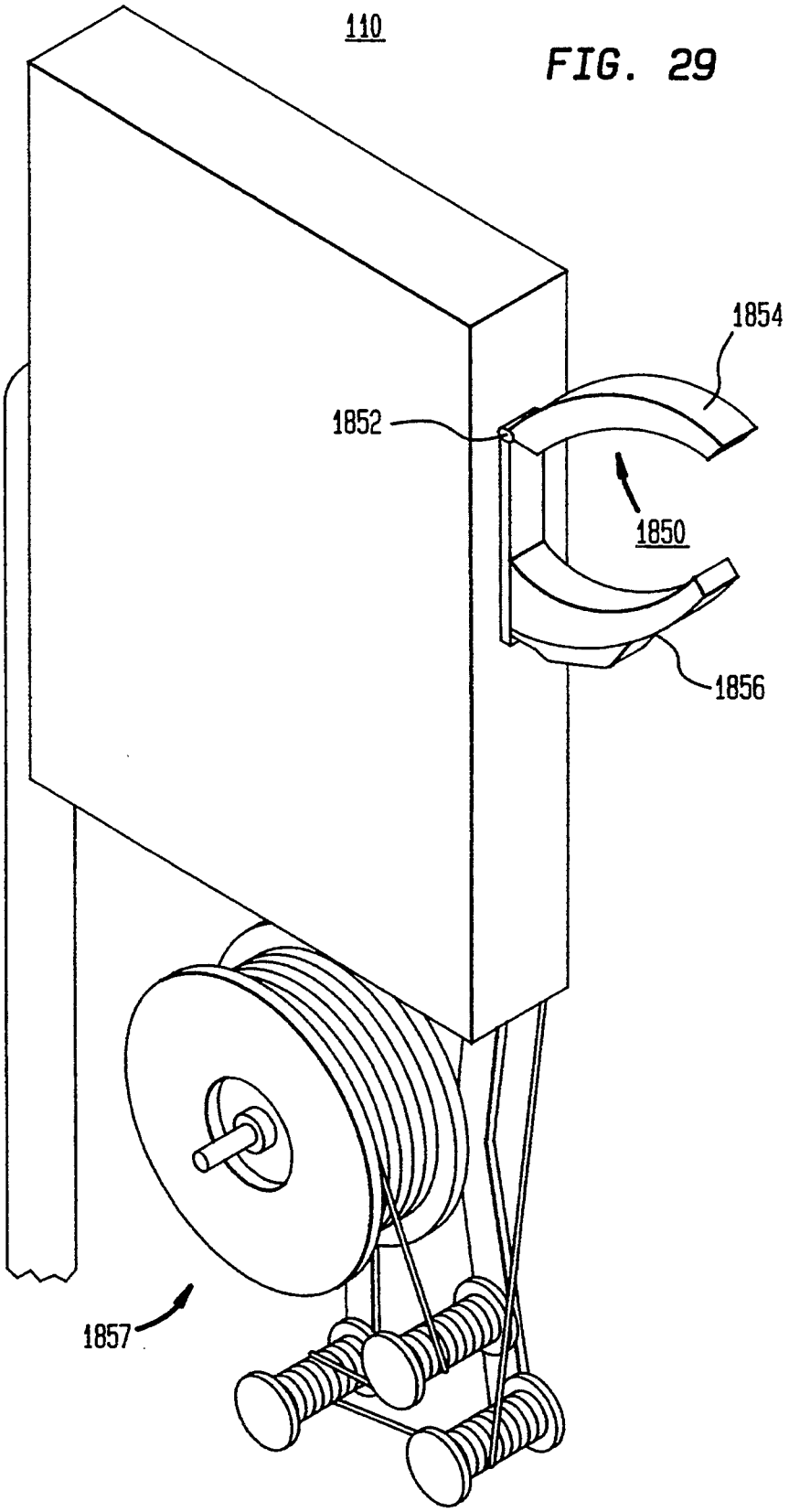
FIG. 29 illustrates cable tie mechanism 110.

FIG. 29 illustrates cable tie mechanism 110. Cable tie mechanism 110 is a Tie Boy A200 manufactured by Peters Equipment, Ivyland, Pa. Tie mechanism 110 includes tie feed loop 1850. Feed loop 1850 is hinged at point 1852 so that section 1854 can be opened and closed. After cable slack take up mechanism 104 is rotated sufficiently to draw connector 98 into the coiled section of the cable, and after table 1760 has stopped rotating so that one slot 1766 of table 1760 is aligned with feed mechanism 1850, section 1854 closes around the coiled portion of cable 190 by extending into slots 1766 of table 1760. Once section 1854 is closed about the cable, a tie wire is fed from reel 1857 through feed mechanism 1850 and secured about a coiled portion of cable 190 automatically. It is possible at this point to tie additional wraps around the coiled portion of cable 190 by rotating table 1760 of cable slack take up mechanism 104 so that a second and even third slot 1766 is aligned with feed mechanism 1850.

After the ties have been placed around the coiled section of cable 190, right cable transport mechanism 106 of coiled cable transport mechanism 92 moves coiled cable 190 to conveyor belt 112. Conveyor belt 112 then moves the fully connectorized and reeled cables to a desired location.

Figure 30A:
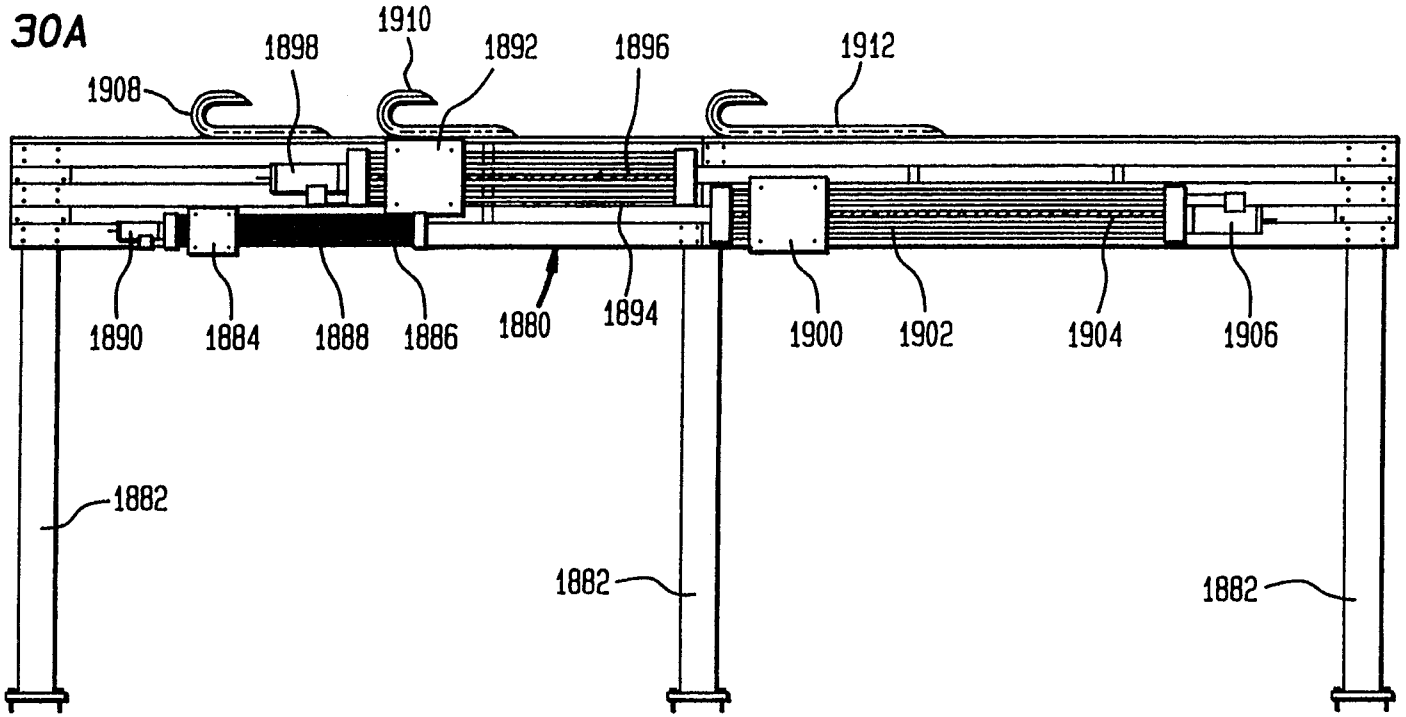
FIGS. 30a and b illustrate gantry 114.
Figure 30B:
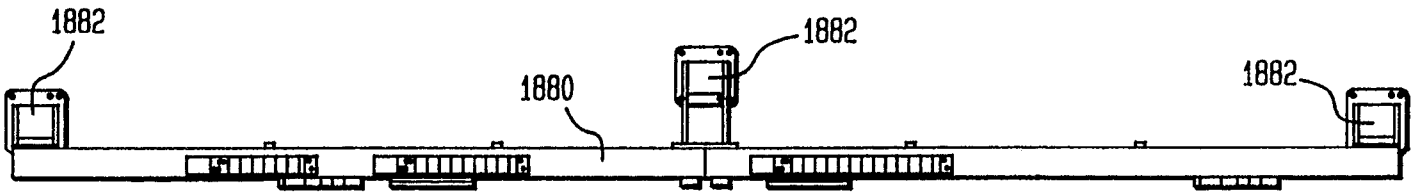

FIG. 30 illustrates gantry 114. Gantry 114 is used to support and move cable transport mechanism 54, rotating cable transport mechanism 80 and coiled cable transport mechanism 92. Gantry 114 includes horizontal frame members 1880 and vertical frame members 1882. Cable transport mechanism 54 is mounted to support plate 1884. Support plate 1884 is mounted to lead screw 1886 and guides 1888. Support plate 1884 is moved along guides 1888 by rotating lead screw 1886 using motor 1890. Rotating coil cable transport mechanism 80 is mounted to support plate 1892. Support plate 1892 is mounted to guide rails 1894 and lead screw 1896. Support plate 1892 is moved along guide rails 1894 by rotating lead screw 1896 using motor 1898. Coiled cable transport mechanism 92 is mounted to support plate 1900. Support plate 1900 is mounted to guide rails 1902 and lead screw 1904. Support plate 1900 is moved along guide rails 1902 by rotating lead screw 1904 using motor 1906. Conductor and air tube guides 1908, 1910 and 1912 are used to guide the conductors and air hoses used by cable transport mechanism 54, rotating cable transport mechanism 80 and coiled cable transport mechanism 92 respectively.

The connectors, which are attached to each end of cable 190, are moved from their shipping container to a mandrel within the identify and connectorization stations by a robot arm located near each identify and connectorization station. Robot arm 66 is used to move connectors from shipping box 68 to identify and connectorization station 60, and robot arm 100 is used to move connectors from shipping box 102 to identify and connectorization station 96. The robots are Adept 604-S manufactured by Adept Technology, Inc., San Jose, Calif.

The connectors are received from the manufacturer in a pre-positioned fashion so that orientation of each connector is known. Connectors are typically received in boxes containing one hundred connectors in individual cells. The box is positioned by spring-loaded guides that position the box in a known position. The robot arm includes a connector gripper. The gripper is used to move connectors to the connectorization station, to position the male or female mandrels in the connectorization stations, and to pick up a connector extraction tool that removes the connectors from the shipping box. The gripper that is used to move connectors and mandrels is also used to pick up the extraction tool. This offers the advantage of having just one gripper attached to the robot arm at any given time and thereby avoids the inconvenience of making and breaking air connections and electrical connections when the extraction tool is required.

The process begins by the robot arm and connector gripper picking up the connector extraction tool from a tool nest. The connector extraction tool has two fingers that act in a scissor-like fashion with one finger being longer than the other. The robot arm moves over a particular cell containing a connector in a known orientation. The longer finger of the connector extraction tool is used to hook the strain relief clamp of a connector within an individual cell of the shipping container. Once the connector's strain relief clamp has been hooked with the longer finger, the scissor-like fingers close to grasp the connector's clamp. The arm then picks up the connector and places the connector in a loosely-fitting locating nest.

Once positioned in the nest, the nest clamps to a tighter configuration to accurately position the connector. The connector receiving nest then rotates to a position that places the connector in an orientation position that permits the connector gripper to grasp the connector. The robot arm then places the connector extraction tool in its tool nest so flint the connector gripper is free to pick up the connector from the locating nest. The connector gripper then grasps the connector from the connector locating nest and moves to a parked position and waits until the connectorization station is ready for another connector. The parked position may be any location near the connectorization station that does not interfere with a cable transport mechanism. After the connectorization station is ready for another connector, the connector is inserted onto the mandrel of the connectorization station. The robot arm then returns to pick up the connector extraction tool to repeat the process. In the meantime, the connector locating nest rotates down to its original position and is opened to a loose-fitting configuration to receive the next connector from the connector extraction tool.

Figure 31:
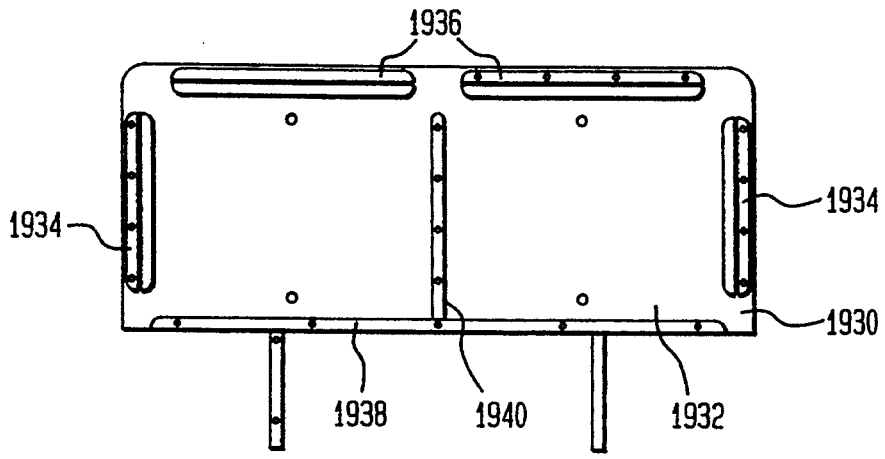
FIG. 31 illustrates a connector prepositioning tray.

FIG. 31 illustrates prepositioning tray 1930 which prepositions two boxes of connectors. Each box is supported by surface 1932 and is positioned by spring loaded rails 1934 and 1936 which press the boxes against stationary rails 1938 and 1940.

Figure 32A:
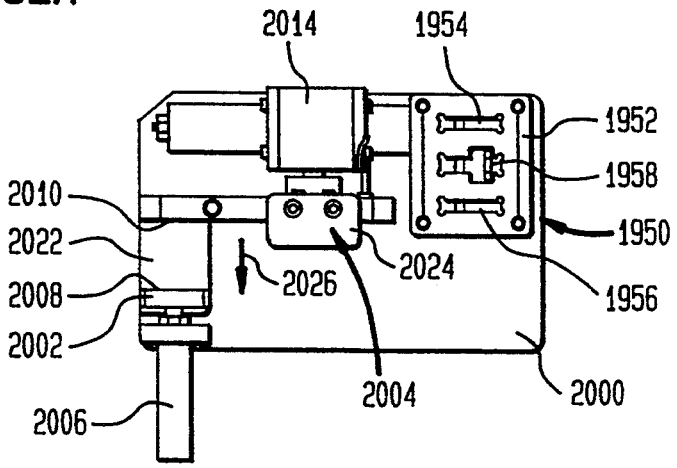
FIGS. 32a and b illustrate a connector locating nest.
Figure 32B:
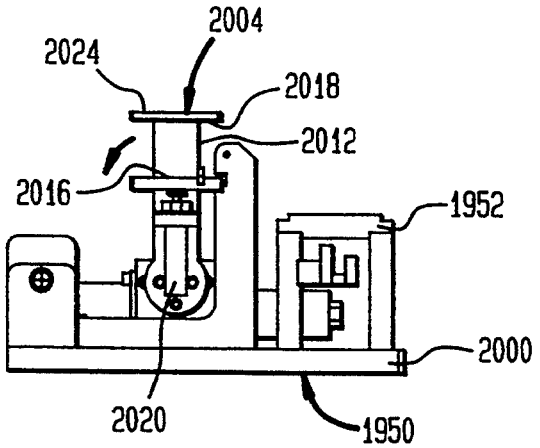

FIGS. 32*a* and *b* illustrate top and side views, respectively, of connector locating nest 1950. Connector locating nest 1950 also includes tool nest 1952. Tool nest 1952 includes slots 1954 and 1956 to hold mandrels used by the connectorization station. There is usually one mandrel for female connectors and another mandrel for male connectors. Slot 1958 is used to store connector extraction tool 1960.

Figure 33C:
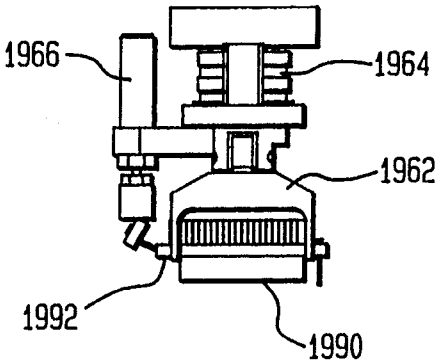
FIGS. 33a, b and c illustrate a robot arm holding a connector extraction tool, the robot arm using the connector extractor tool to hold a connector, and the robot arm using a connector gripper to hold a connector, respectively.
Figure 33B:
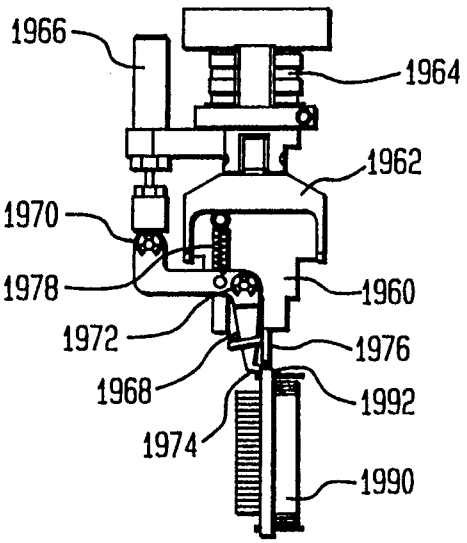
Figure 33A:
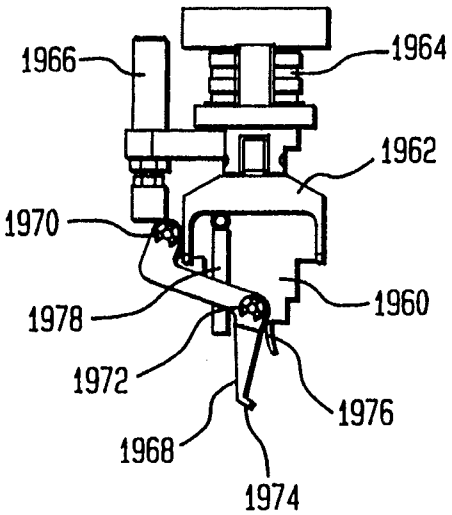

In reference to FIG. 33*a* connector extraction tool 1960 is held by connector gripper 1962. Connector gripper 1962 is operated by air cylinder 1964. Air cylinder 1964 is used to open and close connector gripper 1962 so that connector gripper 1962 can grasp connector extraction tool 1960, connectors or mandrels. When gripping connector extraction tool 1960, air cylinder 1966 is used to operate locating finger 1968. When air cylinder 1966 extends its piston, the end of the piston presses against roller 1970 so that finger 1968 rotates about point 1972 to move finger end 1974 in the direction of stationary finger 1976. When the piston of air cylinder 1966 is retracted, finger end 1974 moves away from stationary finger 1976 due to the action of spring 1978. As a result, fingers 1968 and 1976 operate in a scissor-like fashion to open and close with the extension and retraction, respectively, of air cylinder 1966.

FIGS. 33*b* and *c* illustrate a vertical and horizontal orientation for a connector 1990. In FIG. 33*b*,connector 1990's strain relief clamp is grasped by connector extraction tool 1960, and in FIG. 33*c* connector 1990 is grasped by connector gripper 1962. Connector 1990 is positioned in the vertical orientation when received in the shipping boxes from the manufacturer. When extracting the connector from the shipping box, fingers 1968 and 1976 are held in the open position and the robot arm moves the connector extraction tool so that finger end 1974 hooks strain relief clamp 1992 of connector 1990. After moving the tool so that finger end 1974 hooks strain relief clamp 1992, finger 1974 and 1976 are moved to a closed position to grasp strain relief clamp 1992. After grasping the connector's strain relief clamp, the robot arm moves in a manner that places the vertically-oriented connector 1990 into connector locating nest 1950.

Connector locating nest 1950 includes support base 2000 which holds tool nest 1952, horizontal locator 2002 and rotating locator 2004. Horizontal locator 2002 is operated by the action of air cylinder 2006. Air cylinder 2006 moves surface 2008 closer to surface 2010 when its piston is extended, and moves surface 2008 away from surface 2010 when its piston is retracted. Rotating locator 2004 is mounted to rotating arm 2012. Rotating 2012 is moved between the vertical and horizontal position by pneumatic rotary actuator 2014. Rotating locator 2004 includes surface 2016. Surface 2016 is moved closer to surface 2018 when air cylinder 2020 extends its piston and surface 2016 is moved away from surface 2018 when air cylinder 220 retracts its piston.

When connector 1990 is moved to locating nest 1950, rotating locator 2004 is moved to a horizontal position with the piston of air cylinder 2020 retracted. The piston of air cylinder 2006 is also retracted to provide a loose-fitting reception area for vertically oriented connector 1990. The robot arm positions vertically oriented connector into area 2022 and then releases the connector by separating fingers 1974 and 1976. After the connector has been placed in area 2022, air cylinders 2006 and air cylinder 2020 extend their pistons to accurately position vertically oriented connector 1990 between surfaces 2008 and 2010, and 2016 and 2018. While continuing to hold connector 1992 between surfaces 2018 and 2016, air cylinder 2006 retracts its piston to move surface 2008 away from the connector. This frees the connector so that arm 2012 can be rotated to a vertical position and thereby orient the connector 1990 in a known horizontal position. After the robot arm places connector extracting tool 1960 in slot 1958 of nest 1952, connector clamp 1962 reaches over plate 2024 to grasp connector 1990 while in the horizontal position. Once gripper 1962 has gripped horizontally-oriented connector 1990, air cylinder 2020 retracts to separate surfaces 2018 and 2016 and thereby releases connector 1990. The robot arm then moves in the direction of arrow 2026 to remove connector 1990 from connector receiving nest 1950. The arm then moves the connector to the mandrel located in the connectorization station. FIG. 33*c* illustrates gripper 1962 holding connector 1990 in a horizontal orientation.

Gripper 1962 is also used to change mandrels in the connectorization stations. When changing the mandrel, the robot arm grasps the mandrel in the connectorization station using gripper 1962 and the connectorization station releases the mandrel so that the robot arm can place the mandrel in tool nest 1952. The robot arm then grasps the new mandrel using gripper 1962 and places that mandrel in the connectorization station. The connectorization station then latches the mandrel in place.

The robot is taught to pick up the connectors from the supply box by supplying the robot with reference points and the relationship between the connectors and those reference points. The robot then can move to each of the connector locations to extract connectors. During training, the robot is moved to a particular location and then that location is assigned a reference name. The robot can then be commanded to move to any of those locations by simply referring to the name assigned to the reference point. The robot should be trained in a manner consistent with the supplier's instructions.

Figure 34:
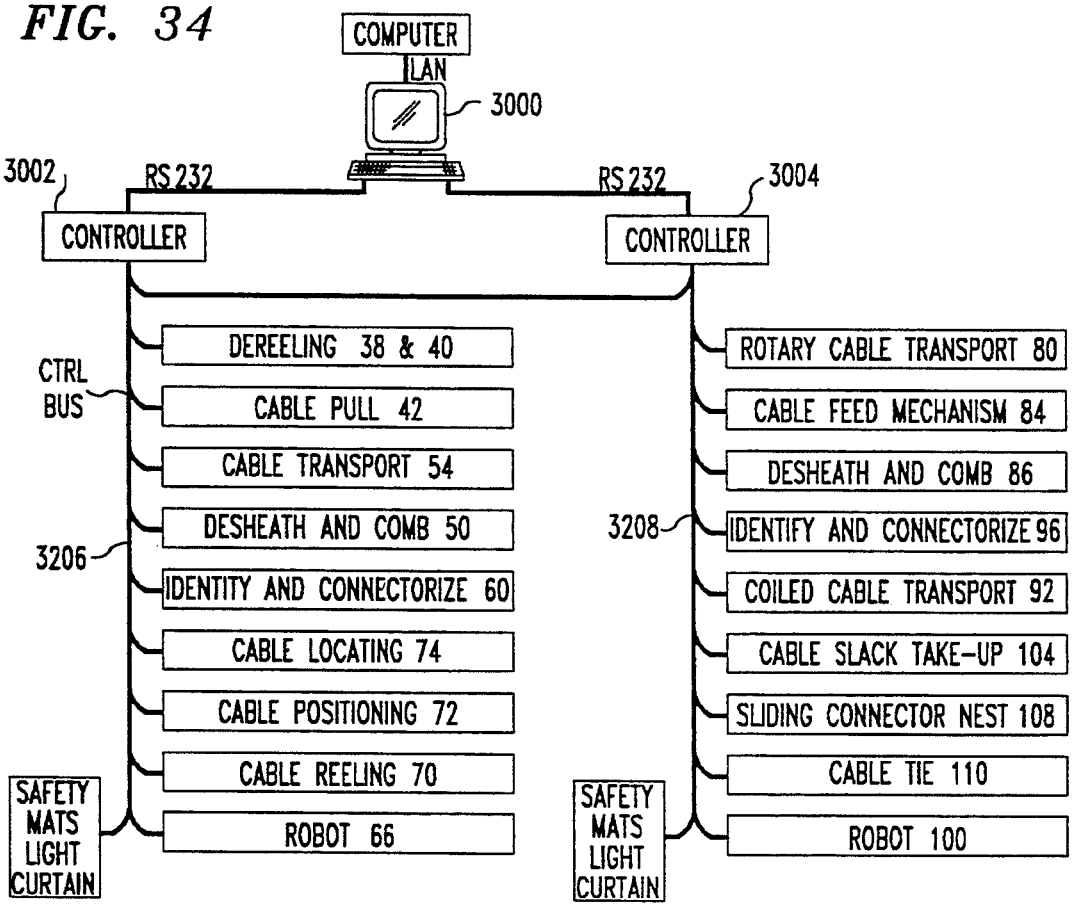
FIG. 34 illustrates the control structure for producing the cable assembly of FIG. 1.

The mechanisms to produce the cable assembly of FIG. 1, are controlled as illustrated in FIG. 34. Personal Computer (PC) 3000 is used as a system controller.

PC 3000 controls the overall operation of the system by specifying the number of cable assemblies to be manufactured and the length of the cable assemblies. It also provides a user interface through an associated keyboard and display so that an operator can be notified of errors or problems as they arise. In addition, PC 3000 is connected to a local area network (LAN) such as an ethernet where orders for specific cable assemblies can be received from another computer.

PC 3000 controls the overall system using two separate controllers that it communicates with using an RS232 bus. Controller 3002 is used to control cable unreeling mechanisms 38 and 40, cable pull mechanism 42, cable guide and clamp mechanism 44, cable transport 54, desheath and comb station 50, identify and connectorize station 60, cable locating mechanism 74, cable positioning mechanism 72, cable reeling mechanism 70, robot 66, and safety mats and light curtains that are placed around these mechanisms. The safety mats and light curtains are used to inform controller 3002 that someone has entered an area that places them in danger so that controller 3002 can stop a mechanism. Controller 3004 is used to control rotating cable transport mechanism 80, cable feed mechanism 84, desheath and comb station 86, identify and connectorize station 96, coiled cable transport mechanism 92, cable slack takeup mechanism 104, sliding connector nest 108, cable tie mechanism 110, robot 100, and the safety mats and light curtains associated with these mechanisms. Controllers 3002 and 3004 control these devices using high speed buses 3206 and 3208 to communicate with or obtain inputs from air valves, optical switches and servo motor controllers that operate or monitor mechanisms. The typical speed of an input or output is approximately 1 msec. The high speed buses are also used to provide a communication between controller 3002 and 3004. Controllers 3002 and 3004 are preferably ADEPT CC controllers available from Adept Technology, Inc., San Jose, Calif. The high speed bus is implemented using interface boards available from OPTO 22, located at 15461 Springdale Street, Huntington Beach, Calif. 94629. The bus system is known as a PAMUX bus system. It is also possible to use other controllers and high speed buses.

The high speed bus (3206 or 3208) associated with each controller is structured as a 512-bit wide parallel bus. The bus is divided into bits that communicate with different devices. For example, one bit may be used for an air cylinder located in cable transport 54, another bit may be used to detect input from a slotted optical switch, several bits may be used as inputs to a servo motor controller several other bits may be used as outputs from another servo motor controller and other bits can be used as inputs from safety mats or light curtains. The 512 bits are divided up so that a controller can communicate with all of the sensors, air valves and servo motor controllers, actuators, transducers and all other equipment used to operate physical devices. The 512 bit-wide bus can be divided in any manner, and addresses can be assigned to each bit or group of bits. The addresses can then be used when executing programs so that the controllers can communicate with a specific device. The controllers also use several bits of their respective high speed buses to communicate with each other.

Motors throughout the system are controlled and monitored using servo motor controllers. These controllers store sequences of action in non-volatile memory. Sequences are executed by applying the binary code that identifies the sequence to the inputs of the servo motor controller. As a result, to obtain a particular type of action from a motor, the appropriate controller (3002 or 3004) uses its high speed bus to send a binary value to the input of the associated servo motor controller. To obtain the status (position, velocity, etc.) of a particular motor, the appropriate controller uses its high speed bus to read a binary code available at the outputs of the associated servo motor controller. Servo motor controllers are taught a specific sequence, which can involve moving to a location using specific velocities and accelerations, via an RS232 bus in accordance with instructions provided by the servo motor controller's manufacturer. The RS232 bus is used to specify what actions should be taken in a sequence and the binary value that identifies the sequence. The RS232 bus that connects controller 3002 to its associated servo motor controllers, and the RS232 bus that connects controller 3004 to its associated servo motor controllers are not shown in FIG. 34. Servo motor controllers are available from Parker Hunnifin Corporation, Rohnert Park, Calif.

Figure 35:
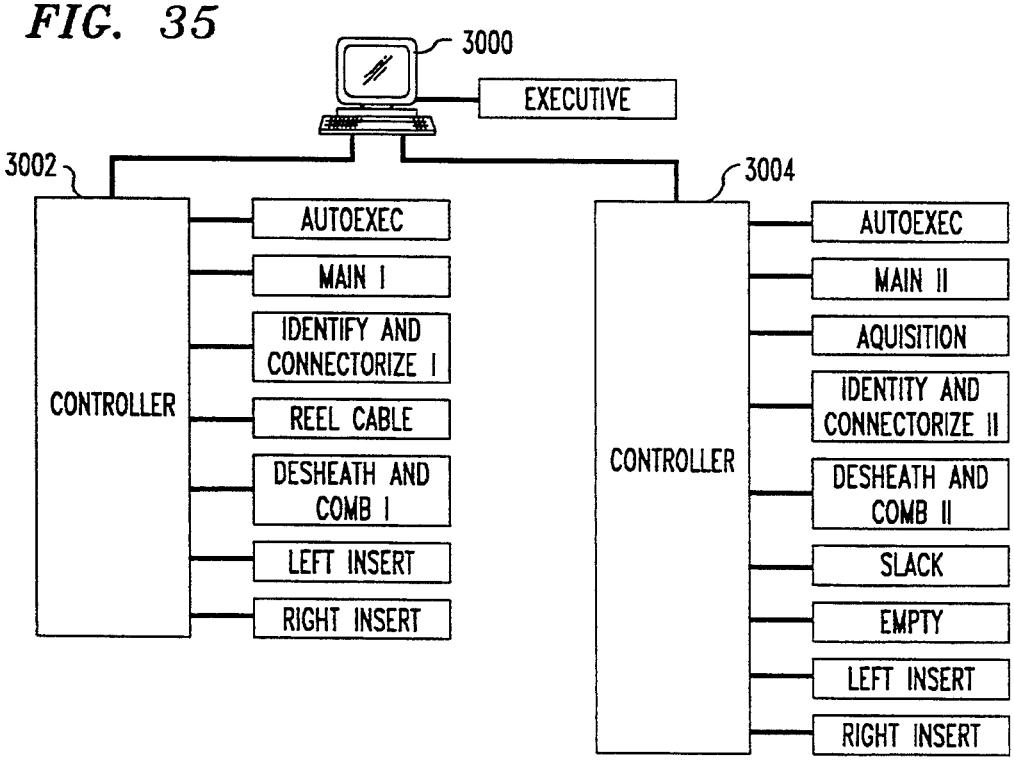
FIG. 35 illustrates different software program modules.

The controllers execute programs written in a language specified by the controller's manufacturer. In the case of ADEPT controllers, programs are written in the form of V+. FIG. 35 illustrates the program modules run by each of the controllers. Each controller executes its list of programs in a time-shared fashion. Different programs are assigned different time slices of the controller's time. Time sharing is desirable because the programs involve waiting for mechanical motion to occur. These waiting periods permit the controllers to execute a program in one time slice while several other programs in other time slices are waiting for a mechanical device to move. In this embodiment, controller time is sliced into eight different slices of approximately 15 milliseconds each.

Program module Main 1 places the machine in a known state, monitors safety and fault interrupts, controls cable transport 54 and makes calls to other program modules. Module Desheath and Comb 1 dereels the cable from the spools, captures the end of the cable at the desheath station, and operates the desheath and comb station. Module Identify and Connectorize 1 captures the end of the cable at the ID station, determines the identities of the wires, tests each conductor after it has been inserted into a connector and starts modules Left Insert and Right Insert. Module Left Insert moves a conductor from disk 714 to conductor transfer arm 824 and aligns conductor insertion mechanism 718 with the proper contact of the connector. Module Right Insert operates in a similar fashion, it moves a conductor from disk 714 to conductor transfer arm 826 and aligns conductor insertion mechanism 719 with the proper contact of the connectors. Module Reel Cable accepts a connectorized end of cable 190 from cable transport mechanism 54 using cable reeling mechanism 70, dereels the proper length of cable from the spools using the cable pull mechanism 42, winds this cable into a coil and acquires the loose end of the cable after it has been cut using cable locating mechanism 74. This program also notifies controller 3004 that a coiled cable with one end connectorized is waiting to be picked up by rotating cable transport mechanism 80.

It can be seen that by operating these programs controller 3002 produces a coiled length of cable with a connector at one end and a loose end in a known location. Once this partial cable assembly is available, controller 3004 is notified so that it can perform the rest of the functions required to produce the cable assembly of FIG. 1. Program module Main II is similar to program module Main 1. Module Main II places the mechanisms in a known state, monitors safety and fault interrupts and controls rotating cable transport 80 and coiled cable transport 92. Module Desheath and Comb Module 2 feeds cable from the loop created by cable locating mechanism 74 into the desheath station using cable feed and clamp mechanism 84. This module also operates the desheath and comb station 86. Module Identify and Connectorize II acquires the combed end of the cable, determines the identity of the wires, starts modules Left Insert and Right Insert, and checks the wires after they have been inserted. Modules Left Insert and Right Insert are the same as Module Left Insert and Right Insert executed by controller 3002. Module Slack Removal removes the loop of cable created by cable locating mechanism 74 using slack take-up mechanism 104, and sliding connector nest 108; and controls tie mechanism 110 so that coiled cable is tied. Module Empty empties the mechanisms controlled by controller 3004 when the last cable assembly is received from cable reeling mechanism 70.

Figure 36:
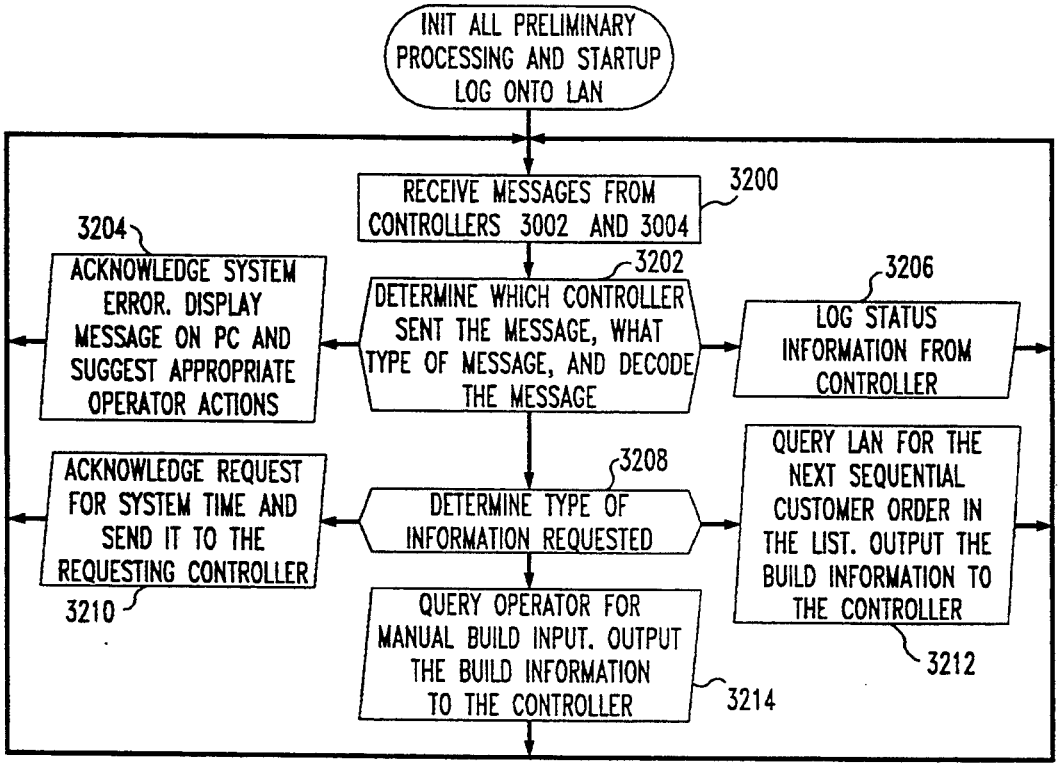
FIG. 36 is a flow chart of an executive program.

FIG. 36 is a flow chart of the executive program executed by PC 3000. The program begins by initializing the PC and logging onto a LAN. The program then moves to step 3200 where it waits to receive an interrupt from one of the controllers. In step 3202 it is determined which controller sent the message and what type of message was sent. If the message was an error message, the PC displays the message on the screen and uses a database of suggested solutions to display a suggested action for the operator. If the message contained status information, step 3206 is executed and the status information is logged for later retrieval by an operator. If the message sent by the controller requests information, step 3208 is executed where it is decided what type of information is needed. If a request for system time is received, step 3210 is executed where the current time is sent to the requesting controller. The current time is simply used to provide a time tag on status information sent from the controller to the PC. If the request was for manufacturing information, step 3212 is executed to provide the controllers with information regarding the next customer order to be built. Information is obtained from the LAN and stored within PC 3000 as a list of backlogged orders. If the request from the controller for order information and there is none available from the LAN, the operator can input order information manually in step 3214.

Figure 37:
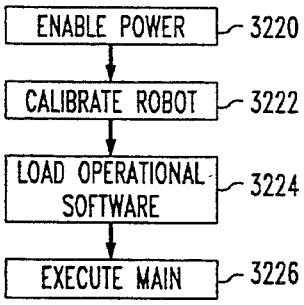
FIG. 37 is a flow chart of an auto.exec routine.

FIG. 37 is a flowchart of the auto executive routine. This routine is executed by both controllers on power up or initialization. Step 3220 turns on power to the robots. Step 3222 calibrates the robots by instructing the robot to go to a home position in each degree of freedom and then move to a reference point which is a known distance from that home position. In step 3224, the program modules that will be executed by a particular controller are loaded from non-volatile memory. In step 3226, controller 3002 executes program module Main 1 and controller 3004 executes program module Main II.

Figure 38:
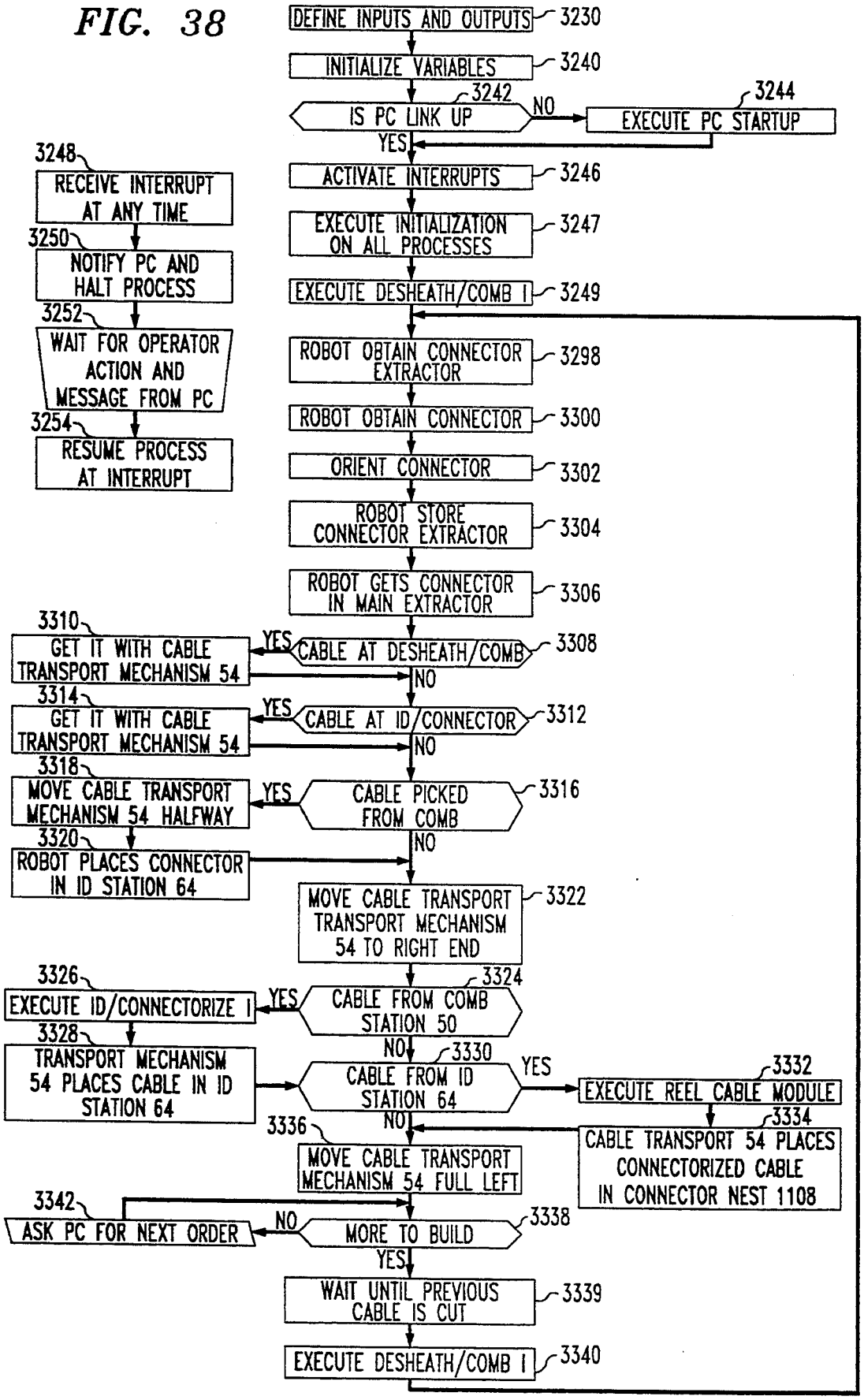
FIG. 38 is a flow chart of program module Main 1.

In reference to FIG. 38, module Main 1 begins with step 3230 which involves initializing the high speed bus by defining which bits are grouped together and which address specifies each group of bits. Each group comprises one or more bits, and each group of bits can be defined as an input, an output or an interrupt. Variables are initialized in step 3240. For example, a software flag that indicates which spool of cable will be used for the next cable assembly is initialized. In step 3242 the RS232 communication link between PC 3000 and controller 3002 is tested by listening for a command from the PC. If no command is received, step 3244 is executed by requesting a communication from the PC such as a time request. After executing step 3244 or step 3242, interrupts are activated using step 3246.

Interrupts result from occurrences such as someone stepping on a safety mat or an impending collision of cable transport mechanisms. When interrupts are received, steps 3248 through 3254 are executed. These steps comprise receiving the interrupt, notifying PC 3000 and halting the process involved in the interrupt. After an operator action has been taken, and a resume message has been received from the PC, program main resumes processing at the point where the interrupt was received.

After step 3246, step 3247 is used to place the different components of the mechanisms controlled by controller 3002 in a position that prepares them to receive material for processing. Step 3249 starts execution of module Desheath and Comb 1. Different modules operate in different 15 msec time slices of controller 3002's time; therefore, from a mechanical point of view the modules are operating simultaneously. As a result, modules Main 1, and Desheath and Comb 1 can be viewed as operating simultaneously.

Figure 39:
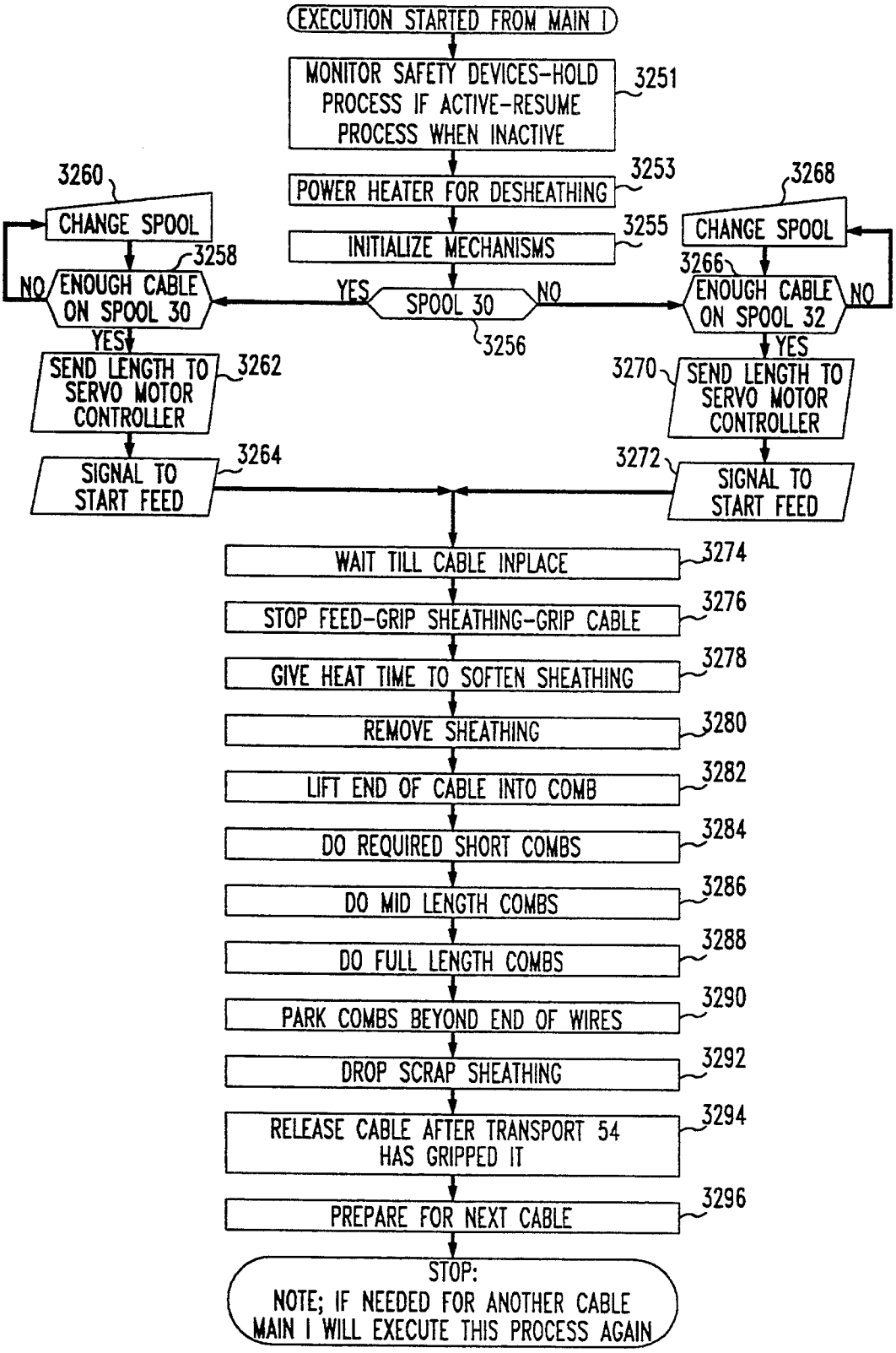
FIG. 39 is a flow chart of program module Desheath and Comb 1.

FIG. 39 is a flow chart of module Desheath and Comb 1. Step 3251 monitors safety devices and delays execution of module Desheath and Comb 1 until the safety devices are inactive. Step 3253 applies power to heater 354 that heats cable 190 for desheathing. Step 3255 initializes the mechanisms to begin desheathing. In step 3256 a software flag that was initialized in step 3240 is checked to determine which spool of cable should be used. After checking the flag, the flag is flipped to its opposite position so that a different spool will be used next time. If spool 30 is to be used, step 3256 is exited to the left and if spool 32 is to be used, step 3256 is exited to the right. Step 3258 determines if there is enough cable on spool 30 for the length of cable being manufactured. The amount of cable available is determined by keeping track of the amount of cable that is unreeled from the spool during each operation. The operator tells the PC 3000 on loading a spool how much cable is on the spool. PC 3000 then supplies controller 3002 with information about the total length of cable on spool 30 so that step 3258 can determine if there is insufficient cable left on the spool. If there is insufficient cable left, step 3260 sends a message to the operator via PC3000 requesting a new spool of cable for spool lift mechanism 34. If sufficient cable is available, step 3262 is executed where the length of cable to be unreeled is sent to the servo motor controller that operates the wheels which pull the cable from spool 30. In step 3264 the servo motor controller is signaled to begin feeding. Steps 3266 through 3272 operate in a similar fashion but with respect to spool 32. After signaling the servo motor controller of the appropriate set of wheels in cable pull mechanism 42, step 3274 waits for the optical sensor in the desheath station to detect the end of cable 190 being fed into the desheath station. At this point, step 3276 stops the feeding of the cable by cable pull mechanism and grips the sheathing of the cable. Step 3278 waits approximately four seconds for the sheathing to soften and then the sheathing is pulled free in step 3280. After the sheathing is pulled free, the appropriate cable guides of cable guide and clamp mechanism 44 are opened and the cable is lifted into the combing portion of station 50 during step 3282. The desheathed portion of the cable is combed during steps 3284 through 3290. In step 3292 the scrap piece of sheathing is dropped by the desheathing station. In step 3294 the module waits for cable gripper 584 of cable transport mechanism 54 to indicate that it has closed and therefore grasped the cable. After the signal is received, step 3294 releases the cable from the cable clamp of cable guide and clamp mechanism 44, and prepares for the next cable in step 3296.

Returning to program module Main 1, after ordering the execution of module Desheath and Comb 1 in step 3250, module Main 1 continues by executing steps 3298 through 3306 where robot 66 obtains the connector extractor from its tool nest, removes the connector from its shipping box, places the connector into its connector locating nest so it can be oriented in a horizontal position, stores the connector extractor tool and then removes the horizontally-oriented connector from the locating nest. After removing the connector from the locating nest, the robot continues to hold the connector while it waits in a safe position. The safe position may be any position that is near the mandrel in connectorization station 60 and does not interfere with cable transport 54. In step 3308, it is determined whether the desheathed and combed end of cable 190 is available at desheath and comb station 50. This is determined by checking to see that combing portion of the station is parked at the rear most end of its travel, and that the cable clamp of cable guide and clamp 44 is closed and in an upper position thereby indicating that it is holding a cable. When the cable is at desheath and comb station 50, step 3310 is executed where cable transport mechanism 54 moves its cable over the cable in the desheath and comb station and grips it with cable clamp 584. Closing cable clamp 584 when cable transport mechanism 54 is positioned over the desheath and comb station signals module Desheath and Comb 1 to release the cable (see step 3294) by opening the cable clamp of cable guide and clamp 44. If step 3308 detects that there is no cable at desheath and comb station 50, step 3312 is executed. Step 3312 determines whether a cable with an attached connector is located at identify and connectorization station 60. This is detected by determining whether cable clamp 708 is closed and at its lower position. If it is determined that the cable and connector are available at station 60, cable transport mechanism 54 is positioned over station 60 and connector clamp 614 is lowered onto the connector. (Note, that at this point cable transport mechanism 54 is positioned so that its cable clamp 584 is positioned over desheath and comb station 50 and its connector clamp 614 is positioned over identify and connectorization station 60). After step 3314 gasps the connector at identify and connectorization station 60, it waits for a signal indicating that cable clamp 708 is open to indicate that station 60 has released the connectorized end of cable 190 so that it can be moved. If step 3312 determines that there is no cable at station 60, the program proceeds directly to step 3316. At step 3316 it is determined whether a desheath and combed cable end was picked up from station 50. This is determined by checking whether cable clamp 584 of cable transport mechanism 54 was closed by the execution of step 3310. If a cable was picked up at station 50, cable transport mechanism 54 is moved approximately half way in its travel between stations 50 and 60 so that cable clamp 584 is halfway between stations 50 and 60. At this point, step 3320 commands the robot 66 to move from the safe position where it has been waiting and places the connector on the mandrel of station 613. After step 3320 or after it is determined at step 3316 that a desheath and combed cable was not picked up at station 50, step 3322 is executed. Step 3322 moves cable transport mechanism 54 moves to the far right end of its travel so that cable clamp 584 is positioned over station 60 and connector clamp 614 is positioned over the connector nest of cable reeling mechanism 70. Step 3324 determines whether a cable was obtained at station 50 by checking whether clamp 584 was closed during step 3310. If a cable was obtained, step 3326 is used to start the execution of module Identify and Connectorize 1. After executing step 3326 controller 3002 waits for station 60 to capture the cable's conductors and comb them into a single column. This is detected by determining when cable capture mechanism 780 has closed and moved to its rear position. In step 3328, after capture mechanism 60 captures the conductors, cable transport mechanism 54 lowers clamp 584 to place the cable in clamp 708 of station 60. When the controller detects that cable clamp 708 of station 60 is closed, it releases cable transport mechanism 54's cable clamp 584. Step 3330 checks to determine whether a connectorized cable was obtained from station 60. If no cable was obtained step 3336 is executed. If one was obtained, step 3332 is executed to start module reel cable. Step 3334 places the connector that was attached to the cable by station 90 into connector nest 1108 of cable reeling mechanism 70. When controller 3002 detects that the nest 1108 has closed on the connector, cable transport mechanism 54 opens its connector clamp 614 to release the connector that is now in cable reeling mechanism 70. Step 3336 moves cable transport mechanism 54 to its left most position to align the transport mechanism's cable clamp 584 over station 50 and its connector clamp 614 over station 60. Decision block 3338 determines whether there are more cables to build. If there are more cables, Block 3339 waits until the cable at station 70 has been released from cable pull station 42 as signified by the cutters having operated and released (FIG. 43, step 3474). Step 3340 starts module Desheath and Comb 1, and then module Main 1 continues with step 3298. If there are no further cables to build, step 3342 asks PC 3000 for further instructions.

Figure 40A:
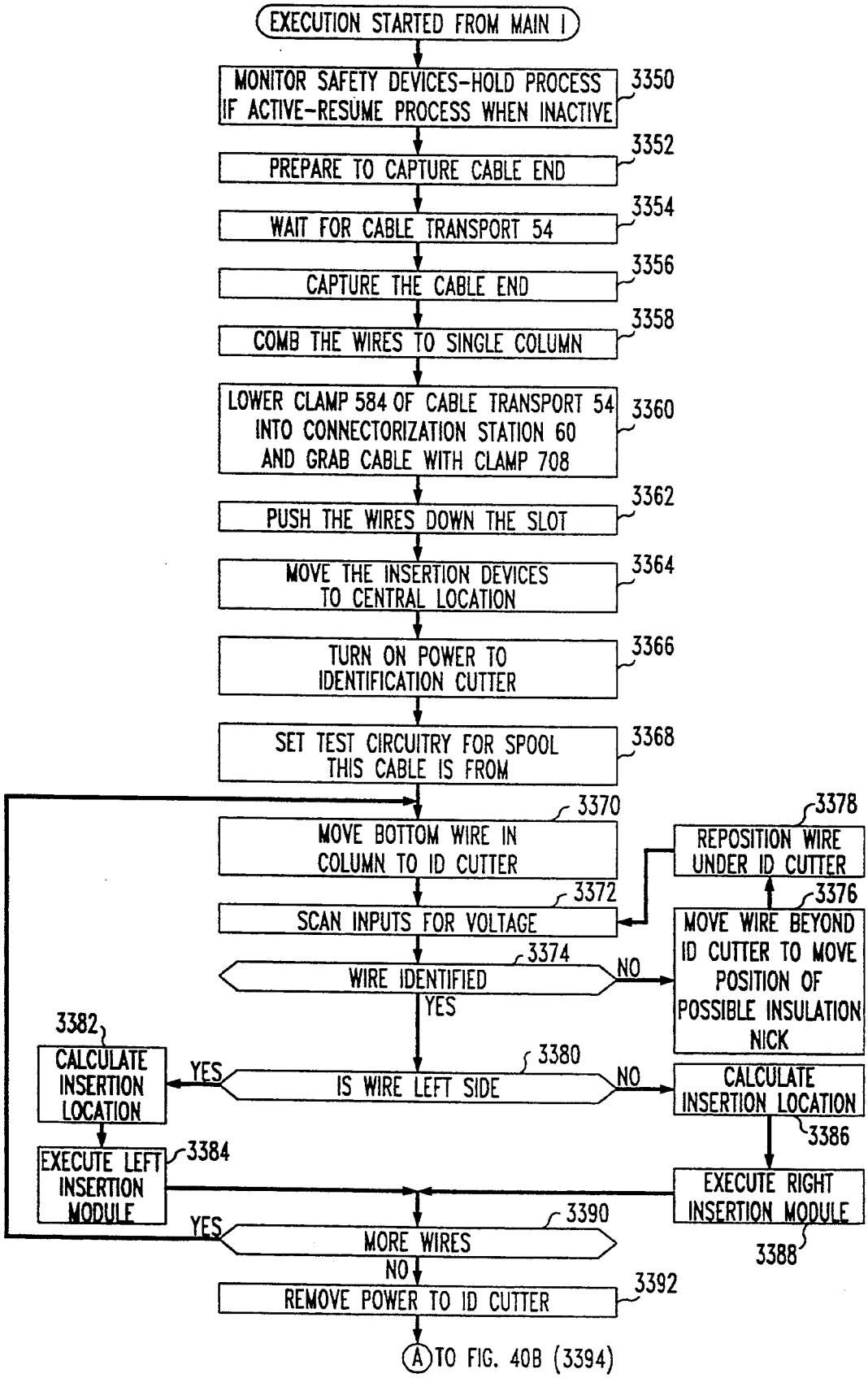
FIGS. 40a and b are a flow chart of program module Identify and Connectorize 1.
Figure 40B:
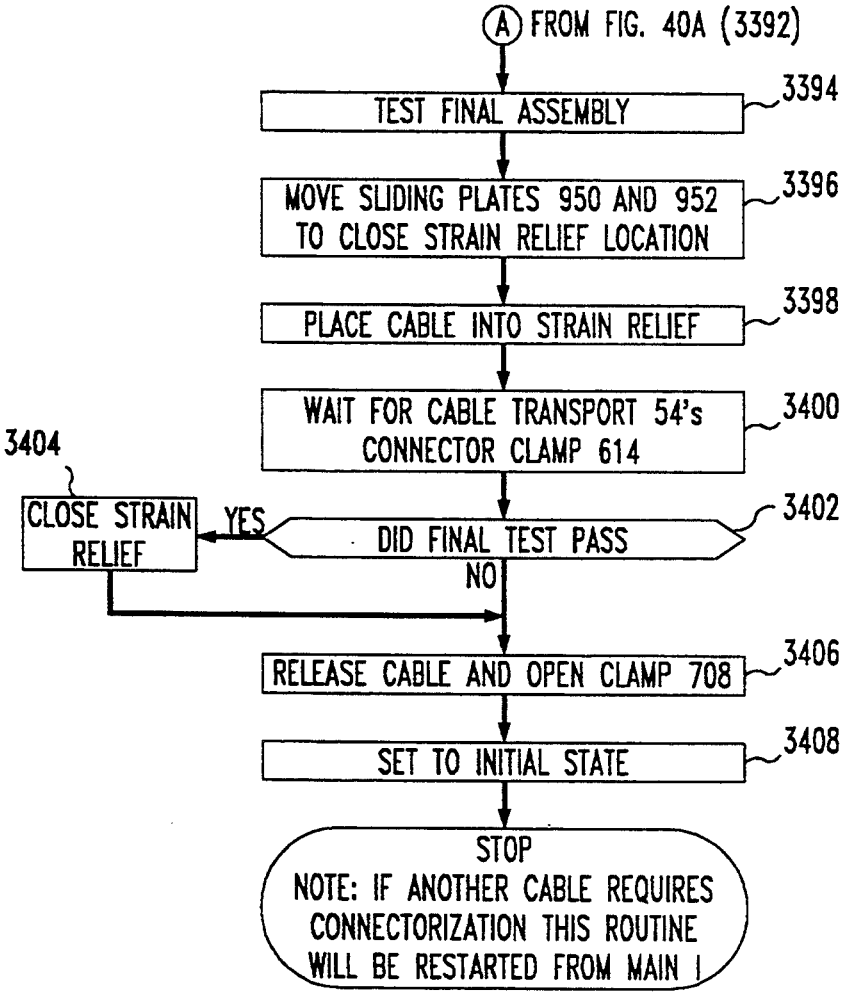

FIGS. 40*a* and *b* illustrate a flow chart for module Identify and Connectorize 1. It should be recalled that this module is activated by step 3326 module Main 1. Step 3350 checks safety devices such as safety mats and light curtains determine if one of the safety devices has been activated by someone entering an area that places them in danger. If so, the program does not proceed until the devices are deactivated. In step 3352 station 60 prepares to capture the desheathed and combed end of cable 190. This step includes moving base plate 746 of station 60 to its rear most position and separating guide plates 760 and 762. In step 3354 controller 3002 (or the module) waits for cable transport mechanism 54 to complete its move to the right which was started in step 3322 of module Main 1. This is detected by controller 3002 monitoring signals from the servo motor controller that moves cable transport mechanism 54 along gantry 114. After cable transport 54 has stopped moving so that cable clamp 584 and the desheathed and combed cable end held by the clamp are over station 60, step 3356 is executed. In steps 3356 and 3358, station 60 captures the conductors of the cable and combs them into a single column using guide plates 760 and 762. In step 3360, the module waits for cable transport 54 to lower cable clamp 584 so that cable clamp 708 of identify and connectorization station 60 can grasp the cable. (See step 3328 of Main 1). When controller 3002 detects that the cable clamp 708 is closed, transport 54 opens cable clamp. (Also see step 3328 of module Main 1). In step 3362, after transport 54 has transferred the cable to clamp 708, the conductors are pushed downward in the slot between conductor guide plates 760 and 762 by conductor feed mechanism 710. In step 3364 insertion devices 718 and 719 are moved to a central location. In step 3366 the 48 volts to identification cutter 716 are turned on. In step 3368, controller 3002 sets the starting address that will be used when it scans the addressable high speed digital bus lines that are connected to the circuitry which is used to identify conductors. Since the cable can be supplied by one of two spools, the starting address is set so that it corresponds to the test circuitry which is wired to the end of the spool supplying the cable. The spool supplying the cable is identified using the flag that was set in step 3256 of module Desheath and Comb 1. In step 3370 the conductor in notch 712 is moved to identifier 716. In step 3372 controller 3002 scans the inputs of the high speed digital bus that are attached to the connector at the end of the spool supplying the cable. The conductor is identified by determining which contact of the connector at the end of the spool has the 48 volts that is being supplied by identifier 716. Once identified the conductor can be inserted into the proper contact of connector 64. In step 3374 it is determined whether the conductor was identified by detecting the 48 volts at the spool's connector. If it was not, in step 3376, wheel 714 is rotated counter-clockwise past wire identifier 716 to move the conductor a small amount in a direction along the conductor and away from wheel 714. This movement repositions a nick in the insulation which may be causing a short circuit to the frame of station 60. In step 3378 the conductor is repositioned under identifier 716. If this procedure does not result in an identified wire, an error is reported to PC 3000 and operator intervention is required. At step 3380 it is determined whether the conductor goes to the left or right side of connector 64. At steps 3382 and 3384 the insertion location for the identified conductor is determined and then module Left Insert is started. If the conductor belongs on the right side of connector 64, steps 3386 and 3388 calculate an insertion location and start module Right Insert. The insertion locations are calculated using an insertion table loaded into the controller by PC3000. The table specifies which contact of connector 64 will receive the conductor based on which contact of the spool's connection had the 48 volts. In step 3390 it is determined whether there are any more wires to be attached. This is determined by keeping track of the number of conductors already inserted. If there are no more wires to be inserted, step 3392 removes the 48 volts from wire identifier 716. In step 3394, wired connector 64 is tested. This is carried out by Founding all of the contacts of connector 64 through the mandrel in station 60. The controller then checks for a ground at each of the digital bus inputs that are attached to the contacts of the connector at the end of the spool. At step 3396 sliding base plates 950 and 952 of station 60 move to align air cylinders 724 and 726 with the strain relief clamp of connector 64. In step 3398 cable clamp 708 is lowered to place the end of cable 190 within the strain relief. In step 3400, the module waits to detect that connected gripper 614 of transport 54 is lowered and grasps connector 64. This is detected using slotted optical switches positioned on cable transport 54 and the servo motor controller that moves transport 54. It should be noted that step 3314 in module Main 1 caused cable transport 54 to grip the connector. Also recall that tab 618 of clamp 614 helps to position cable 190 in the strain relief clamp. In step 3402 it is determined whether the test of step 3394 passed. If the test passes, connector strain relief clamp 722 is closed in step 3404. If it does not pass, 3404 is not executed and PC 3000 is notified to request an operator intervention. Step 3406 opens clamp 708 of station 60. Recall that step 3314 of module Main 1 detects clamp 708 opening 60 that it can move the cable and connector to cable reeling mechanism 70. In step 3408 station 60 is returned to its initial state.

Figure 41:
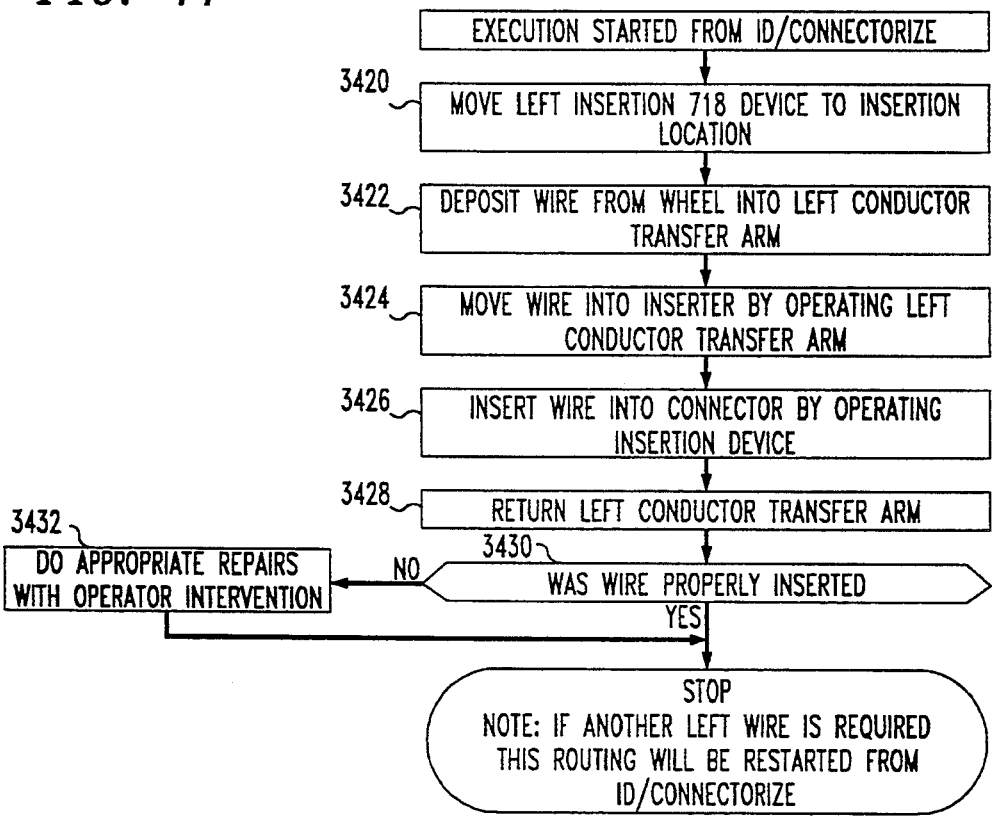
FIG. 41 is a flow chart of program module Left Insert.

FIG. 41 illustrates module Left Insert which begins execution as a result of step 3384 of the module Identify and Connectorize 1. Step 3420 moves left insertion device 718 which is mounted on base 950, to a location that aligns insertion blade 1078 with the proper contact of connector 64. In step 3422, wheel 714 is rotated counterclockwise to deposit the conductor in conductor transfer arm 824. In step 3424 conductor transfer arm is operated to place conductor within the insertion device. When microswitch mechanism 1054 detects the conductor's presence, step 3426 is executed to insert the conductor into the proper contact of connector 64 using air cylinder 956. In step 3428 the conductor transfer arm is returned to its starting position. In step 3430 the conductor is tested using the connector that is attached to the end of the spool supplying cable 190. This test involves determining whether the conductor is now grounded through the mandrel upon which connector 64 is mounted. If this test fails, PC 3000 is notified to request operator intervention in step 3432.

Figure 42:
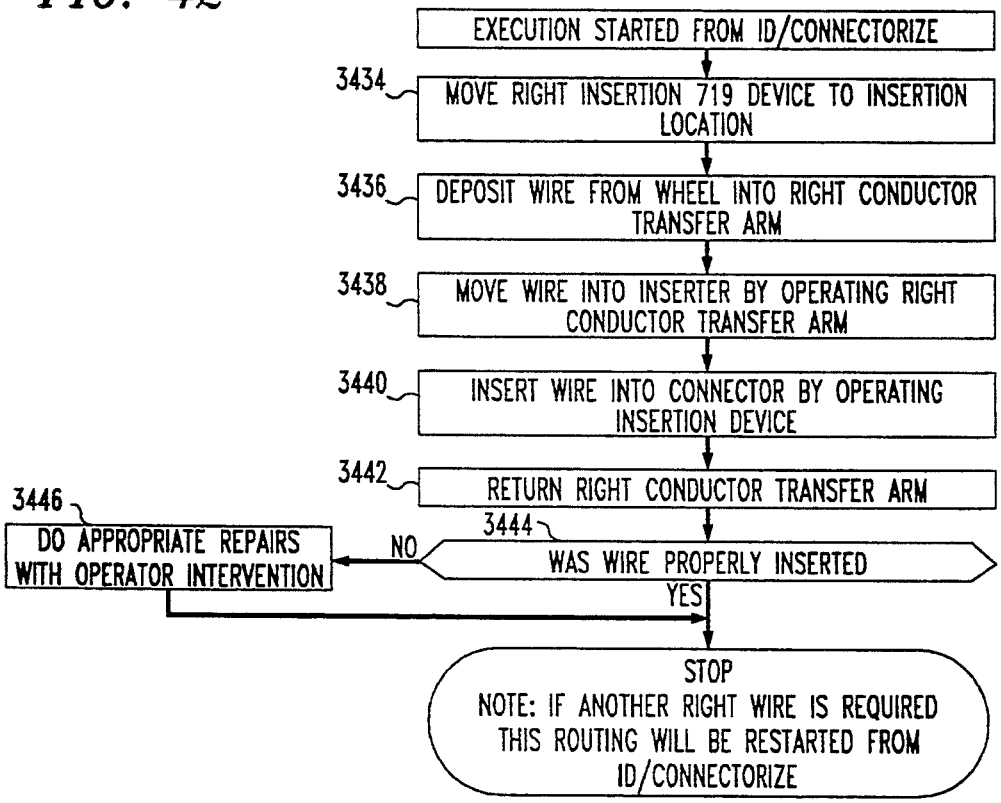
FIG. 42 is a flow chart of program module Right Insert.

FIG. 42 illustrates module Right Insert. This module is very similar to module Left Insert. Step 3434 moves right insertion device 719 to align insertion blade 1078 with the proper contact of connector 64. In step 3436 wheel 714 is rotated in a clockwise direction to place the conductor in right conductor transfer arm 826. The conductor is moved to insertion device 719 by operating the transfer arm in step 3438. In step 3440 air cylinder 958 of insertion device 719 is activated when the conductor contacts microswitch mechanism 1054. In step 3442 the transfer arm is returned to its starting position. In step 3444 the conductor is tested using the connector that is wired to the end of the spool. The conductor is tested to see that it is grounded through the mandrel upon which connector 64 is mounted. If this test fails, step 3436 requests operator intervention through PC 3000.

Figure 43A:
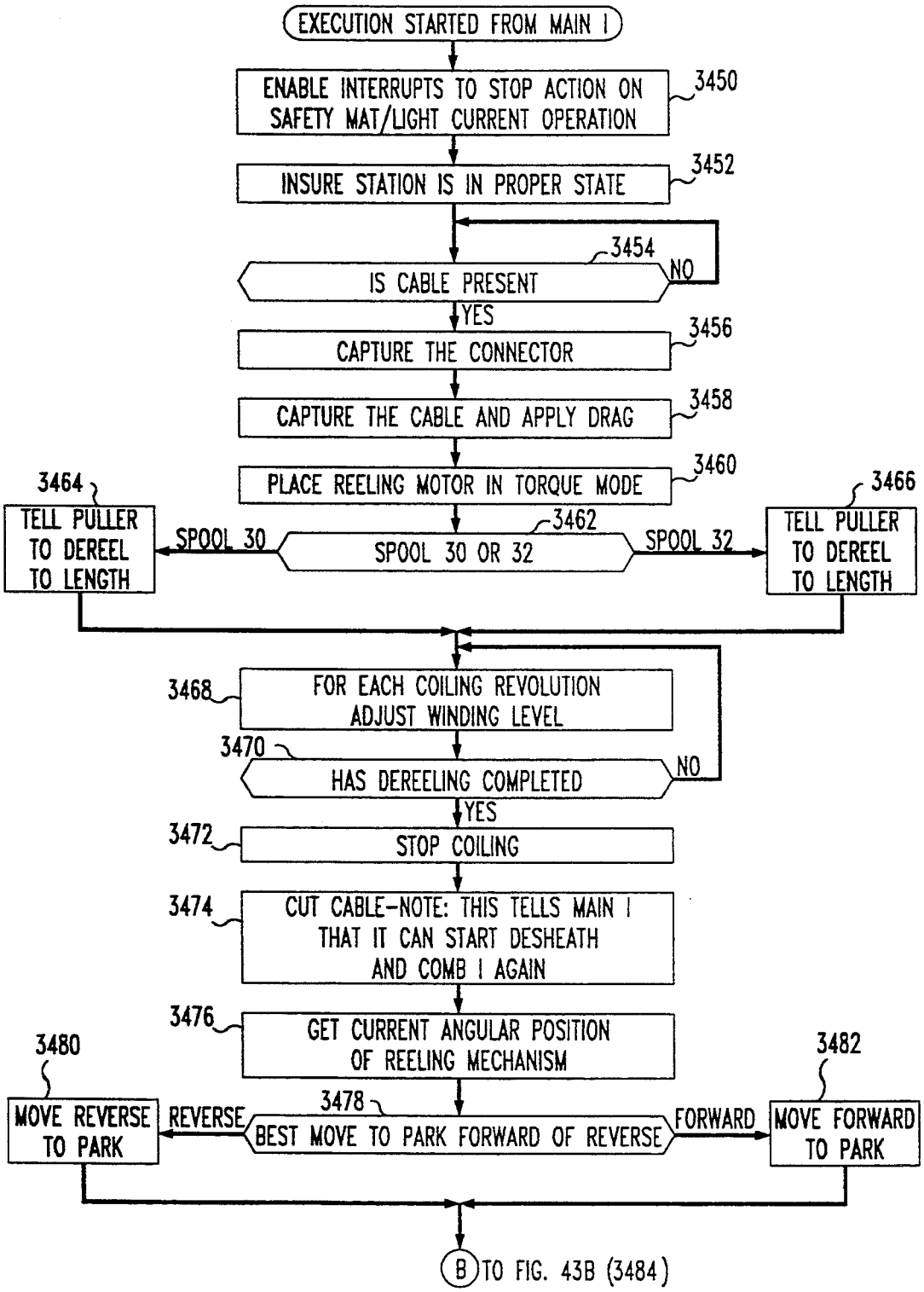
FIGS. 43a and b are a flow chart of program module Reel Cable.
Figure 43B:
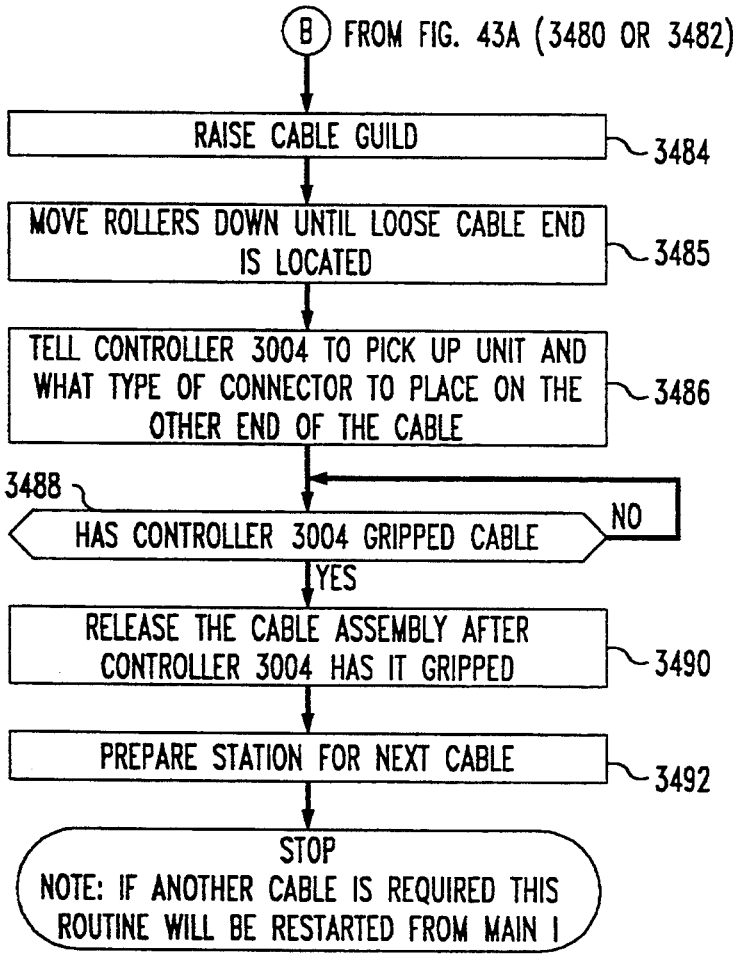

FIGS. 43*a* and *b* illustrate module Reel Cable which began execution as a result of step 3332 of module Main 1. Step 3450 enables interrupt associated with safety mats and light curtains in the area of cable locating mechanism 74 and cable positioning mechanism 72. Step 3452 ensures that cable reeling mechanism 70, cable locating mechanism 74 and cable positioning mechanism 72 are ready to accept a new cable that transport mechanism 54 will provide to these devices. Step 3454 is used to determine whether a new cable is present by detecting when the slotted optical switches and the servo motor controller of cable transport 54 indicate that connector clamp 614 of cable transport 54 is positioned over cable reeling mechanism 70 and has been lowered to place connector 64 in connector nest 1108 of cable reeling mechanism 70. When this condition is detected, step 3456 extends the fingers of reeling mechanism 70 and thereby grasps connector 64. It should be noted that at this point, module Main 1 detects connector nest 1108's closed position and causes transport 54 to release connector 64 and move to the far left end of its travel. (Step 3336 of module Main 1). Step 3458 captures the portion of the cable draped between cable pull mechanism 42 and cable reeling mechanism 70 by first raising capture bracket 1200 and roller 1220 to an upper position, and then rotating rollers 1206, 1208 and 1220 to a horizontal position. In addition, the dereeling mechanisms associated with the cable to be reeled is set to apply a drag. In step 3460 the servo controller that controls the motor which rotates cable reeling mechanism 70 is placed in a constant torque mode. At step 3462 it is determined which set of wheels of cable puller 42 should be activated to pull the cable from the proper cable spool using the flag that was set in step 3256 of module Desheath and Comb 1. If spool 30 is being used, the servo motor controller associated with the motor that turns knurled wheels 250, 252, 244 and 246 of cable pull mechanism 42 is instructed to unreel the proper length. Likewise, in step 3466 the servo motor controller that controls the motor that turns the knurled wheels 270, 272, 264 and 266 of cable pull mechanism 42 is instructed to unreel the proper length of cable. In step 3468 the vertical position of rollers 1220 and 1222 are adjusted to control the level of the windings as they form on cable reeling mechanism 70. In step 3470 it is determined whether the total length of cable has been unreeled by detecting a signal from the servo motor control that is operating the knurled wheels. If the total length is dereeled, step 3472 stops the motor that rotates cable reeling mechanism 70 and instructs the servo controller that controls the motor of mechanism 70 to place itself in a position control mode. In step 3474, the cable is cut free from the spool using the appropriate cutter of cable pull mechanism 42. This step also sets a flag in module Main 1 so that it can start module Desheath and Comb 1 and begin operation on the next assembly (see FIG. 38, step 3339). In step 3476 the current angular position of the reeling mechanism is determined. In step 3478 it is determined which way to rotate reeling mechanism 70 so that it can reach a parked position. If sufficient cable remains, the reeling mechanism 70 is rotated to park position while reeling additional cable. In steps 3480 and 3482 reeling mechanism 70 is moved to its parked position. Step 3484 raises cable guide 1184 of cable positioning mechanism 72 to an upper position to facilitate grasping the cable with clamp 1362 of rotating cable transport mechanism 80. In step 3484 rollers 1220 and 1222 of cable locating mechanism 74 are moved downward to create a loop in cable 190. The controller continues to move these rollers downward until the optical sensor 1230 of cable locating mechanism 74 locates the end of cable 190. In step 3486 controller 3002 signals controller 3004 that it should use cable transport 80 to pick up coiled cable 190 at cable reeling mechanism 70 so that controller 3004 can complete manufacturing the cable assembly. This signaling occurs using two lines of the digital buses. One line indicates that a female connector should be placed on the other end of the cable by identify and connectorization mechanism 96 and a second line indicates that a male connector should be placed on. If both lines are activated, it indicates that this is the last cable assembly being manufactured. Step 3488 determines whether controller 3004 has used cable transport 80 to grip connector 64 which is located in nest 1108 of cable reeling mechanism 70. This is detected by monitoring another bit of the digital bus. Controller 3004 uses this bit to indicate that it has gripped the connector. Step 3490 resets the digital bus lines used to signal controller 3004 and releases the coiled cable assembly so that controller 3004 can remove the cable assembly using cable transport assembly 80. The cable assembly is released by moving rollers 1206, 1208 and 1220 to their vertical positions and by retracting the fingers of cable reeling mechanism 70. In step 3492 cable reeling mechanism 70, cable positioning mechanism 72 and cable locating mechanism 74 are prepared to receive the next cable and the safety interrupts activated by step 3450 are disabled.

Figure 44A:
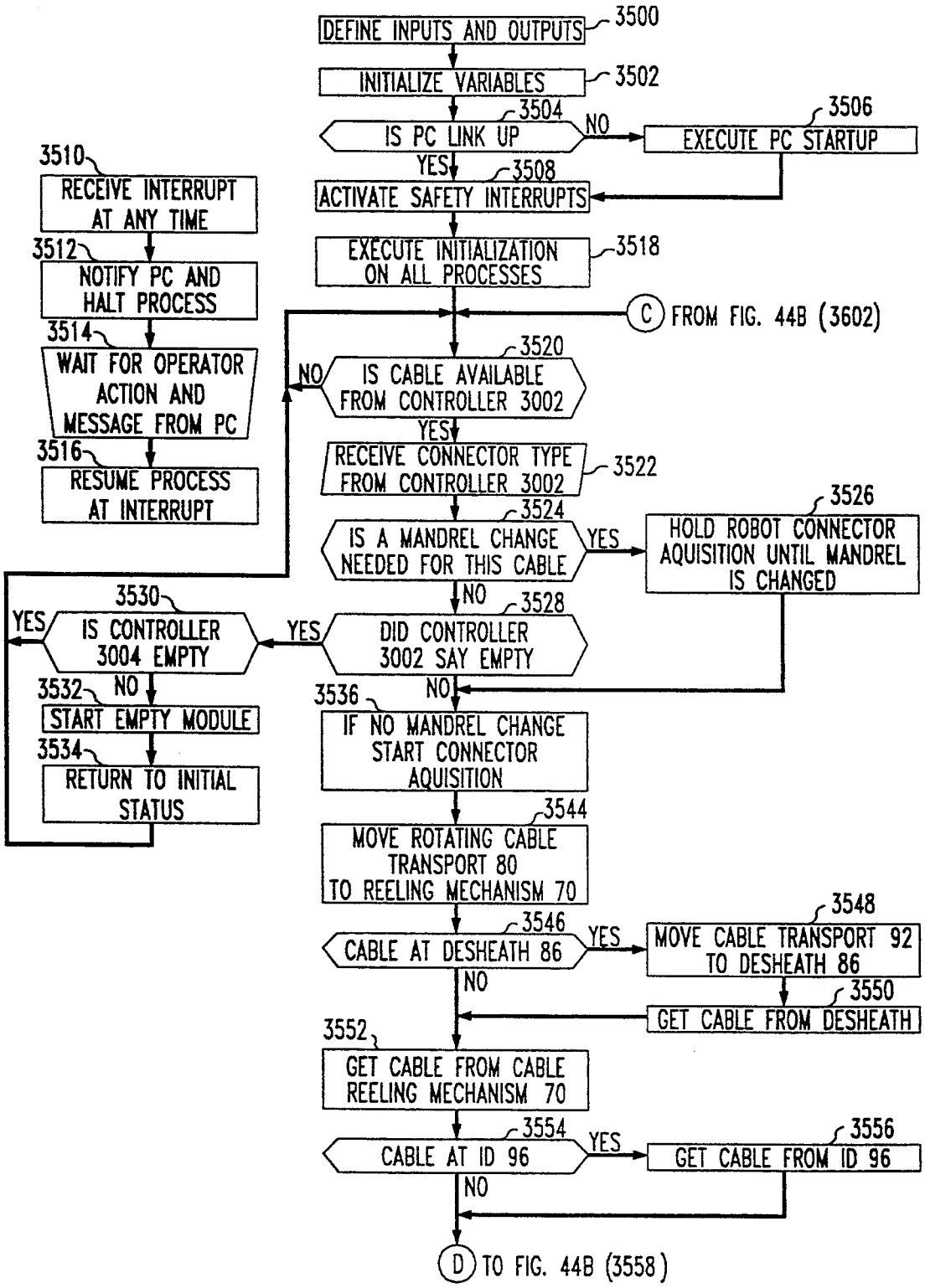
FIGS. 44a and b are a flow chart of program module Main II.
Figure 44B:
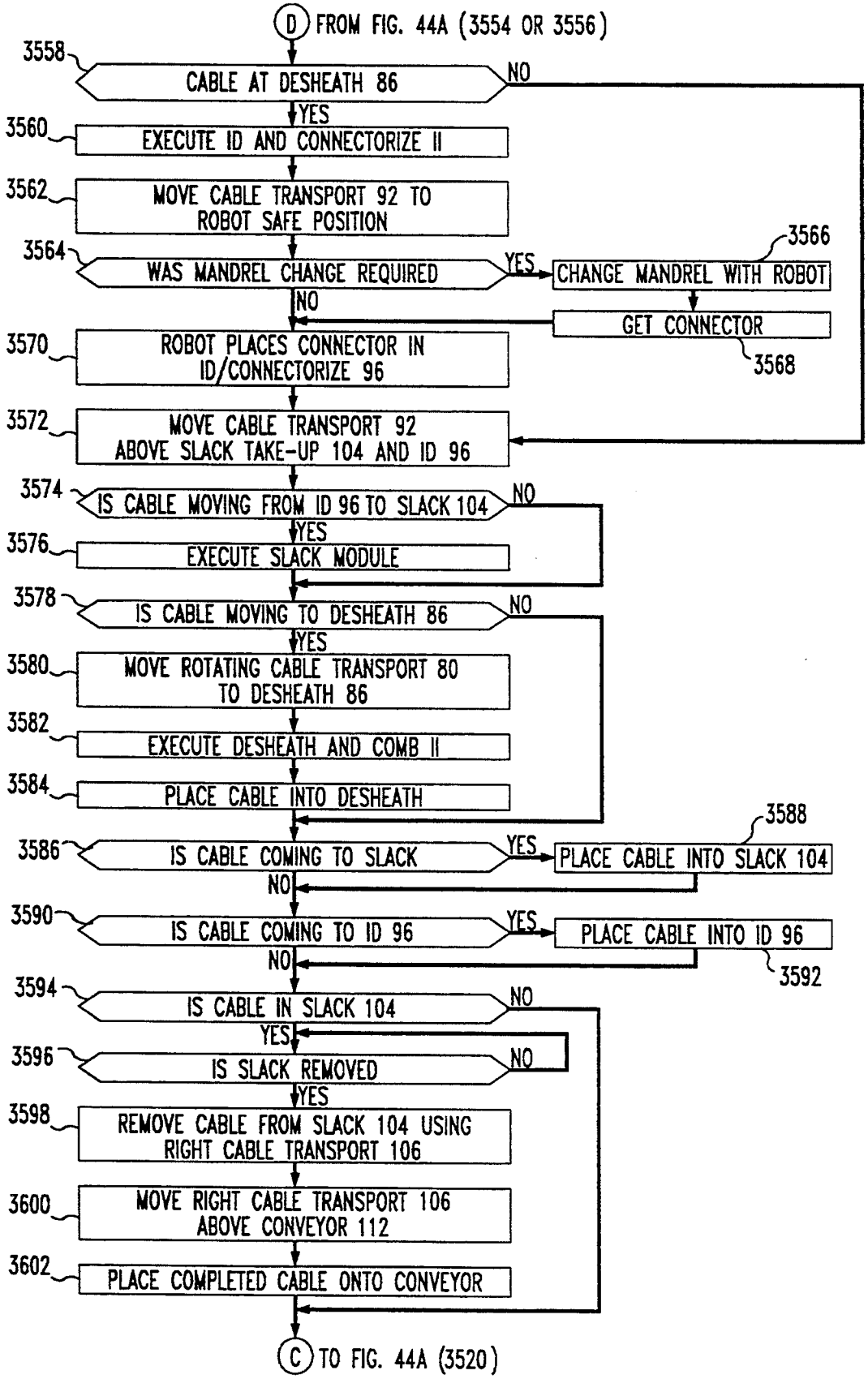

FIGS. 44*a* and *b* are flow charts of module Main II executed by controller 3004. It should be noted that controller 3004 operates in parallel to controller 3002. The two controllers operate independently of each other except for the signals used to indicate that controller 3002 has completed work on a cable assembly, and the signals used to indicate that controller 3004 has acquired the cable assembly using rotating cable transport mechanism 80. In a fashion similar to that of module Main 1, steps 3500 and 3502 define inputs, outputs and interrupts on the high speed digital bus and initialize variables. Step 3502 also sets an empty software flag as part of the initialization. Steps 3504 and 3506 establish or check the RS232 link between controller 3004 and PC 3000 in a fashion similar to steps 3242 and 3244 of module Main 1. In step 3508 the safety interrupts associated with devices such as safety mats and light curtains are activated. Steps 35 10 through 3516 are used to process interrupts. In step 3518, mechanisms are moved to an initial position. In step 3520 it is determined whether signals from controller 3002 indicate that a coiled cable assembly is ready in cable reeling mechanism 70. In step 3522, controller 3004 sets a software flag to indicate whether the connector to be attached at station 96 is male or female based on the signals received from controller 3002. In step 3524, it is determined whether the mandrel in station 96 should be changed based on the gender of the connector specified by the signals from controller 3002. If the mandrel must be changed, step 3526 is executed which puts a hold on the Acquisition module that directs robot 100 to obtain a connector from the shipping box and sets a mandrel change software flag. In step 3528 it is determined whether controller 3002 indicated that mechanisms should be emptied. Recall that this information is passed to controller 3004 by controller 3002 setting both the male and female indicator signals. If controller 3002 indicated that mechanisms should be emptied, step 3530 checks to determine whether mechanisms are already emptied by checking the empty software flag. If the flag is set, step 3520 is executed. If the flag is not set, step 3532 starts module Empty which removes all materials from the mechanisms. Step 3534 returns mechanisms to their initial status and then step 3520 is executed. In reference to step 3528, if controller 3002 did not indicate that mechanisms should be emptied, step 3536 is executed to begin the Acquisition module. Note that if step 3526 puts a hold on the Acquisition module, step 3536 does not start the acquisition module.

Figure 45:
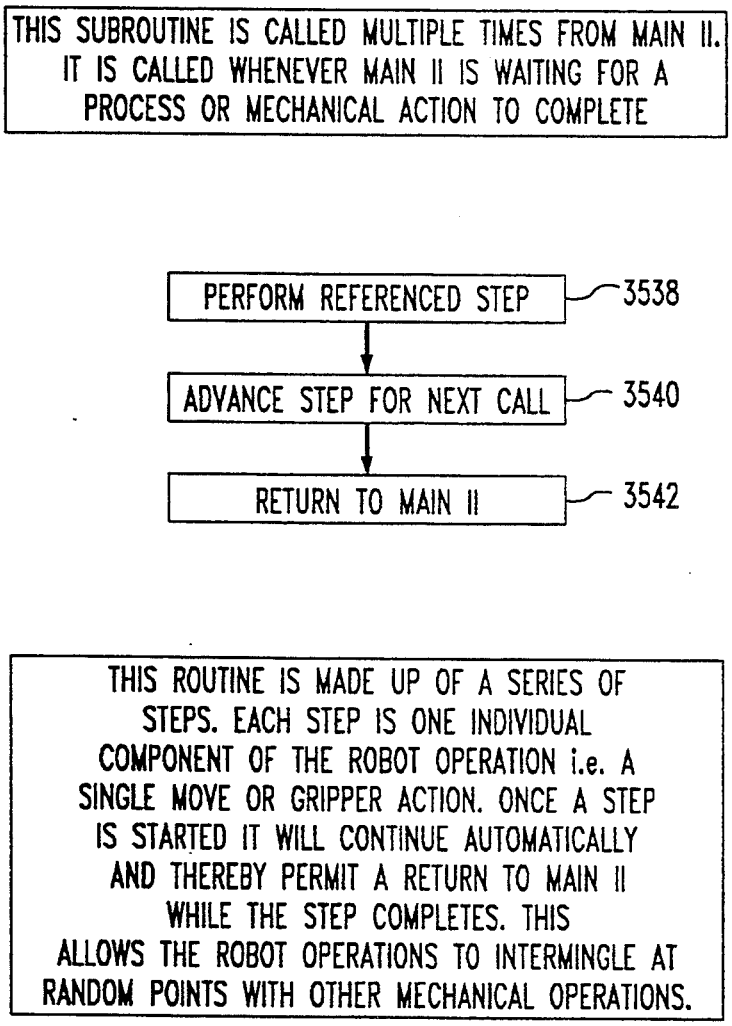
FIG. 45 is a flow chart of subroutine Acquisition.

FIG. 45 is a flow chart of the Acquisition module. The Acquisition module is a subroutine, that after being started, is called by Main II whenever Main II is waiting for mechanical process to complete. The routine includes step 3538 which instructs robot 100 to perform the referenced step of its acquisition routine. Step 3540 advances the referenced step counter and step 3542 returns to Main II. The steps performed by the robot are determined by the relative positions of the robot, connector shipping boxes 102 and connector locating nest. The robot is taught each step in the program according to the manufacturer's instructions. Each step is then given a reference number and the acquisition routine instructs the robot to perform whatever step is currently referenced. If the reference counter is greater than the number of steps included in the instructions for acquiring a connector, the acquisition routine simply returns to module Main II without performing any operations. The final steps of this routine has the robot holding a connector in a parked position that will not interfere with the motion of cable transport mechanism 92. By calling this subroutine whenever main is waiting for a mechanical action, the robot's operations can be controlled without interfering with the normal operation of Main II. It should also be noted, that once the robot has been instructed to perform a referenced step, the robot performs the step automatically without further intervention by controller 3004.

Returning to module Main II, step 3544 moves rotating cable transport mechanism 80 to a position above cable reeling mechanism 70. Step 3546 determines whether a cable is located at desheath and comb station 86 by checking to see whether the cable clamp of cable feed mechanism 84 is closed. If the clamp is closed step 3548 moves coiled cable transport mechanism 92 to the left so that left cable transport 90 is positioned over desheath and comb station 86. It should be noted that this action also places right cable transport 106 over station 96. In step 3550 cable clamp 1566 of left cable transport 90 closes on the cable held by cable feed mechanism 84's cable clamp. When cable clamp 1566 of left cable transport 92 closes, module Desheath and Comb II opens cable feed mechanism 84's clamp in step 3652. In step 3552, rotating cable transport 80 prepares to remove coiled cable 190 from cable reeling mechanism 70 by lowering support plate 1330 over cable reeling mechanism 70 to grasp connector 64, the coiled portions of cable 190 and the portions of cable 190, held by cable positioning mechanism 72 and cable locating mechanism 74. After performing this operation controller 3004 sends a signal to controller 3002, via the digital bus, to indicate that it has grasped coiled cable 190. Once this signal has been received, controller 3002 deactivates the signals that indicated whether a male or female connector should be used at station 96 and commands cable reeling mechanism 70 and cable locating mechanism 74 to release cable 190 and connector 64. When controller 3004 detects that the male/female connector signals are inactive, step 3554 is executed. Step 3554 determines whether there is a connectorized cable at station 96. This is determined by examining the condition of cable clamp 708 at station 96. When clamp 708 is closed and in a lowered position, it indicates that a connectorized cable is ready to be moved from station 96. Recall that step 3548 positioned right cable transport 106 over station 96. In step 3556 right cable transport 106 grasps the cable assembly in identify and connectorization station 96. This assembly includes the coiled portion of the cable assembly held by coiled cable holding mechanism 88 and newly attached connector 98. In step 3558 it is determined whether left cable transport 90 of cable transport 92 grasped a cable located at desheath and comb station 86 using cable clamps 1566, 1630 and 1618. This is determined by checking to see if clamp 1566 is in a closed position. If left cable transport 90 grasped a cable at desheath and comb station 86, step 3560 begins execution of module Identify and Connectorize II. Module Identify and Connectorize II begins execution and waits to receive a cable from left cable transport 90. Step 3562 moves transport 92 to a position that places left cable transport 90 approximately halfway between stations 86 and 96, and right cable transport 106 halfway between station 96 and cable slack takeup mechanism 104. This provides sufficient clearance for robot 100, which has been waiting in a parked position, to place the connector that it is holding onto the mandrel of station 96. Recall that the parked position is a location where the robot does not interfere with the cable transport mechanism. In step 3564 it is determined whether a mandrel change is required by checking the mandrel change software flag that may have been set by step 3524. If the mandrel change flag is set, step 3566 clears the mandrel change flag and executes a series of steps that directs the robot to change the mandrel. It should be noted that if the mandrel change is required, the acquisition module that instructs the robot to obtain a connector and wait in a parked position is not executed earlier (see step 3526) so that the robot is free to change mandrels. Once the mandrel has been changed, step 3568 commands robot 100 to obtain a connector from box 102, reorient the connector using connector locating nest 1950 and then moves the horizontally-oriented connector to the parked position. It should be noted that if mandrel change was not required, step 3570 is executed after step 3564 and that the acquisition module started in step 3536 leaves the robot in the parked position. In step 3570 the robot arm is commanded to move from the parked position to place the connector on the mandrel of identify and connectorization station 96, and then move back to the parked position. Step 3572 moves cable transport 92 to the right to place left cable transport 90 over station 96 and right cable transport 106 over cable slack takeup mechanism 104. In step 3574 it is determined whether a cable is moving from station 96 to station 104. This is determined by looking at the status of connector clamp 1570 of cable transport 106. If clamp 1570 is closed, step 3576 is executed to start execution of the module Slack. The module Slack will operate in parallel to Main II during another time slice and then wait for right cable transport 106 of cable transport 92 to place the cable and connector into slack takeup mechanism 104 and sliding connector nest 108. In step 3578 it is determined whether a cable is moving from cable reeling mechanism 70 to desheath and comb station 86 by looking at connector clamp 1348 of rotating cable transport 80 to determine if the clamp is closed. If the clamp is closed, step 3580 moves rotating cable transport mechanism 80 to desheath and comb section 86. Step 3582 starts execution of module Desheath and Comb 2. This module runs in parallel with Main II during another time slice. Module Desheath and Comb II will begin execution and then wait for the cable from rotating cable transport 80. In step 3584 rotating cable transport 80 places the cable from cable reeling mechanism 70 into coiled cable holding mechanism 82 and cable feed and clamp mechanism 84. When Module Desheath and Comb II detects the position of cable transport 80, it grasps the cable using mechanisms 82 and 84. After detecting that connector nest 1404 of mechanism 82 has closed, transport 80 releases the cable and step 3586 is executed. Step 3586 determines whether a cable is to be placed into slack takeup mechanism 104 and sliding connector nest 108 by looking at connector clamp 1568 of right cable transport 106. If the clamp is closed, step 3588 commands right cable transport 106 to place the coiled cable into cable slack takeup mechanism 104 and sliding connector nest 108. This step also sets a software flag that indicates a cable assembly has been placed into mechanism 104 and 108. When module Slack detects the position of transport 106, it grasps the cable using mechanisms 104 and 108. After module Main II detects that cable nest 1764 of mechanism 104 has closed, right transport 106 releases the cable assembly and moves to an upper position. Step 3590 examines cable clamp 1566 of left cable transport 90 to determine whether a cable is being passed to identify and connectorization station 96. If the clamp is closed, step 3592 is executed so that left cable transport 90 transfers a cable assembly to station 96. When module Identify and Connectorize detects the position of left cable transport 90, it grasps the cable assembly using coiled cable holding mechanism 88 and cable clamp 708 of station 96. After module Main II detects that fingers 1704 of mechanism 88 have extended, left cable transport 90 releases the cable assembly and moves to an Upper position, and step 3594 is executed. Step 3594 is used to check the software flag that indicates whether a cable assembly was placed into stations 104 and 108. If the flag is set, step 3596 is executed which checks a software flag from the Slack module which indicates whether or not the Slack module has completed its operation. If the software flag from the Slack module indicates that the slack has been removed from the cable, step 3598 is executed so that the flag from step 3588 is cleared, and right cable transport 106 grasps and then removes the reeled and tied cable assembly from slack takeup mechanism 104. Right cable transport 106 does not attempt to lift able assembly from takeup mechanism 104 until controller 3004 detects that fingers 1762 of mechanism 104 have been retracted by the Slack module. The Slack module retracts fingers 1762 after it detects that right cable transport has grasped the cable assembly. Step 3600 moves cable transport 92 to its far right position so that right cable transport 106 is positioned above conveyor 112. Step 3602 instructs right cable transport 106 to place the completed cable assembly on conveyor 112. Step 3520 is executed after step 3602.

Figure 46:
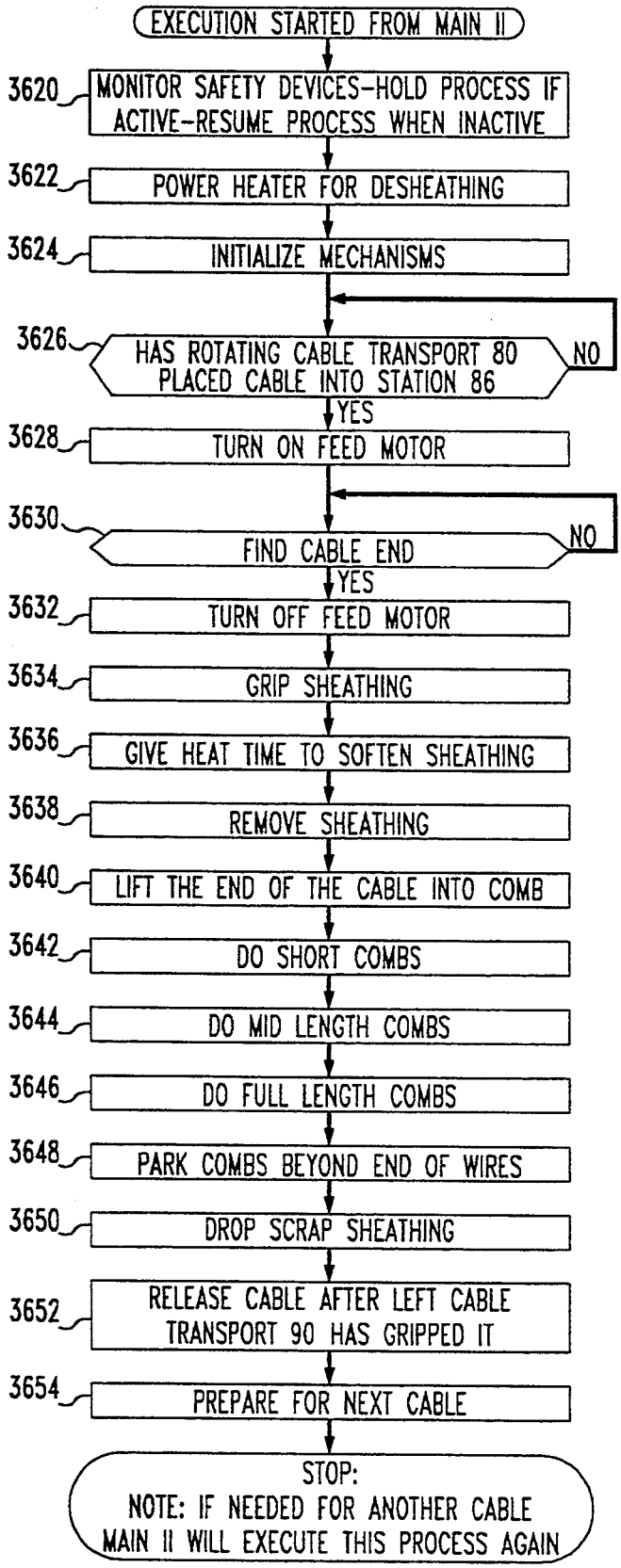
FIG. 46 is a flow chart of program module Desheath and Comb II.

FIG. 46 is a flow chart for module Desheath and Comb II. Recall that module Desheath and Comb II was started by step 3582 of module Main II. Module Desheath and Comb II is somewhat similar to module Desheath and Comb 1 executed by controller 3002. Step 3620 is used to check safety devices such as safety mats and light curtains to determine whether someone may be injured by the mechanisms used by this module. Step 3622 supplies power to desheath and comb station 86's heater 354 which softens the cable's desheathing. Step 3624 places the mechanisms of desheath and comb station 86 in an initial position. Step 3626 is used to determine whether rotating cable transport 80 has placed a cable from cable reeling mechanism 70 into station 86. This is determined by detecting that transport 80 is positioned at station 86 with cable clamp 1348 closed. After rotating cable transport 80 positions the cable at station 86, step 3628 gasps the cable using coiled cable holding mechanism 82 and cable clamp and feed mechanism 84. After detecting that transport 80 has released the cable (recall module Main II, step 3584) and moved to an upper position, step 3628 activates feed motor 1504 of cable clamp and feed mechanism 84. This feeds the end of cable 190 into the desheath section of station 86. Step 3630 uses an optical sensor in the desheath section of station 86 to determine when the end of the cable has been fed into the station, and then step 3632 turns off feed motor 1504 of cable clamp and feed mechanism 84. Step 3634 grips the sheathing using blades 386, 388, 392 and 396, and closes cable clamp 1508 of mechanism 84. Step 3636 allows the sheathing to soften by waiting approximately four seconds, and then step 3638 removes the sheathing. Step 3640 moves cable clamp 1508 to its upper position to place the desheathed end of the cable into the comb station. Steps 3642 through 3646 perform combing operations and step 3648 parks the combing mechanism beyond the end of the desheathed and combed conductors. Step 3650 drops the scrap sheathing held by clamp 423. Step 3652 opens cable clamp 1508 of mechanism 84 and retracts fingers 1406 of mechanism 82 after detecting that left cable transport 90 has gasped the cable. This is detected by monitoring outputs from cable transport 92's servo motor controller that indicate when left transport 90 is positioned over station 86, and by monitoring switches that indicate when cable clamp 1566 is in its lower position and closed. Step 3654 then prepares station 86 to receive the next cable.

Figure 47A:
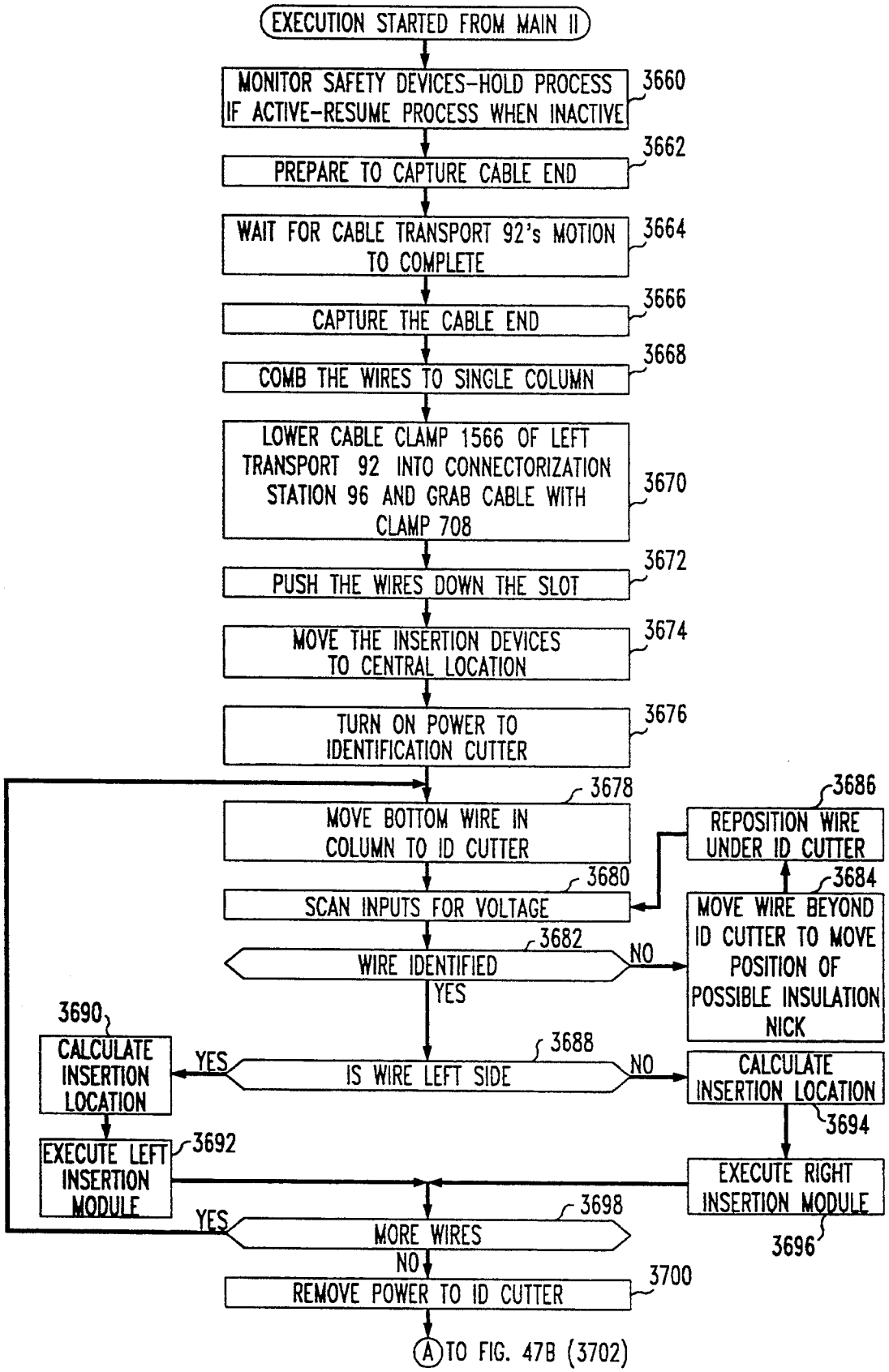
FIGS. 47a and b are a flow chart of program module Identify and Connectorize II.
Figure 47B:
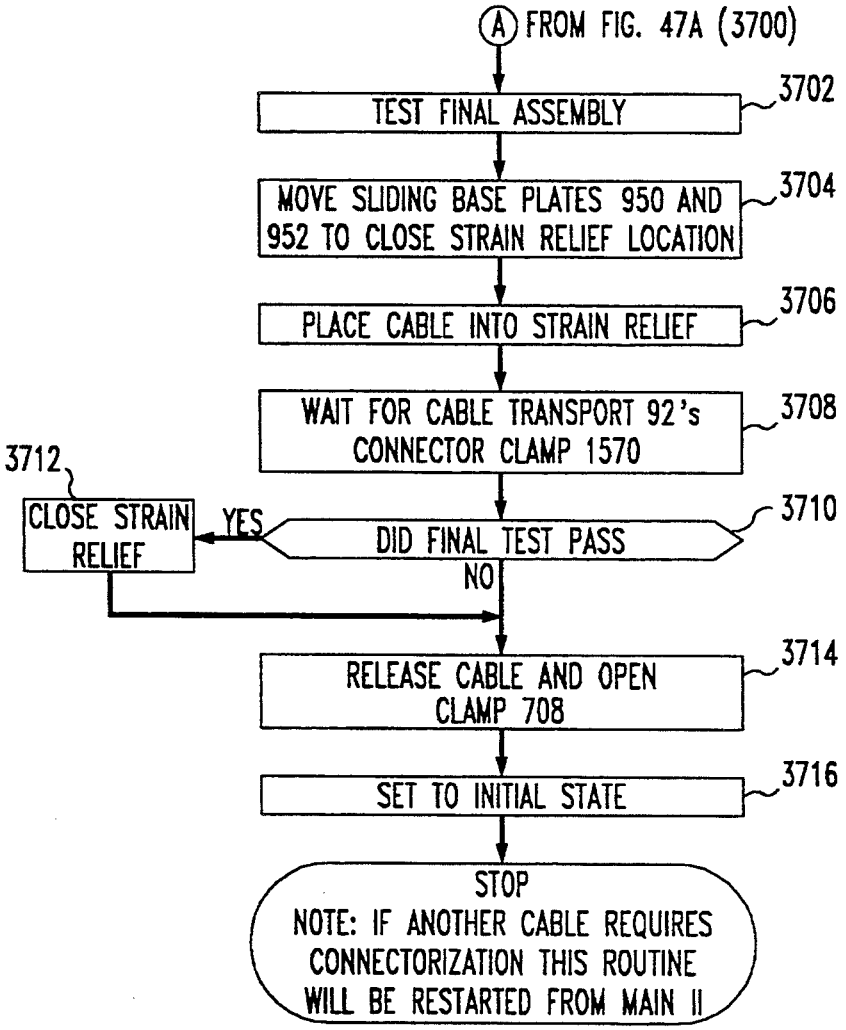

FIGS. 47*a* and *b* illustrate module Identify and Connectorize II. This module is similar to module Identify and Connectorize 1 which is executed by controller 3002. This module begins execution as a result of step 3560 of module Main II. Step 3660 monitors devices such as safety mats and light curtains to determine if execution of the operation will be a danger to personnel. The process is put on hold until safety devices indicate that the danger is not present. Step 3662 prepares station 96 to capture the desheathed and combed end of a cable. Step 3664 monitors the outputs of the servo motor controller of cable transport 92 to determine whether left cable transport 90 is positioned in front of station 96. When left cable transport 90 is positioned at station 96, step 3666 captures the combed end of the cable by extending and then closing guides 760 and 762. Step 3668 combs the conductors into a single column positioned in a slot between guides 760 and 762 by retracting air cylinder 748. Step 3670 waits for cable clamp 1566 of left cable transport 92 to be lowered and then grips the cable using cable clamp 708 of station 96 and cable holding mechanism 88. At this point, cable clamp 1566 of left cable transport 92 releases the cable. (Recall step 3592 of Main II). Step 3672 pushes the conductor down in the slot between guides 760 and 762 using conductor feed mechanism 710. Step 3674 moves insertion mechanisms 718 and 719 to a central location along connector 98. Step 3676 turns on the 48 volts to identification cutter 716. Step 3678 moves the conductor in notch 712 of wheel 714 under identification cutter 716. In step 3680 controller 3004 scans the digital bus inputs that are wired to the connector nest of coiled cable holding device 88 so it can monitor the contacts of the connector in the nest to detect the 48 volts provided by wheel 716. In step 3682 it is determined whether the conductor has been identified by detecting the 48 volts. If it has not, the conductor may have a short circuit against the frame of station 96. This is remedied by step 3684 which rotates wheel 714 in a counter-clockwise direction past cutter 716 to shift the conductor's position and remove the short circuit. Step 3688 rotates wheel 714 to place the conductor back under cutter 716. If this process does not result in an identification of the conductor, operator intervention is requested through PC 3000. When the conductor has been identified, step 3688 determines whether the conductor will be wired to the left or right side of connector 98. If the conductor is to be attached to the left side of the connector, step 3690 calculates the insertion location for insertion device 712 and step 3692 starts execution of module Left Insert. If the conductor is to be wired to the right side of connector 98, step 3694 calculates the insertion location for insertion device 719 and 3696 starts execution of module Right Insert. The insertion locations are calculated using an insertion table loaded into controller 3004 by PC 3000. The table specifies which contact of connector 98 will receive the conductor based on which contact of the connector in nest 1702 of mechanism 88 had the 48 volts. Step 3698 determines if there are more wires to be attached to connector 98. This is determined by keeping track of the number of wires inserted and having knowledge from PC 3000 which includes the total number of contacts on the connector. In step 3700, the 48 volts are removed from cutter 716. In step 3702 a final test is performed by once again monitoring the digital bus inputs attached to the contacts of the connector in nest 1702 of coiled cable holding mechanism 88. This test involves checking to see if each contact of the connector in nest 1702 is grounded by the grounded mandrel of station 96. Step 3704 moves sliding base plates 950 and 952 to align air cylinders 724 and 726 with the strain release clamp of connector 98. Step 3706 moves cable clamp 708 of station 96 to its lower position and thereby places the end of cable 90 into the strain relief clamp of connector 98. Step 3708 waits until connector clamp 1570 of right cable transport 106 has been lowered onto connector 98 and grasps the connector so that tab 1668 of clamp 1570 assists in holding the end of cable 190 in the strain relief clamp. This is detected by using the slotted optical switches on right cable transport 106 and the outputs from the servo motor controller of cable transport 92. In step 3710 it is determined whether the test of step 3702 was passed. If the test was passed, the strain relief clamp is closed in step 3712 using air cylinders 724 and 726. If the test was not passed, a message is sent to PC 3000 that requests operator intervention. In step 3714, cable clamp 708 of station 96 and fingers 1704 of mechanism 88 release the cable, and wait for right cable transport to remove the cable assembly (see step 3556 of Main II). After detecting that connector clamp 1568 is closed and moved to an upper position, step 3716 returns to its initial state.

Figure 48A:
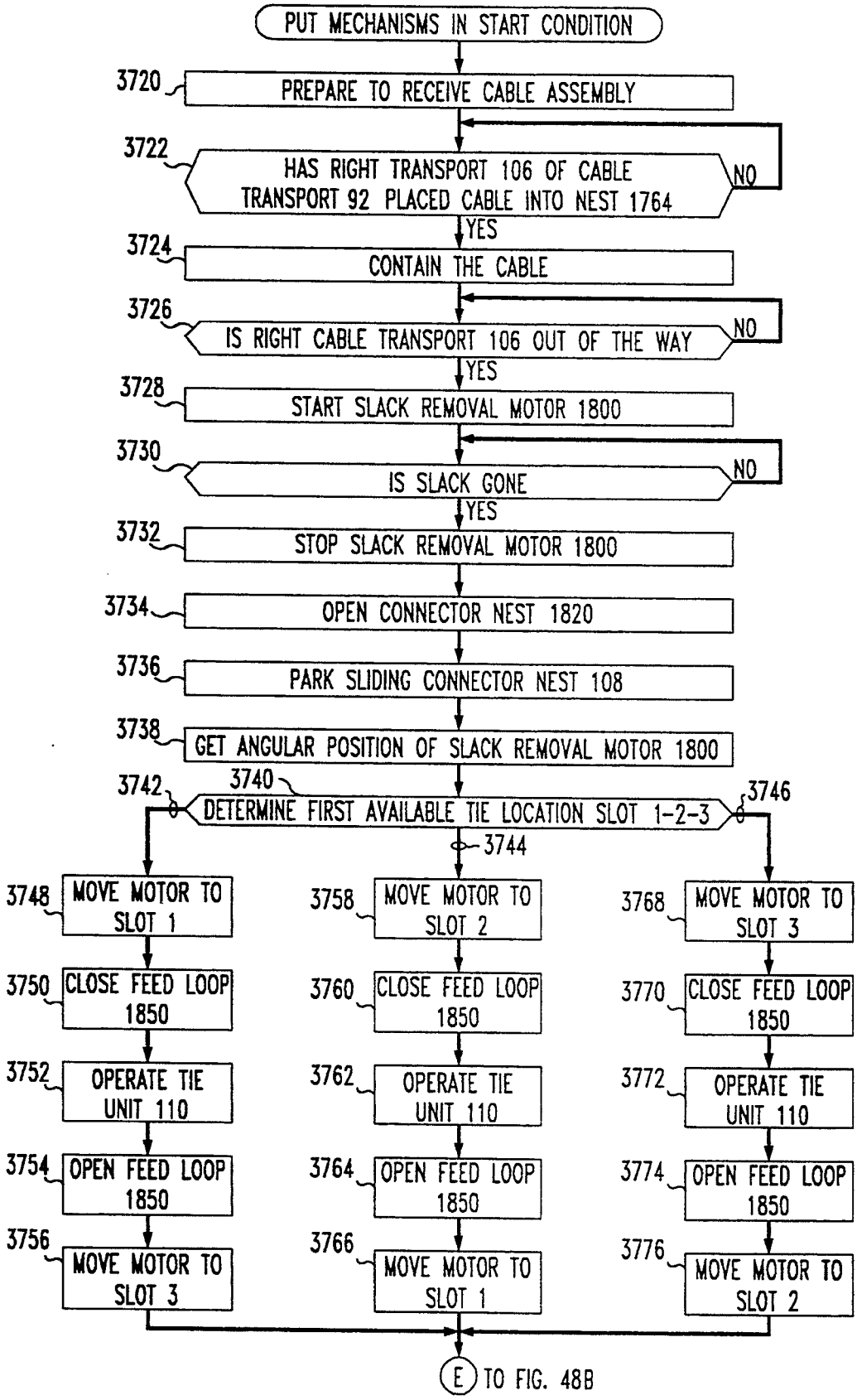
FIGS. 48a and b are a flow chart of program module Slack.
Figure 48B:
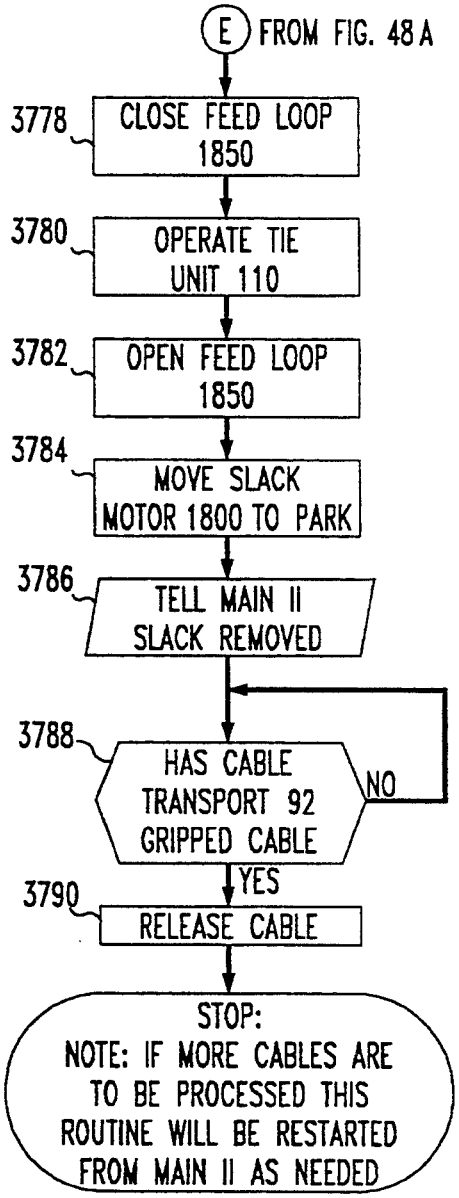

FIGS. 48*a* and *b* are flow charts of the Slack module, which removes the loop that was placed in the cable assembly by locating mechanism 74. Execution of the Slack module begins as a result of step 3576 of module Main II. Step 3720 prepares slack takeup mechanism 104 and sliding connector nest 108 to receive the cable assembly from cable transport 92 and clears a flag that indicates when the slack has been removed from the cable. Step 3722 determines whether cable transport 92 has placed the cable assembly into cable slack takeup mechanism 104 and sliding connector nest 108. This is determined by detecting when right cable transport 106 is positioned over cable slack mechanism 104 with its connector clamps extended to their lower position. In step 3724 cable slack mechanism 104 extendeds its fingers to grasp the coils of the coiled cable assembly and sliding connector nest 108 grips the connector held by connector clamp 1570 of right cable transport 106. Step 3726 checks to make sure that right cable transport 106 has retracted so that it does not interfere with the slack removal process. (See step 3588 of Main II). Step 3728 starts motor 1800 that rotates slack takeup mechanism 104. In step 3730 it is determined whether the slack has been taken up by the rotation of mechanism 104 by detecting when sliding connector nest 108 reaches the end of its travel in the direction of cable takeup mechanism 104. When step 3730 determines that the slack has been removed step 3732 stops motor 1800 which rotates mechanism 104. Step 2734 opens the connector nest of sliding connector nest 108, and step 3736 parks the nest in its initial position by retracting the piston of air cylinder 1836. Step 3738 uses the outputs from the servo motor controller of motor 1800 to determine the angular position of the motor. In step 3740 it is determined which of several sequences of actions to take. It determines whether to rotate the slack takeup mechanism 104 to a first, second or third position using the present angular position of motor 1800. The choice of sequences is based on which of the three slots in table 1760 of mechanism 104 is the first to align with feed loop 1850 of tie mechanism 110 after the end of the cable has been reeled into the coiled portion of the cable. If slot 1 will be the first to align with feed loop 1850 path 3742 is taken. If the second slot will be the first to align with feed loop 1850, path 3744 is taken, and if the third slot will be first to align with feed loop 1850, path 3746 is taken. The numbering of the slots is arbitrary as long as the numbering is in numerical order and in the direction that cable slack takeup mechanism 104 rotates. If path 3742 is taken, step 3748 commands the servo motor controller to rotate motor 1800 to align slot 1 with feed loop 1850. Step 3750 closes feed loop 1850 around a coiled portion of cable 109, and step 3752 operates the tie unit to tie the coiled portion of the cable. Step 3754 opens loop 1850 and step 3756 rotates motor 1800 to align slot 3 with the feed loop. Inputs from microswitches on tie mechanism 110 are used to detect when loop 1850 is open or closed and when a tie operation is complete. If path 3744 is taken, steps 3758 through 3766 are executed. These steps are similar to steps 3748 to 3756 except that motor 1800 aligns slot 2 and then slot 1 with feed loop 1850. If path 3746 is taken, steps 3768 through 3776 are executed. These steps are similar to steps 3748–3756 except that motor 1800 aligns slot 3 and then slot 2 with loop 1850. After the execution of steps 3756, 3766 or 3776, step 3778 closes feed loop 1850 over the cable. Step 3780 operates tie mechanism 110 to tie the coiled portion of the cable, and step 3782 opens the feed loop. Step 3784 commands the servo motor controller of motor 1800 to rotate mechanism 104 to its parked position. Step 3786 sets the software that tells module Main II that the slack removal is complete. (See step 3596 of Main II). Step 3788 determines whether right transport 106 of cable transport 92 has gripped the cable by detecting when right transport 106 is positioned over cable mechanism 104 and when connector clamps 1568 and 1570 are closed. After it is determined that cable transport 92 has gripped the cable assembly, step 3790 releases the coiled and tied cable assembly from slack takeup mechanism 104 by retracting fingers 1762. Cable transport 92 then removes the cable assembly from mechanism 104. (See step 3598 of Main II).

Figure 49:
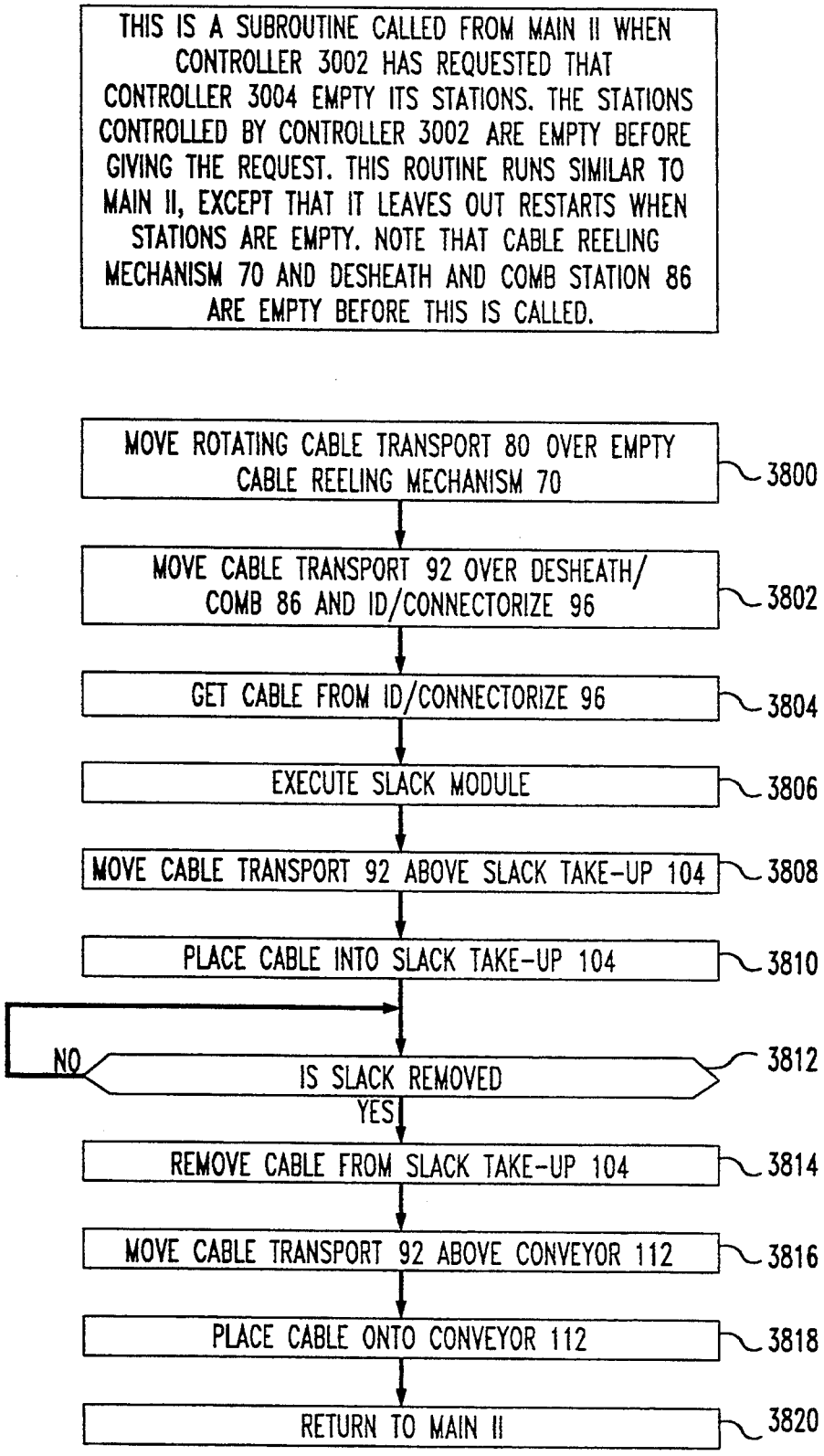
FIG. 49 is a flow chart of subroutine Empty.

FIG. 49 is a flow chart of the Empty module. This module is executed as a subroutine which is called by step 3532 of Main II. Empty is executed when controller 3002 tells controller 3004 that it should empty the mechanisms that it control. It should be noted that the mechanisms controlled by controller 3002 are empty before this request is passed to controller 3004. This routine is similar to Main II except that it leaves out the restarts when mechanisms or stations are empty. It should also be noted that cable reeling mechanism 70 and desheath and comb station 86 are also empty before this module is executed. Station 86 is empty because the empty routine is delayed for one loop through Main II after controller 3002 requests empty. Step 3800 moves rotating cable transport 80 over empty cable reeling mechanism 70. Step 3802 moves cable transport 92 to the left so that left cable transport mechanism 90 is positioned over station 86, and right cable transport mechanism 106 is positioned over identify and connectorization station 96. Step 3804 gets the connectorized cable from station 96 by lowering cable transport 106 and closing connector clamps 1568 and 1570, and cable coil clamps 106. After waiting for cable clamp 708 of station 96 to open, right cable transport 106 moves its cable clamp to an upper position. In step 3806 program module Slack is started. Recall that once program module Slack is started, it will begin execution and then wait for right cable transport 106 of cable transport 92 to place the cable in cable slack takeup mechanism 104 and sliding connector nest 108. Step 3808 moves cable transport 92 to the right so that right cable transport 106 is positioned above slack takeup mechanism 104. In step 3810 cable transport 106 moves its cable clamps to a lower position to place the cable assembly in takeup mechanism 104 and sliding connector nest 108. After fingers 1762 of cable slack takeup mechanism 104 have expanded to grasp the cable assembly, right cable transport 106 opens its cable clamps and raises the clamps to an upper position that does not interfere with the operation of slack takeup mechanism 104. In step 3812, the software flag which is set by the slack takeup module is checked to determine when the cable assembly is ready to be removed from mechanism 104. In step 3814, right cable transport 106 grasps the cable assembly in cable takeup mechanism 104, and after waiting for finger 1762 to retract, lifts the cable assembly out of cable takeup mechanism 104. Step 3816 moves cable transport 92 to its far right position to position right cable transport 106 over conveyor 112. Step 3818 commands right cable transport 106 to place the finished cable assembly on conveyor 112. Step 3820 returns to Main II where steps 3534 and 3520 are executed.

Figure 50:
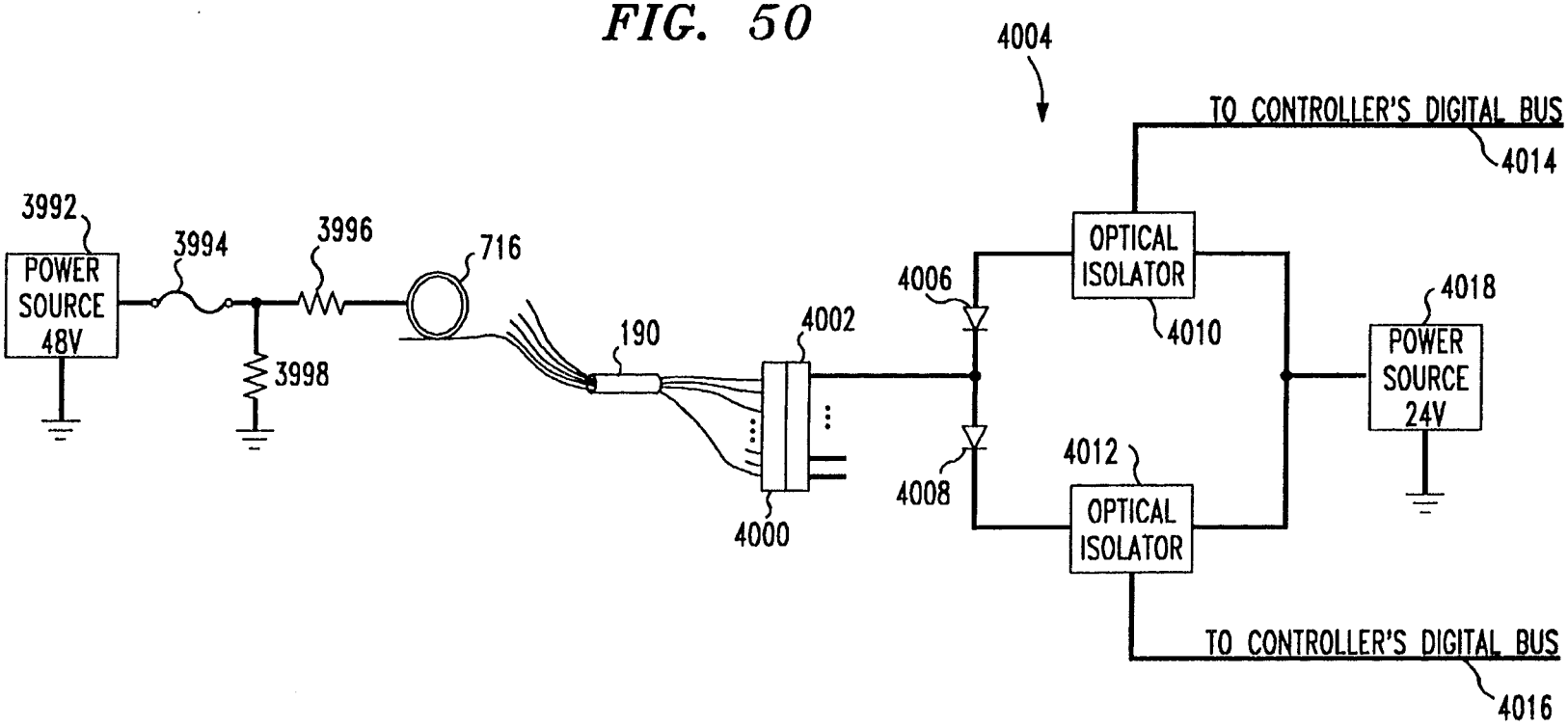
FIG. 50 illustrates a test circuit.

FIG. 50 illustrates the test circuit that is used to identify conductors within cable 190. This circuit is used by identify rand connectorization station 60, and by identify and connectorization station 96. Each station places 48 volts on the conductor under test by cutting through the conductor's insulation using identifier 716's cutting blade. The 48 volts is provided to identifier 716 by power source 3992 via fuse 3994 and current limiting resistor 3996. Resistor 3998 is used as a current drain to remove any residual charge that may remain after source 3992 is turned off. It is preferable to use a 1.5K ohm resistor as resistor 3996, and a 10K ohm resistor as resistor 3998. It is also preferable to use a 5 amp fuse as fuse 3994. The current from source 3992 travels through the conductor of cable 190 to connector 4000 that is wired to the end of cable 190. Connector 4000 makes electrical contact with mating connector 4002. For each contact of connector 4002, there is a circuit 4004. Circuit 4004 comprises diodes 4006 and 4008, optical isolators 4010 and 4012, digital bus lines 4014 and 4016, and 24 volt power source 4018.

There is a separate circuit, as illustrated in FIG. 50, for each of the identify and connectorization stations. When the test circuit is associated with identify and connectorization station 60, lines 4014 and 4016 are connected to controller 3002's addressable digital bus, and connectors 4000 and 4002 are located at the end of cable 190's spool of cable. As a result, the current traveling from identifier 716 to connector 4000 passes through the entire spool of cable from which cable 190 is being drawn. When the test circuit is associated with identify and connectorization station 96, lines 4014 and 4016 are connected to controller 3004's addressable digital bus, connector 4000 is the connector that was attached to cable 190 by station 60, and connector 4002 is located in the connector nest of cable holding mechanism 88.

Circuit 4004 is used to identify conductors that are in contact with identifier 716, and to verify that a conductor has been successfully inserted into the contact of a connector which is mounted on the grounded mandrel in the identify and connectorization station.

When a conductor is being identified, identifier 716 cuts through the conductor's insulation to place the 48 volts in contact with the conductor. After passing through the conductor under test, the current from 48 volt source 3992 passes through the contacts of connectors 4000 and 4002 and into circuit 4004. When 48 volts is applied to the conductor, current flows through diode 4008 and optical isolator 4012, and then to ground through 24 volt source 4018. As the current passes through device 4012, a logic level 1 is produced on output line 4016 which is attached to one of the addressable lines of the controller's digital bus. The conductor is identified by the controller addressing each of its digital bus lines to determine which circuit 4004 has a logic 1 on line 4016.

Circuit 4004 is also used to verify that a conductor was successfully inserted into a connector. When the identified conductor from cable 190 is inserted into a connector by the identify and connectorization station, the conductor is grounded via the connector which is mounted on the grounded mandrel in the identify and connectorization station. In this case, current travels from 24 volt source 4018 through optical isolator 4010, diode 4006 and the conductor under test, and then to ground through the grounded mandrel. When current flows through optical isolator 4010, a logic level 1 is produced on output line 4014 which is attached to one of the addressable lines of the controller's digital bus. The controller determines that the conductor was successfully inserted into the connector by detecting a change from logic to logic 1 on line 4014.

We claim:

1. A conductor handling apparatus, comprising:

rotating disk means for moving a single conductor to a first position on a path;

conductor identifier means for identifying said conductor by completing a circuit used to detect a signal on said conductor, said conductor identifier means being located at said first position on said path;

control means for controlling said rotating disk means, said control means causing said rotating disk mean to rotate in a direction based on a conductor identity determined using said conductor identifier means;

conductor unload means for removing said conductor from said rotating disk means; and conductor transfer means for moving said conductor from said conductor unload means to a predetermined position based on said conductor identity, said conductor transfer mechanism grasping said conductor between a first surface and a second surface that move toward each other.

2. The apparatus of claim 1, wherein said conductor unload means comprises a spring loaded cam surface.

3. The apparatus of claim 1, wherein said first surface is supported by a first member and said second surface is supported by a second member, said second member being pivotally attached to said first member.

4. The apparatus of claim 3, wherein first member moves between a first position and a second position.

5. A conductor handling apparatus, comprising:
rotating disk means for moving a single conductor to a first position on a path;
conductor identifier means for identifying said conductor by completing a circuit used to detect a signal on said conductor, said conductor identifier means being located at said first position on said path;
control means for controlling said rotating disk means, said control means causing said rotating disk means to move said conductor to a second position on said path and back to said first position when a short circuit is detected using said conductor identifier means;
conductor unload means for removing said conductor from said rotating disk means; and
conductor transfer means for moving said conductor from said conductor unload means to a predetermined position based on a conductor identity determined using said conductor identifier means.

6. The apparatus of claim 5, wherein said conductor unload means comprises a spring loaded cam surface.

7. The apparatus of claim 5, wherein said control means causes said rotating disk mean to rotate in a direction based on said conductor identity.

8. The apparatus of claim 5, wherein said conductor transfer means comprises a first and a second surface that grasp said conductor.

9. The apparatus of claim 8, wherein said first surface is supported by a first member and said second surface is supported by a second member, said second member being pivotally attached to said first member.

10. The apparatus of claim 9, wherein first member moves between a first position and a second position.

11. A conductor handling apparatus, comprising:
rotating disk means for moving a single conductor to a first position on a path;
first conductor identifier means for identifying said conductor by completing a first circuit used to detect a signal on said conductor, said conductor identifier means being located at said first position on said path;
second conductor identifier means for identifying said conductor by completing a second circuit used to detect a signal on said conductor, said conductor identifier means being located at a second position on said path;
control means for controlling said rotating disk means, said control means causing said rotating disk means to move said conductor to said second position on said circular path when a short circuit is detected using said first conductor identifier means;
conductor unload means for removing said conductor from said rotating disk means; and
conductor transfer means for moving said conductor from said conductor unload means to a predetermined position based on a conductor identity determined using at least one of said conductor identifier means.

12. The apparatus of claim 11, wherein said conductor unload means comprises a spring loaded cam surface.

13. The apparatus of claim 11, wherein said control means causes said rotating disk mean to rotate in a direction based on said conductor identity.

14. The apparatus of claim 11, wherein said conductor transfer means comprises a first and a second surface that grasp said conductor.

15. The apparatus of claim 14, wherein said first surface is supported by a first member and said second surface is supported by a second member, said second member being pivotally attached to said first member.

16. The apparatus of claim 15, wherein first member moves between a first position and a second position.

17. A method for handling conductors, comprising the steps of:
moving a single conductor to a first position on a path using a rotating disk;
identifying said conductor while at said first position by completing a circuit used to detect a signal on said conductor;
rotating said disk in a direction based on a conductor identity;
moving said conductor from said rotating disk to an unload position; and
moving said conductor from said unload position to a predetermined position based on said conductor identity by grasping said conductor between a first surface and a second surface that move toward each other.

18. A method for handling conductors, comprising the steps of:
moving a single conductor to a first position on a path using a rotating disk;
identifying said conductor while at said first position by completing a circuit used to detect a signal on said conductor;
rotating said disk to move said conductor to a second position on said path and back to said first position when a short circuit is detected;
moving said conductor from said rotating disk to an unload position; and
moving said conductor from said unload position to a predetermined position based on said conductor identity.

19. A method for handling conductors, comprising the steps of:
moving a single conductor to a first position on a path using a rotating disk;
completing a first circuit used to detect a signal on said conductor while at said first position;
rotating said disk to move said conductor to a second position on said path when said step of completing a first circuit results in a short circuit;
completing a second circuit used to detect a signal on said conductor while at said second position to identify said conductor;
moving said conductor from said rotating disk to an unload position; and
moving said conductor from said unload position to a predetermined position based on said conductor identity.

20. A conductor handling apparatus, comprising:
combing means for forming a linear array of conductors from a collection of conductors extending from a desheathed end of a multi-conductor cable, said combing means having a first and a second surface that move toward each other to capture said collection of conductors between said surfaces;
rotating disk means for moving a single conductor from said linear array to a first position on a path;

conductor identifier means for identifying said conductor by completing a circuit used to detect a signal on said conductor, said conductor identifier means being located at said first position on said path;

control means for controlling said rotating disk means, said control means causing said rotating disk mean to rotate in a direction based on a conductor identity determined using said conductor identifier means;

conductor unload means for removing said conductor from said rotating disk means; and conductor transfer means for moving said conductor from said conductor unload means to a predetermined position based on said conductor identity.

21. The apparatus of claim 20, wherein said combing means moves said first and second surfaces in a direction away from said desheathed end to form said linear array.

22. A method for handling conductors, comprising the steps of:

forming a linear array of conductors from a collection of conductors extending from a desheathed end of a multi-conductor cable by moving a first and a second surface toward each other to capture said collection of conductors between said surfaces;

moving a single conductor to a first position on a path using a rotating disk;

identifying said conductor while at said first position by completing a circuit used to detect a signal on said conductor;

rotating said disk in a direction based on a conductor identity;

moving said conductor from said rotating disk to an unload position; and moving said conductor from said unload position to a predetermined position based on said conductor identity.

* * * * *